US008777456B2

(12) United States Patent
Mahalingam et al.

(10) Patent No.: US 8,777,456 B2
(45) Date of Patent: Jul. 15, 2014

(54) THERMAL MANAGEMENT OF LED-BASED ILLUMINATION DEVICES WITH SYNTHETIC JET EJECTORS

(75) Inventors: Raghavendran Mahalingam, Austin, TX (US); Samuel N. Heffington, Tulsa, OK (US); Stephen P. Darbin, Austin, TX (US); Daniel N. Grimm, Round Rock, TX (US); Brandon Lee Noska, Hallettsville, TX (US)

(73) Assignee: Nuventix, Inc., Austin, TX (US)

( * ) Notice: Subject to any disclaimer, the term of this patent is extended or adjusted under 35 U.S.C. 154(b) by 176 days.

(21) Appl. No.: 13/470,523

(22) Filed: May 14, 2012

(65) Prior Publication Data

US 2012/0287637 A1 Nov. 15, 2012

Related U.S. Application Data

(63) Continuation-in-part of application No. 12/902,295, filed on Oct. 12, 2010, now Pat. No. 8,579,476, which is a continuation-in-part of application No. 12/503,181, filed on Jul. 15, 2009, now abandoned, and a continuation-in-part of application No. 12/503,832, filed on Jul. 15, 2009, now Pat. No. 8,299,691.

(60) Provisional application No. 61/134,984, filed on Jul. 15, 2008, provisional application No. 61/486,838, filed on May 17, 2011, provisional application No. 61/134,966, filed on Jul. 15, 2008.

(51) Int. Cl.
*F21V 29/00* (2006.01)
*F21V 29/02* (2006.01)

(52) U.S. Cl.
CPC ..... *F12V 29/00* (2013.01); *F12V 29/004* (2013.01); *F21V 29/02* (2013.01)
USPC ..... 362/294

(58) Field of Classification Search
CPC ... F21V 29/004; F21V 29/02; F21V 29/2293; F21V 29/00; F21V 29/20
See application file for complete search history.

(56) References Cited

U.S. PATENT DOCUMENTS

| | | | | |
|---|---|---|---|---|
| 5,688,042 | A | 11/1997 | Madadi et al. | |
| 7,401,945 | B2 | 7/2008 | Zhang | |
| 7,568,817 | B2 | 8/2009 | Lee et al. | |
| 7,637,636 | B2 | 12/2009 | Zheng et al. | |
| 8,066,410 | B2 * | 11/2011 | Booth et al. | 362/294 |
| 8,240,885 | B2 * | 8/2012 | Miller | 362/294 |
| 8,317,358 | B2 | 11/2012 | Chou | |
| 8,319,406 | B2 * | 11/2012 | Radermacher | 313/12 |
| 8,506,105 | B2 * | 8/2013 | Sharma et al. | 362/96 |
| 8,529,097 | B2 * | 9/2013 | Arik et al. | 362/294 |
| 8,529,105 | B2 * | 9/2013 | Calon et al. | 362/373 |
| 8,559,175 | B2 * | 10/2013 | Huisman et al. | 361/689 |
| 2010/0124058 | A1 * | 5/2010 | Miller | 362/249.02 |
| 2010/0207501 | A1 * | 8/2010 | Radermacher | 313/46 |
| 2011/0110108 | A1 * | 5/2011 | Calon et al. | 362/373 |
| 2011/0204790 | A1 * | 8/2011 | Arik et al. | 315/113 |
| 2013/0083520 | A1 * | 4/2013 | Booth et al. | 362/234 |

* cited by examiner

*Primary Examiner* — Bao Q Truong
(74) *Attorney, Agent, or Firm* — John A. Fortkort; Fortkort & Houston P.C.

(57) ABSTRACT

An illumination device (b1-01) is provided which comprises a housing (b1-03) equipped with an aperture (b1-37), first (b1-33) and second (b1-35) diaphragms disposed in said housing and in fluidic communication with said aperture, and an LED (b1-15) disposed between said first and second diaphragms.

20 Claims, 48 Drawing Sheets

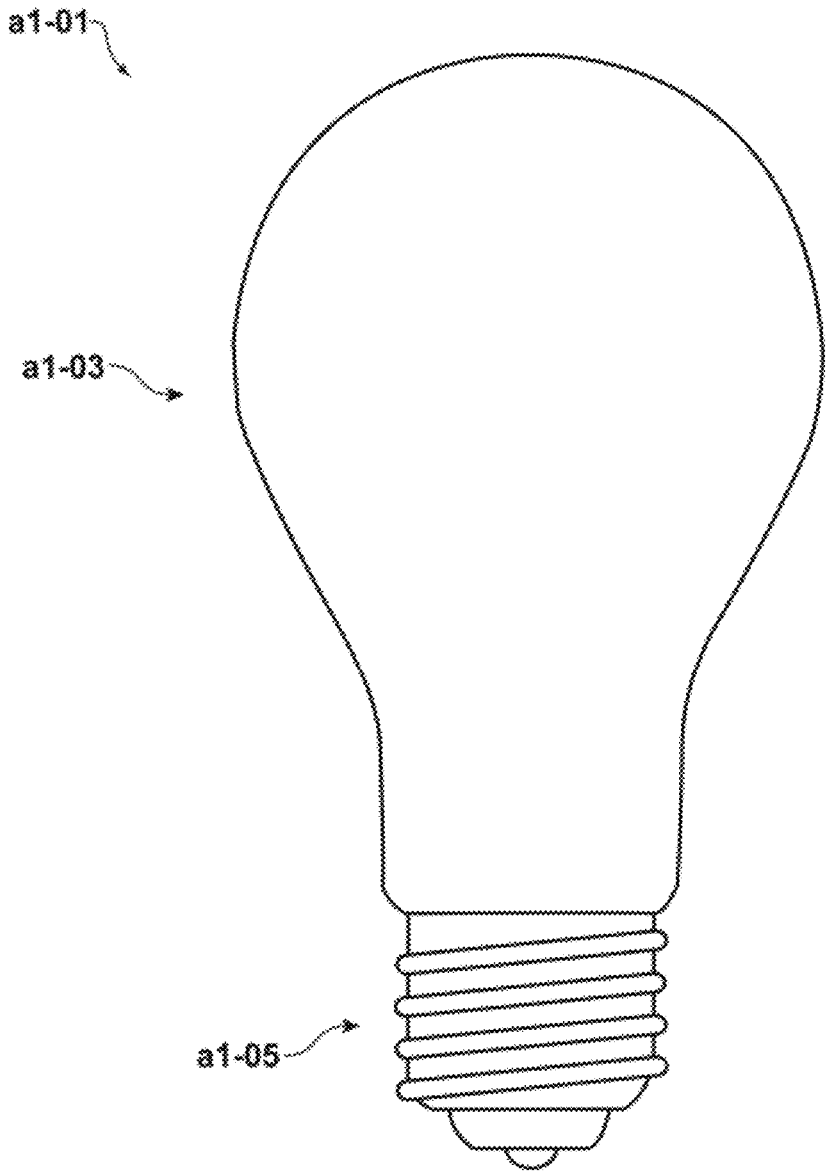
*FIG. A1-1*

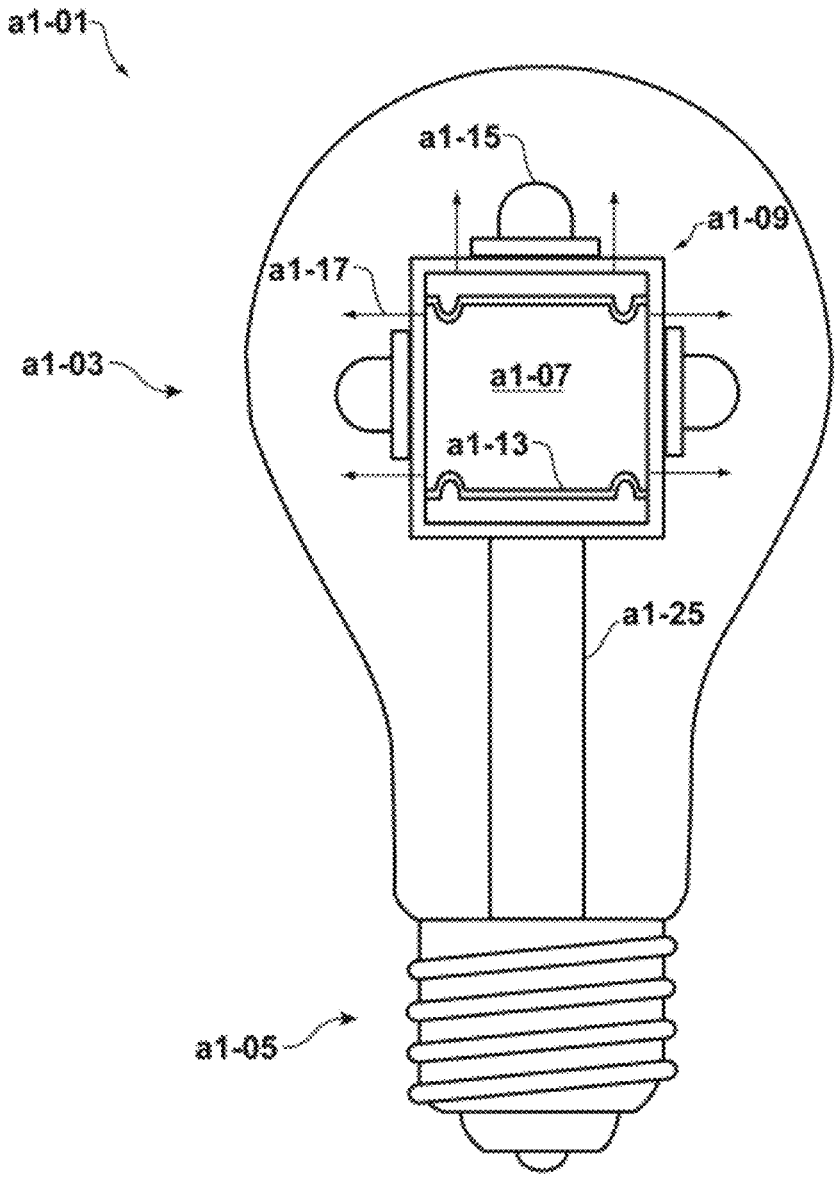
*FIG. A1-2*

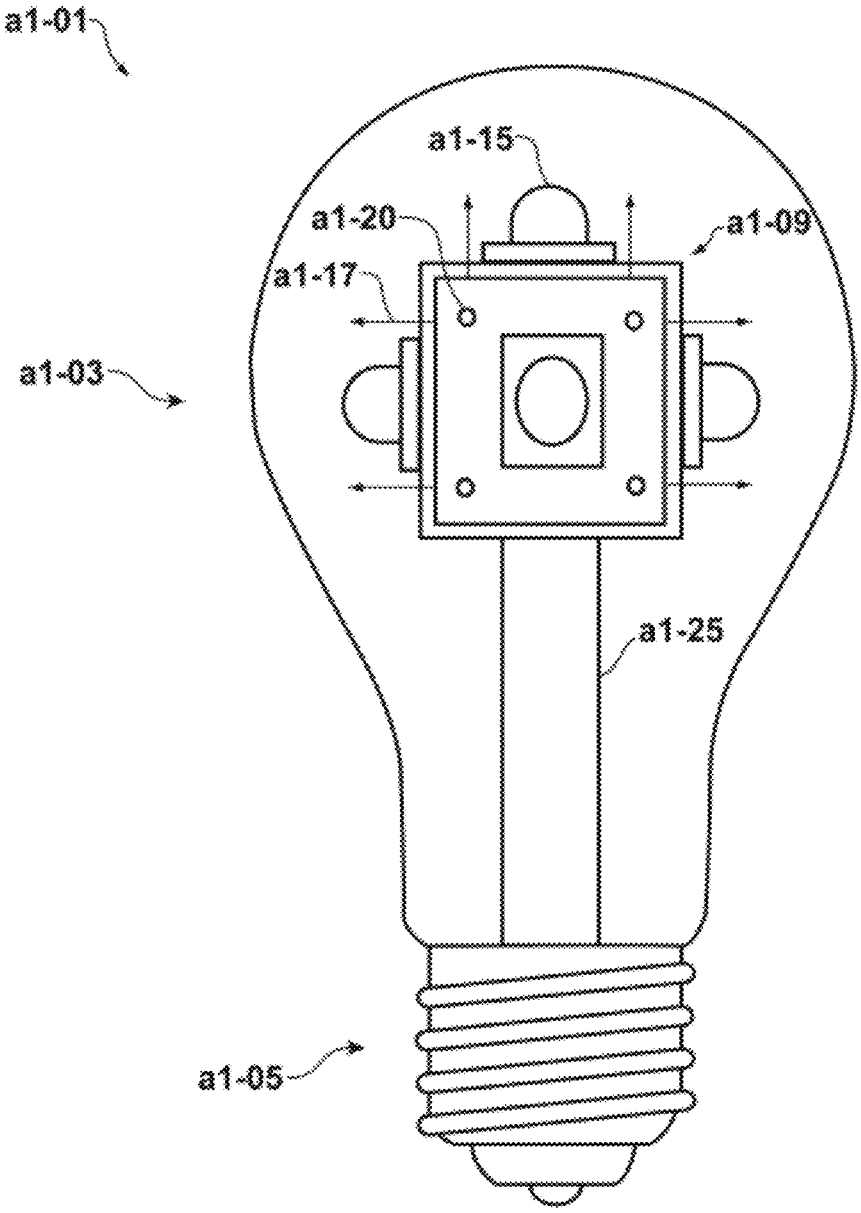
*FIG. A1-3*

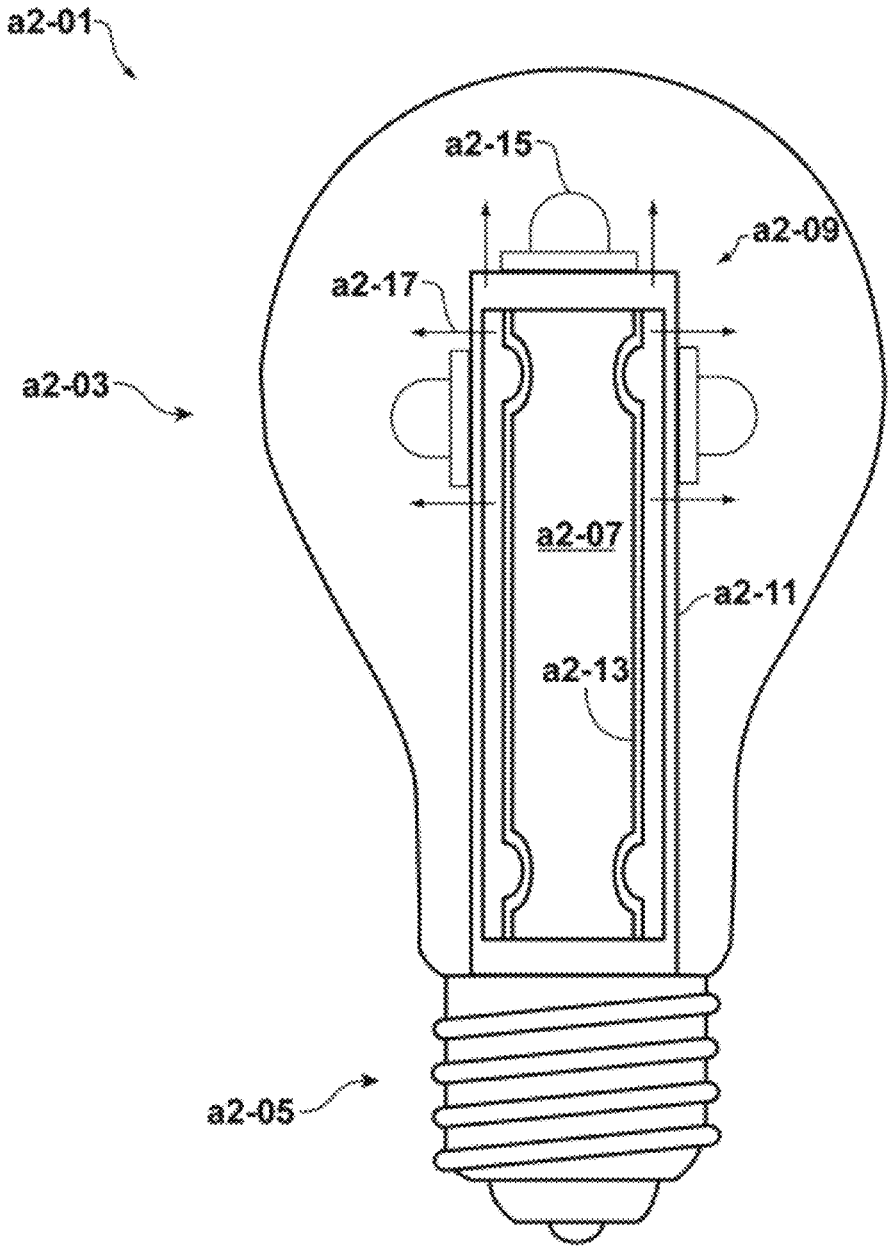
*FIG. A2-1*

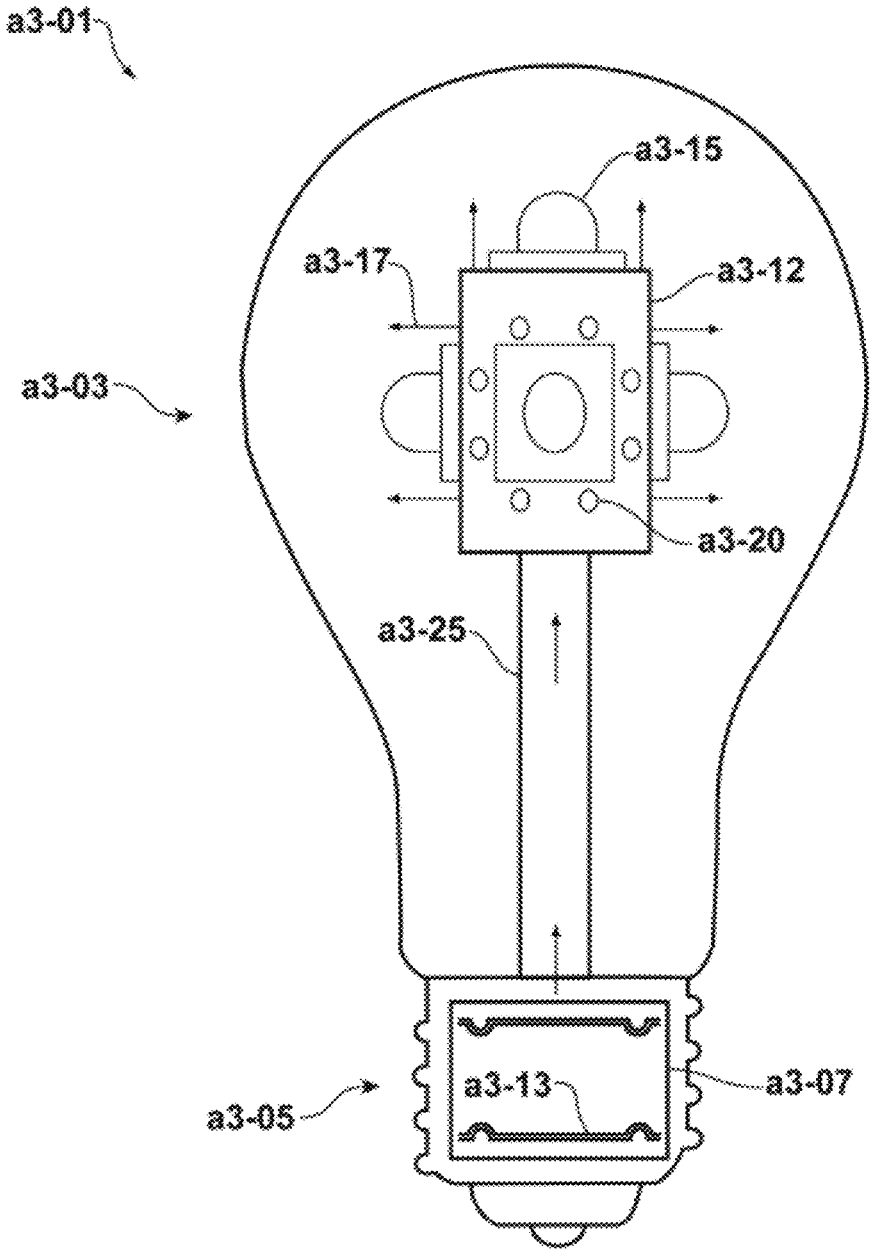
*FIG. A3-1*

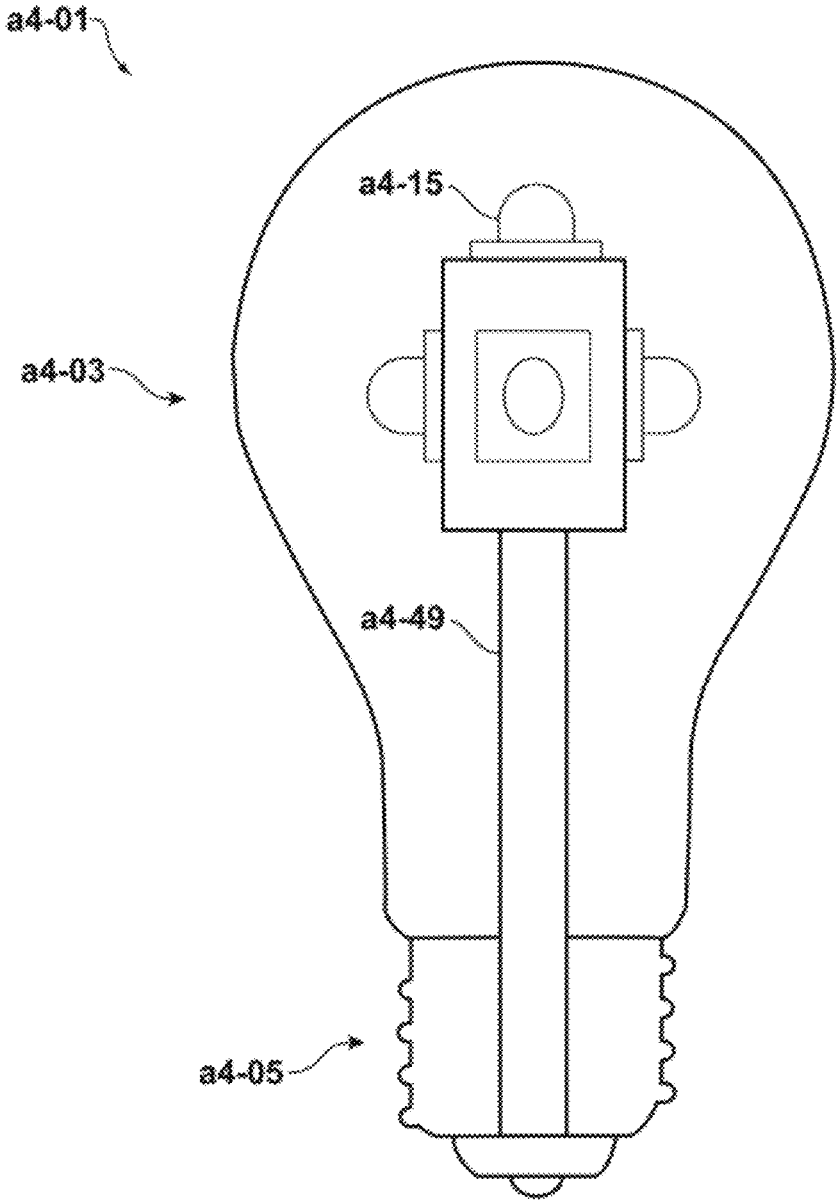
*FIG. A4-1*

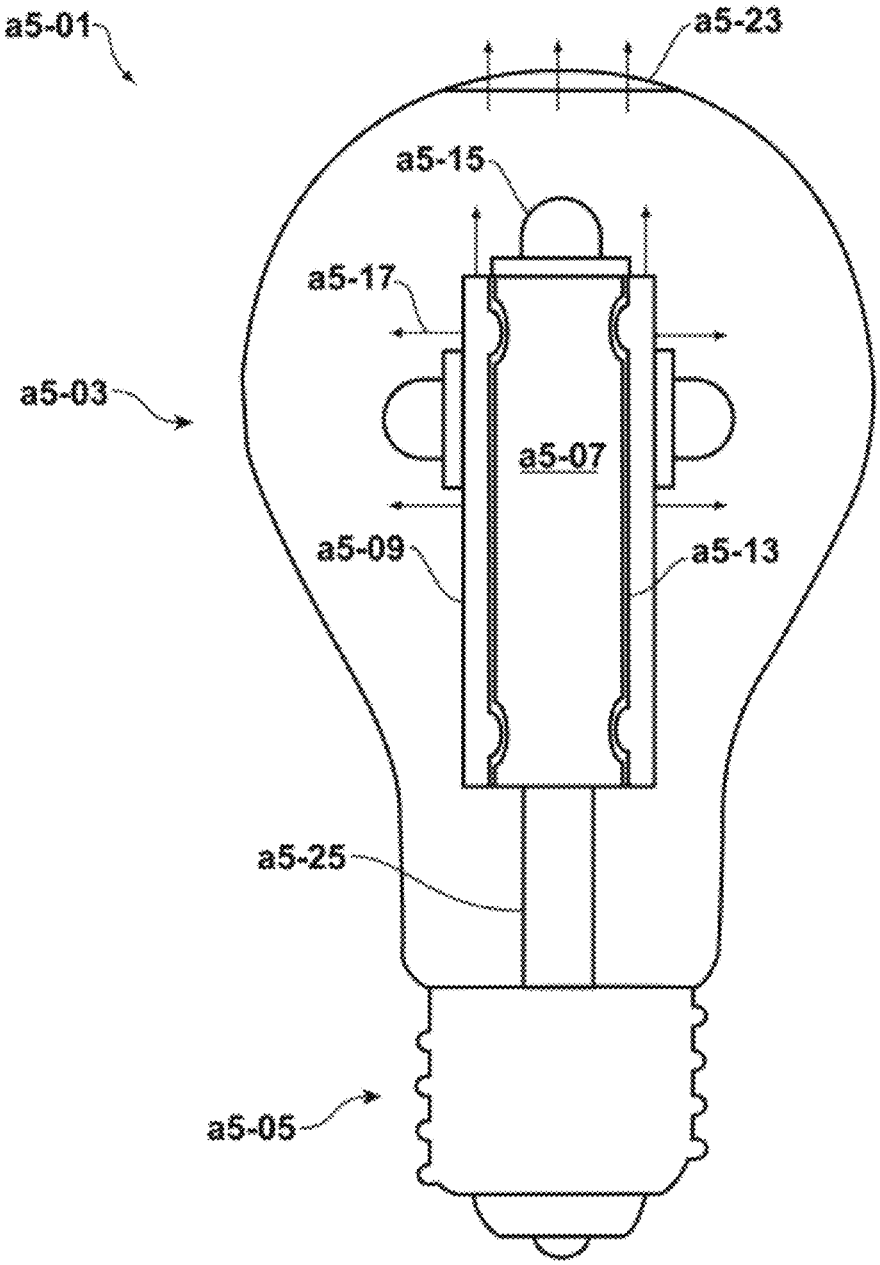
*FIG. A5-1*

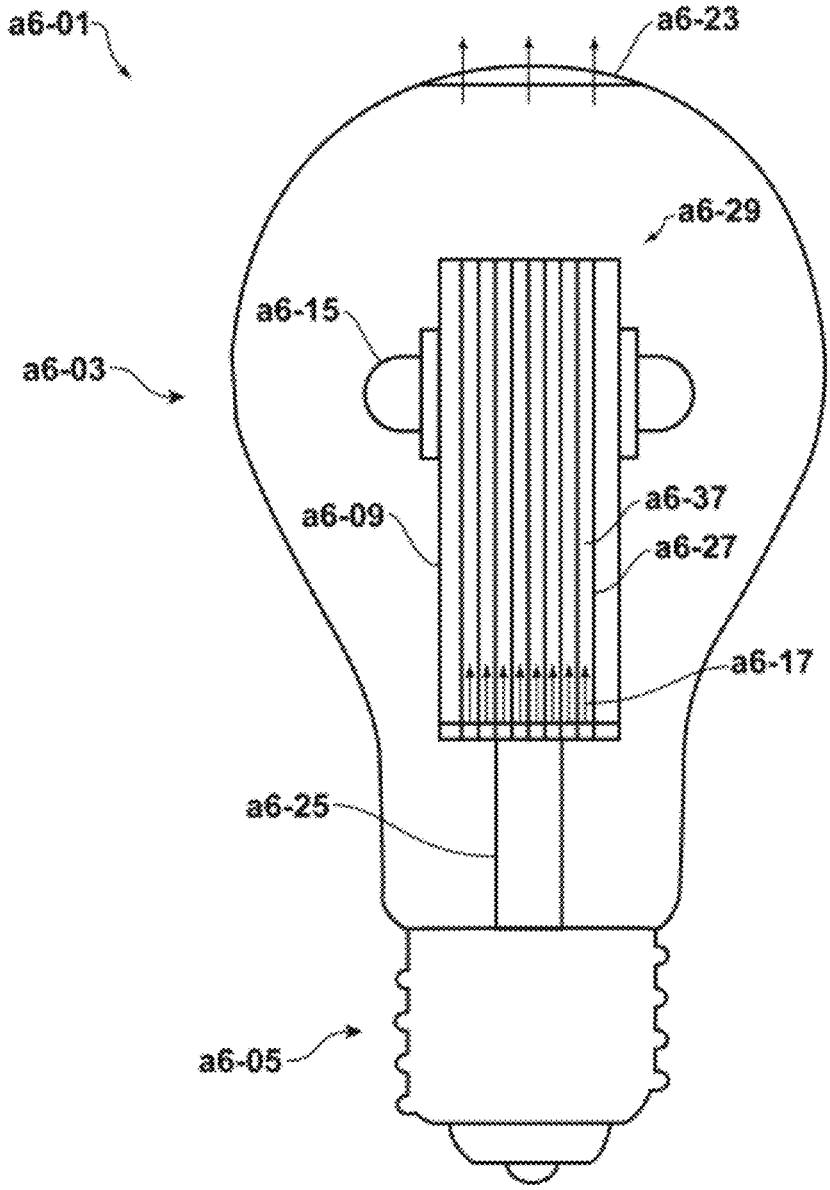
*FIG. A6-1*

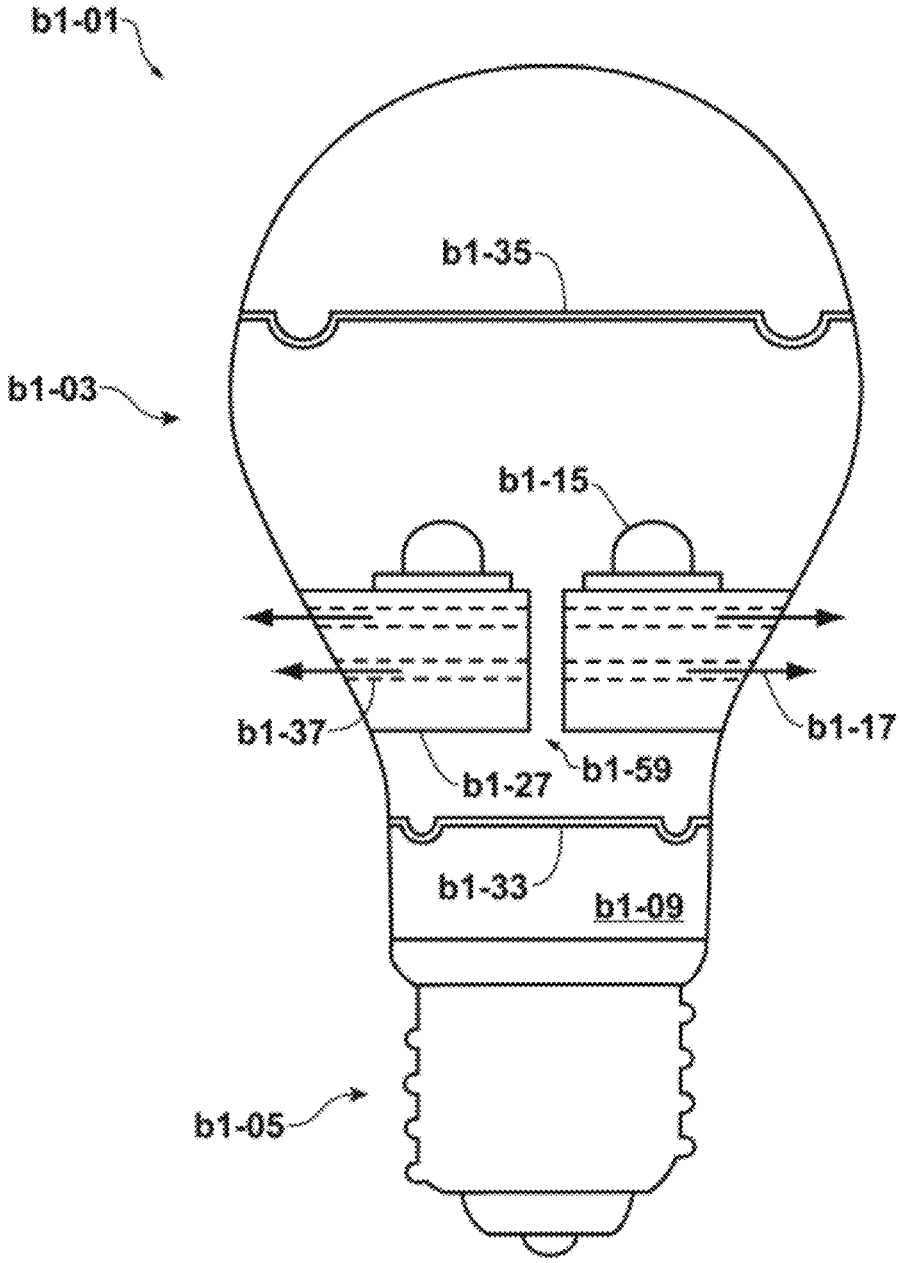
*FIG. B1-1*

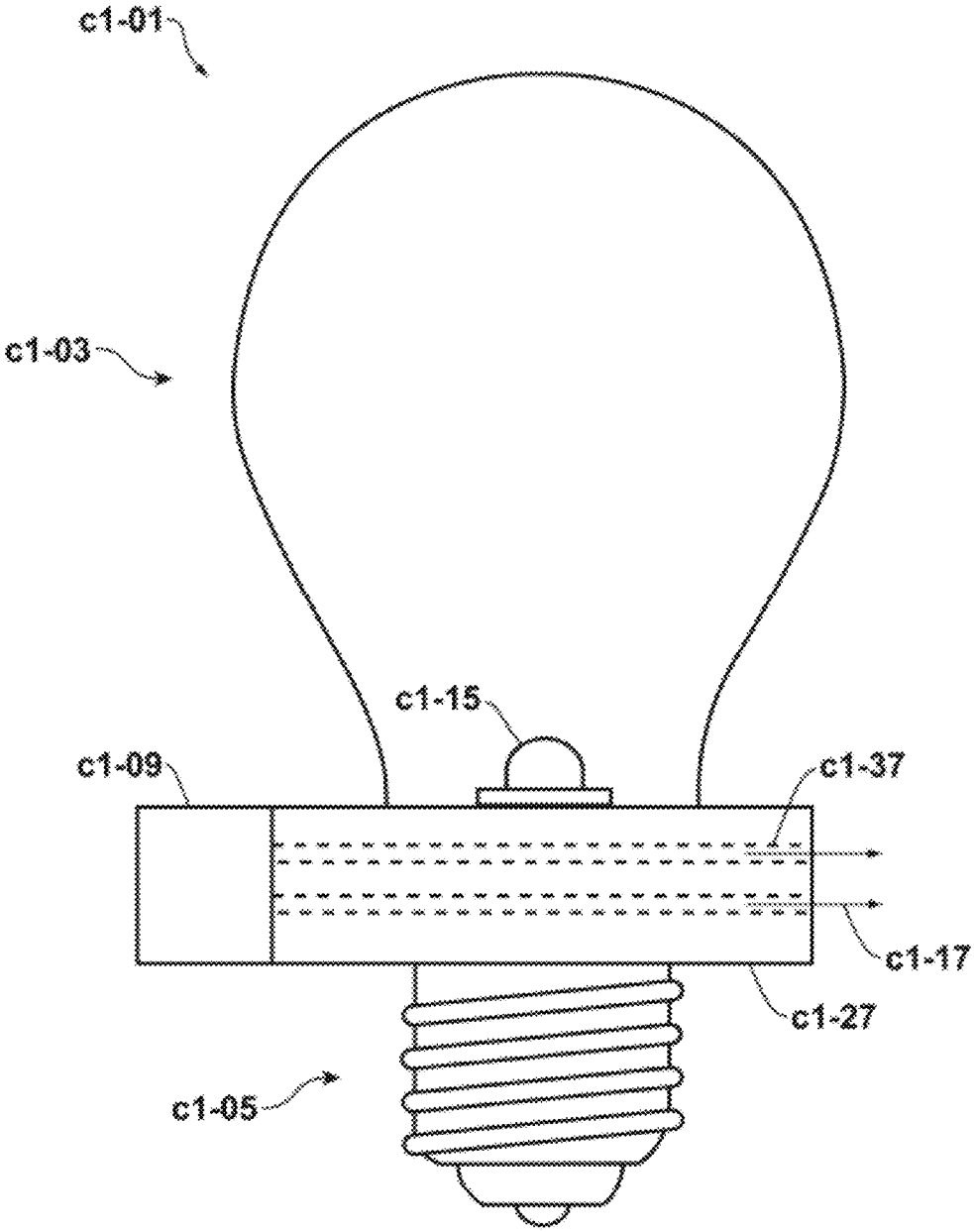
*FIG. C1-1*

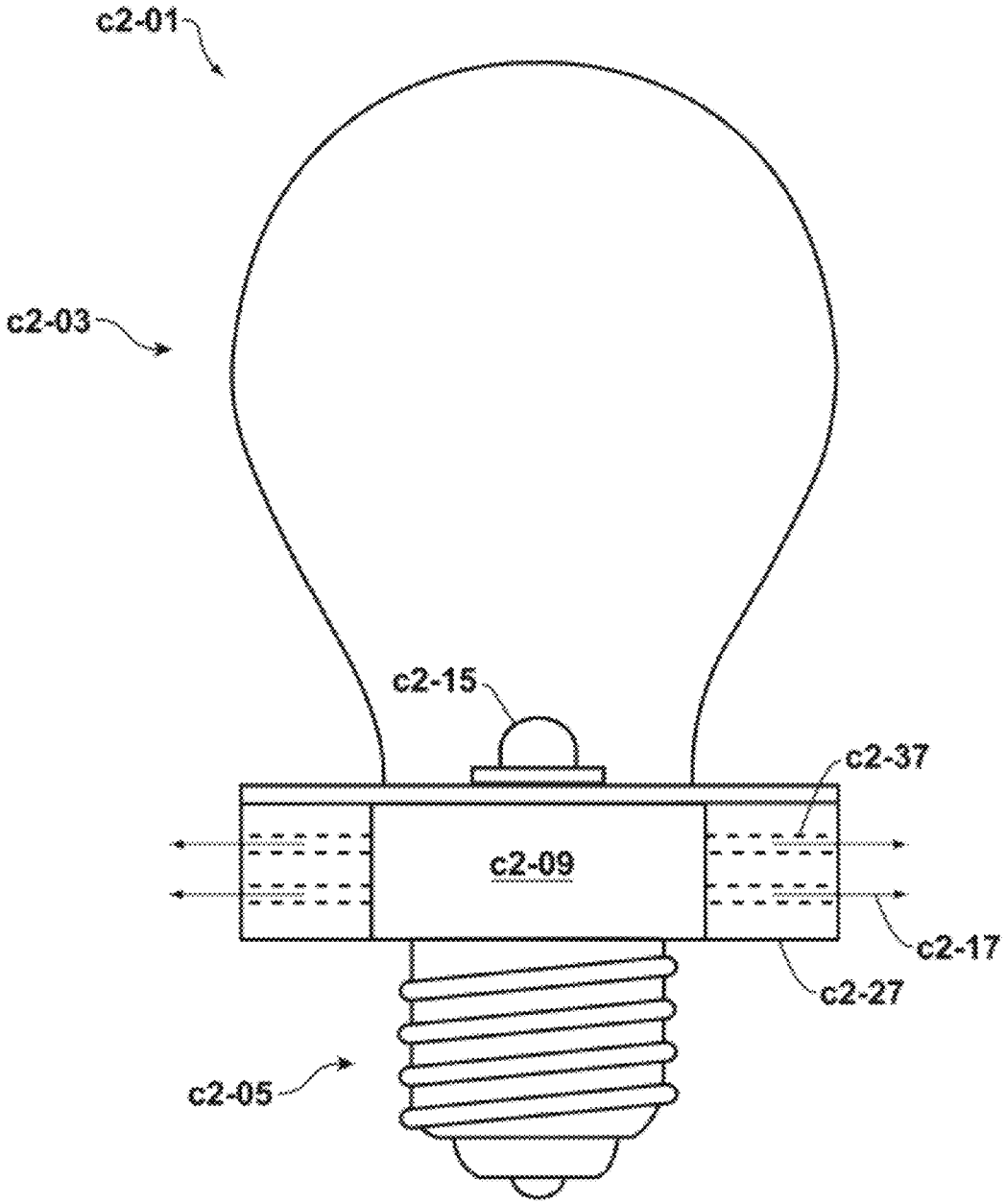
*FIG. C2-1*

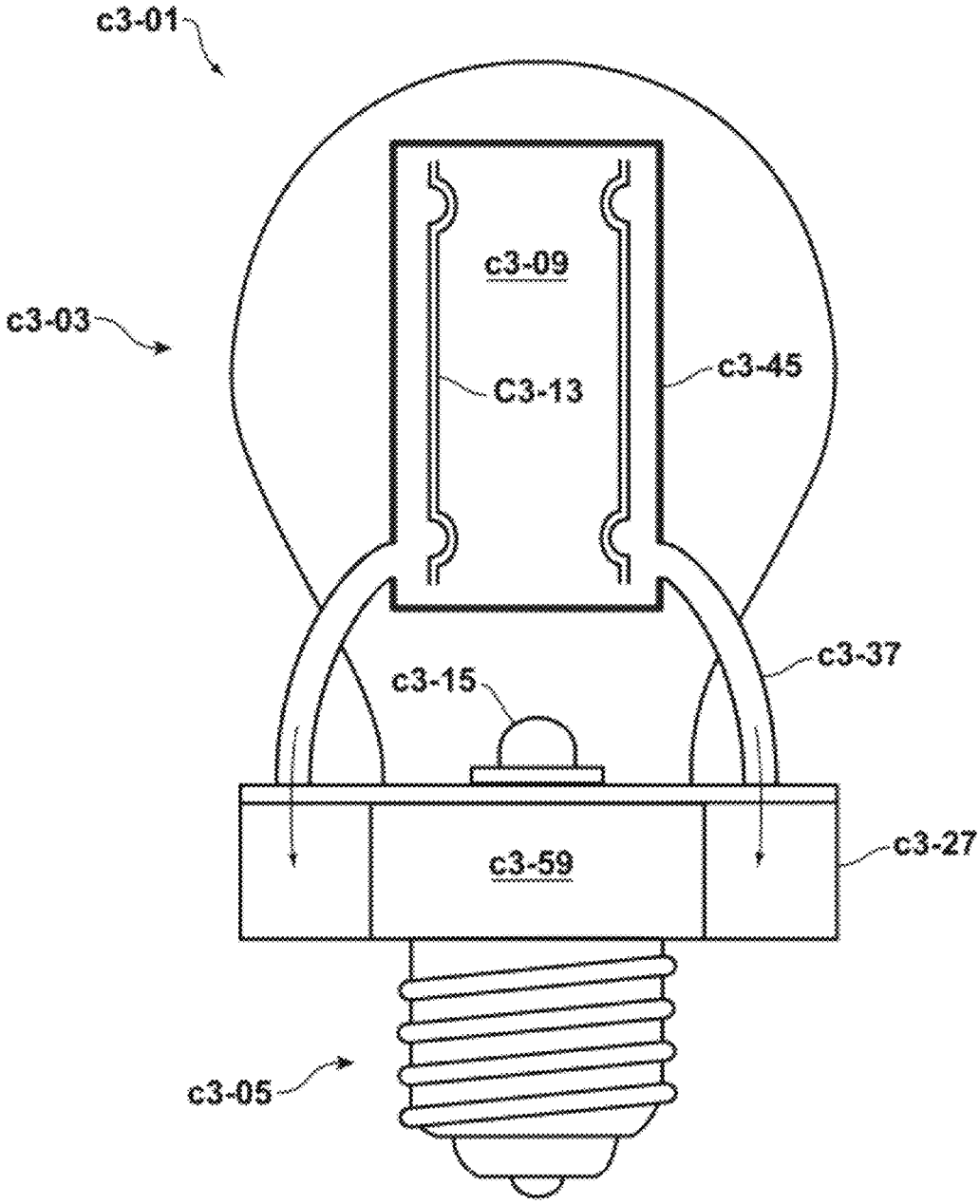
*FIG. C3-1*

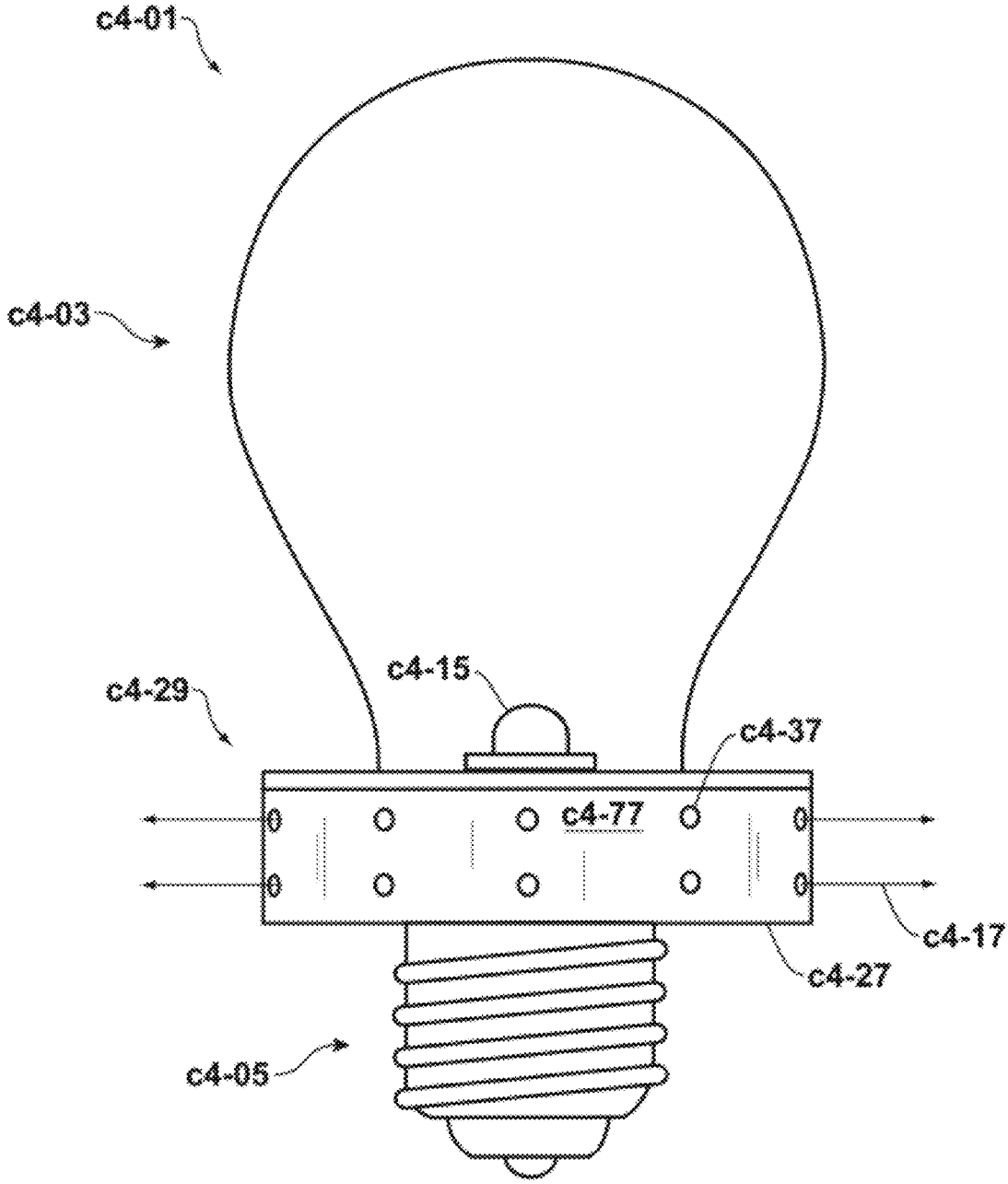
*FIG. C4-1*

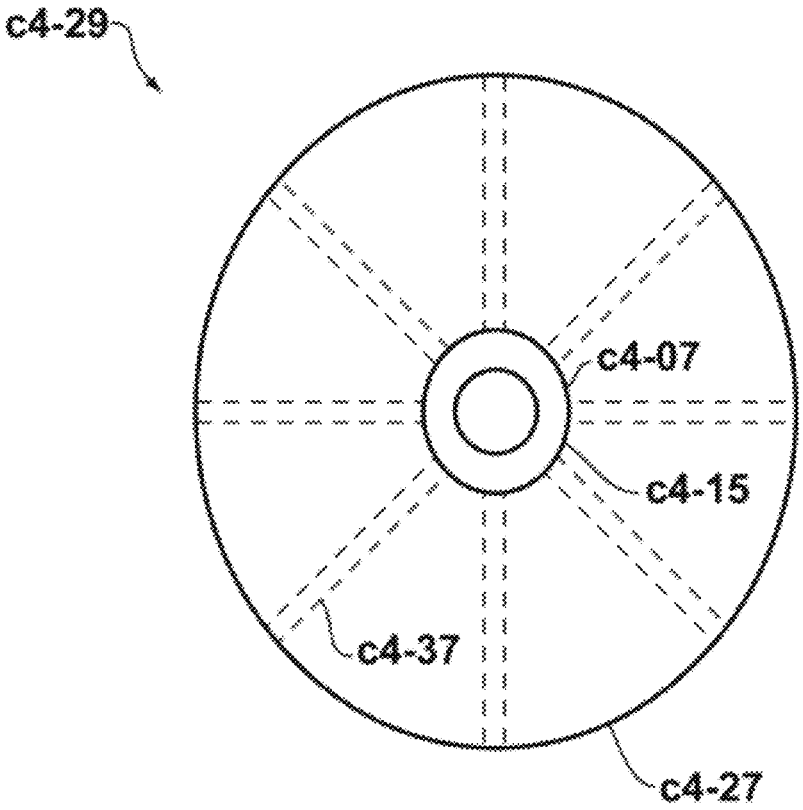
*FIG. C4-2*

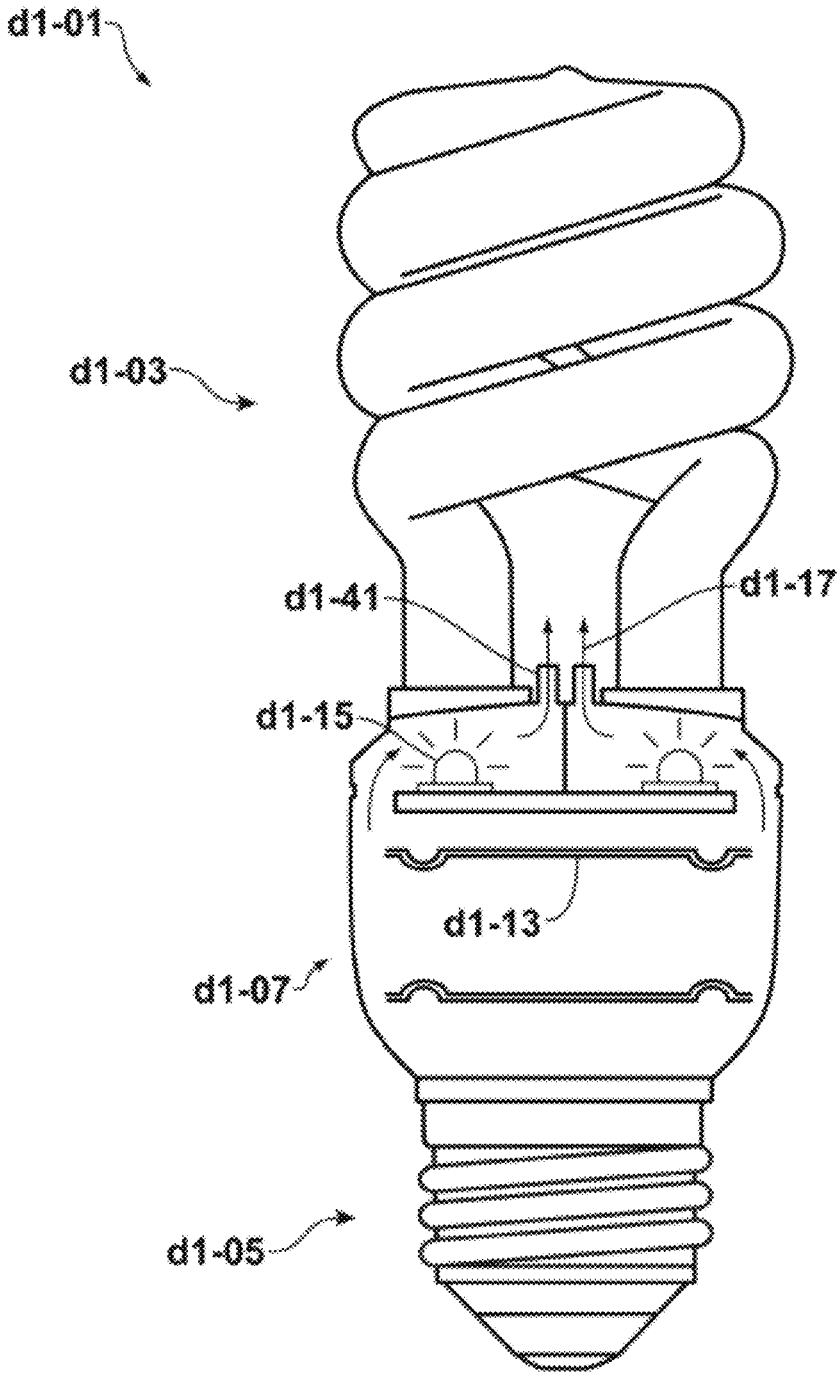
*FIG. D1-1*

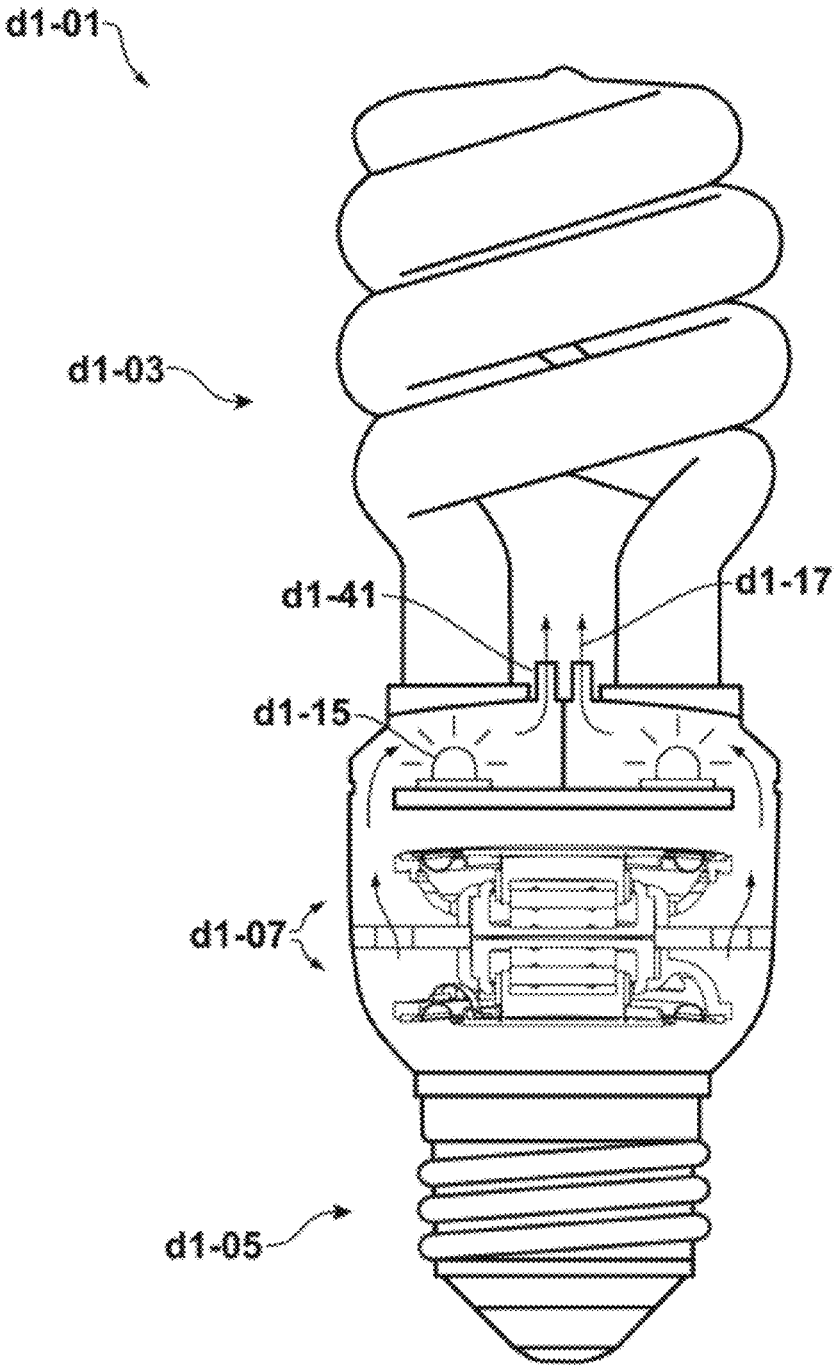
*FIG. D1-2*

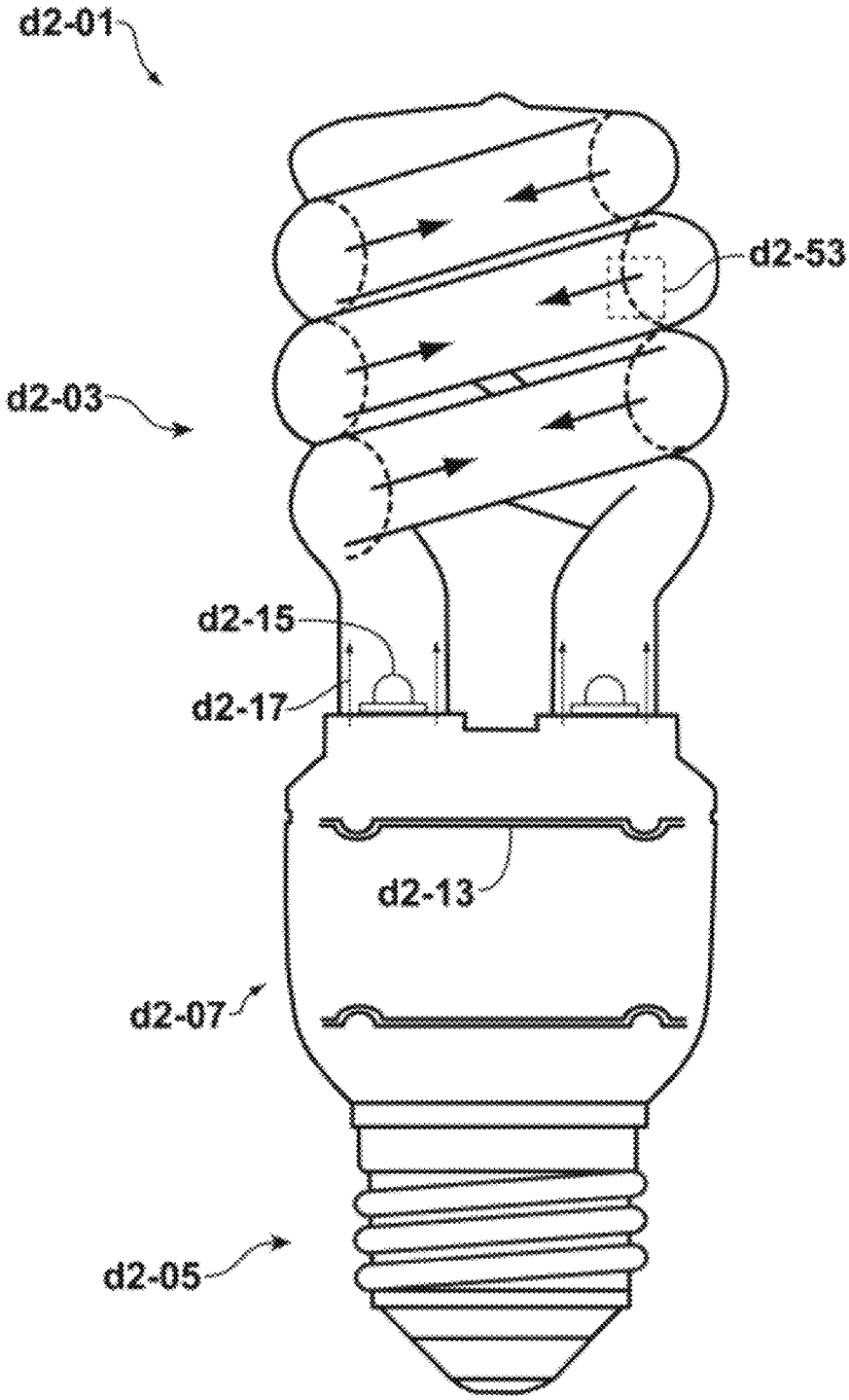
*FIG. D2-1*

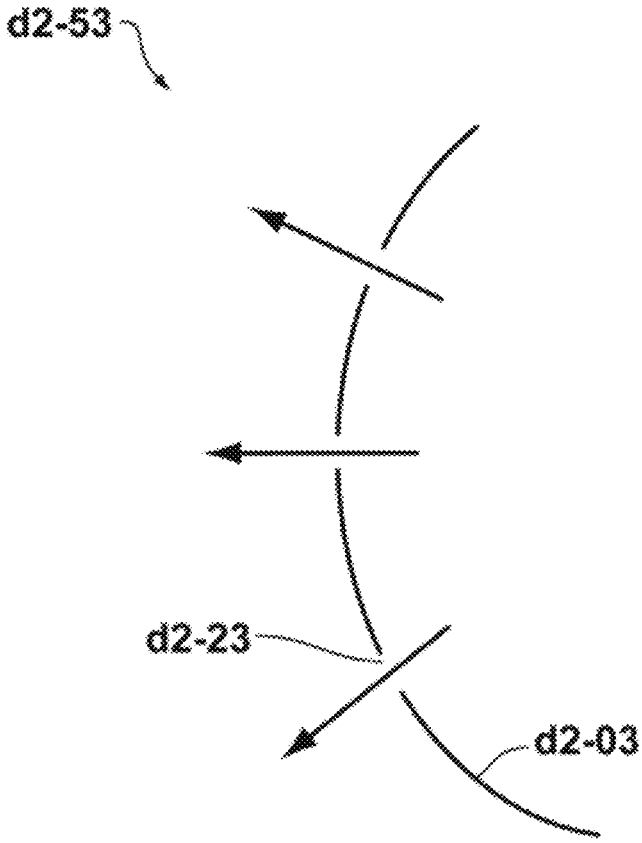
*FIG. D2-2*

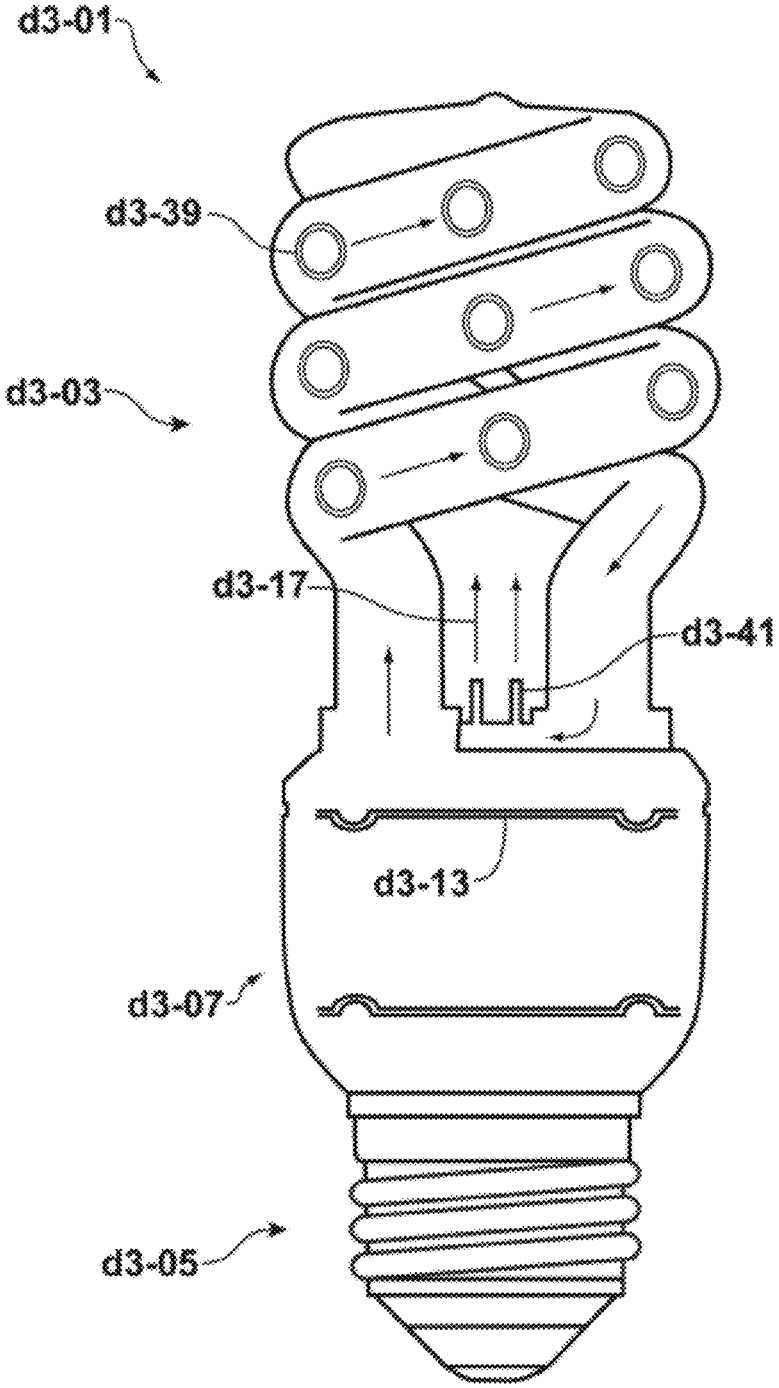
*FIG. D3-1*

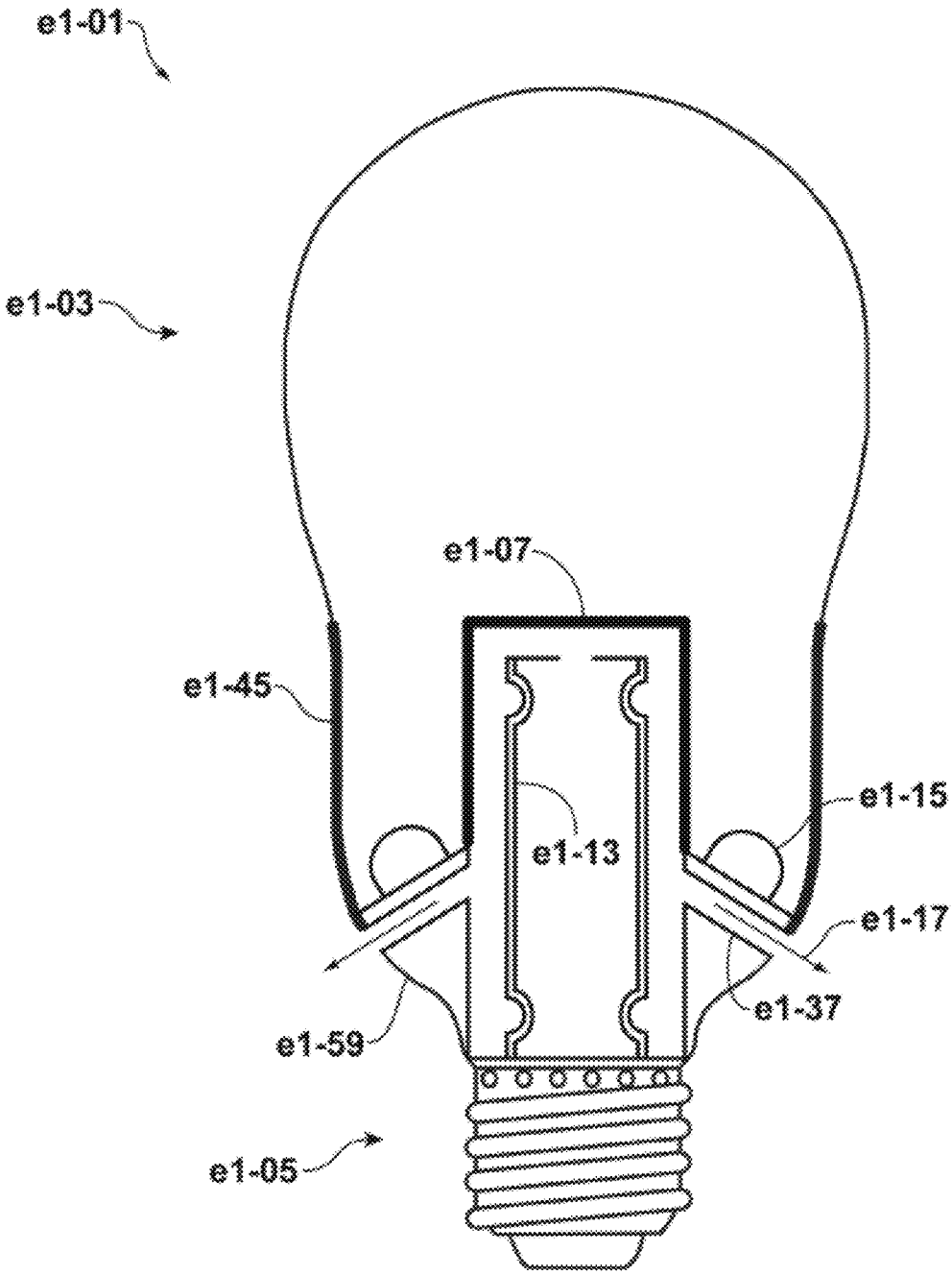
*FIG. E1-1*

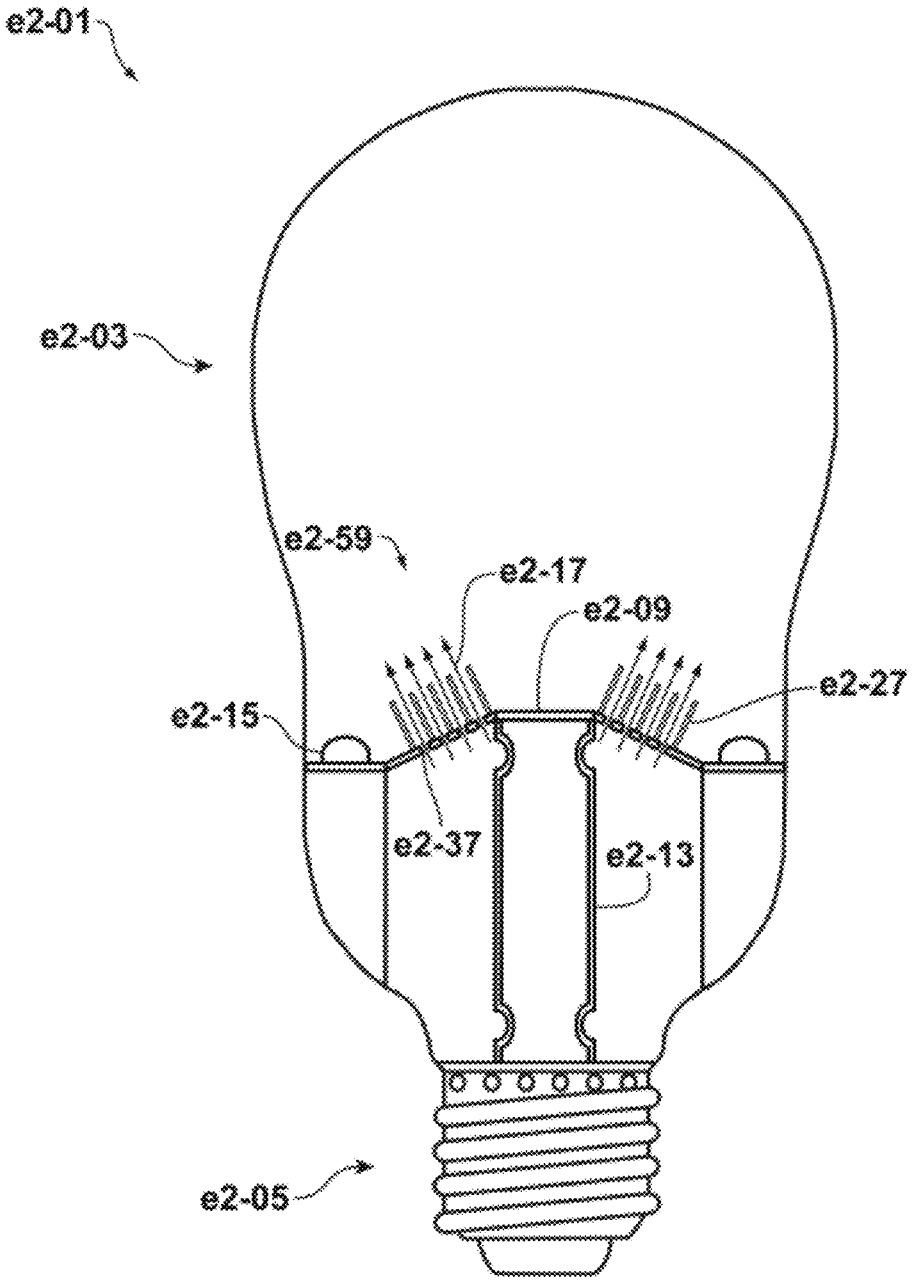
*FIG. E2-1*

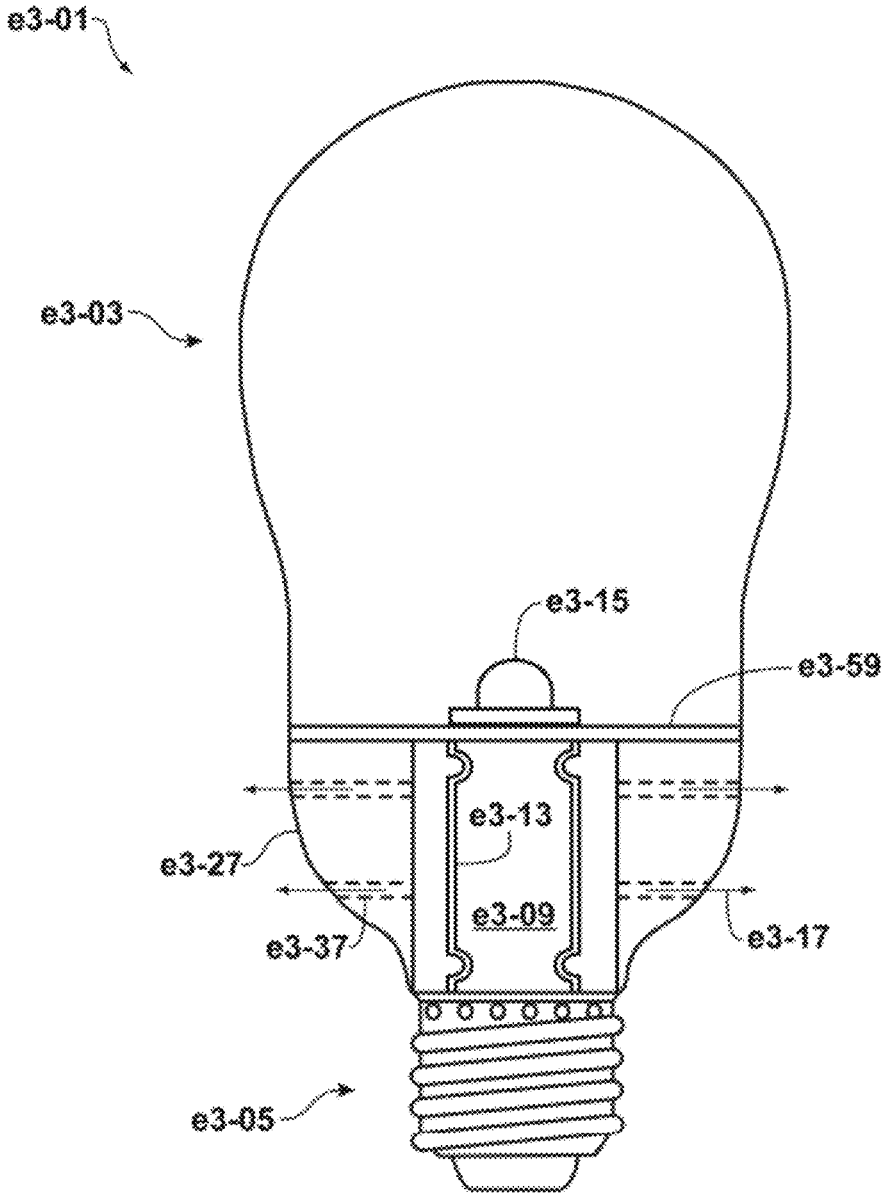
*FIG. E3-1*

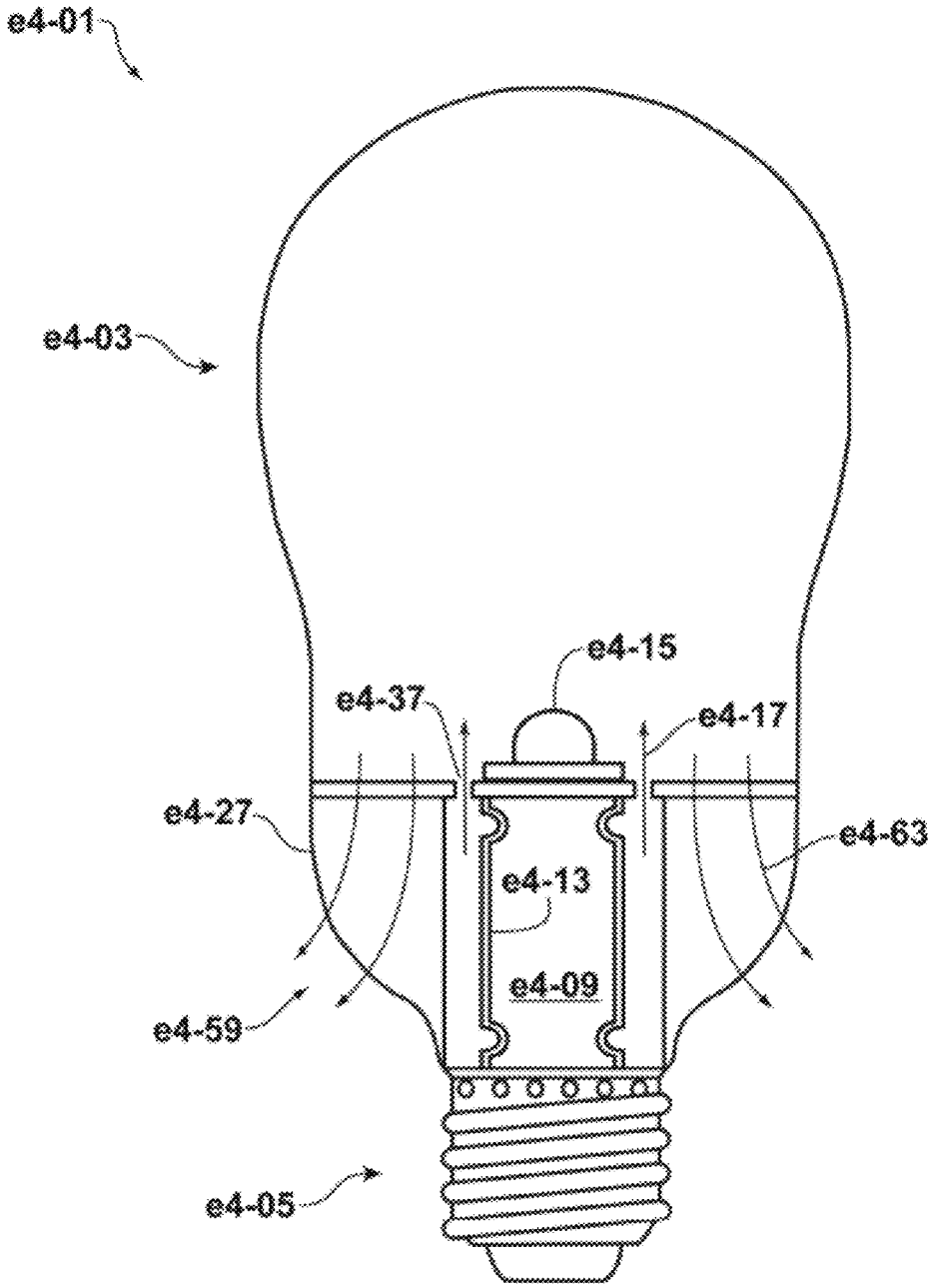
*FIG. E4-1*

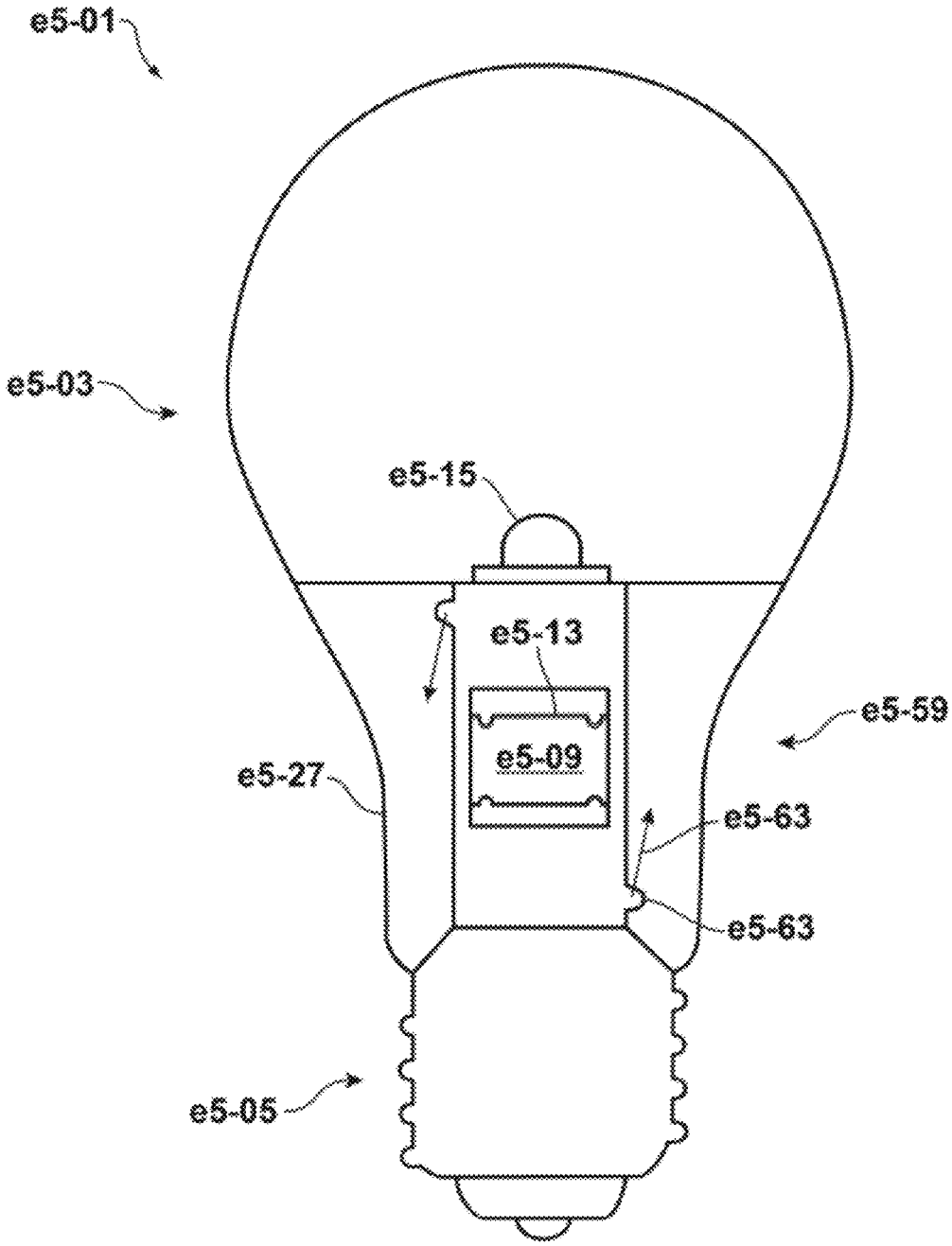
*FIG. E5-1*

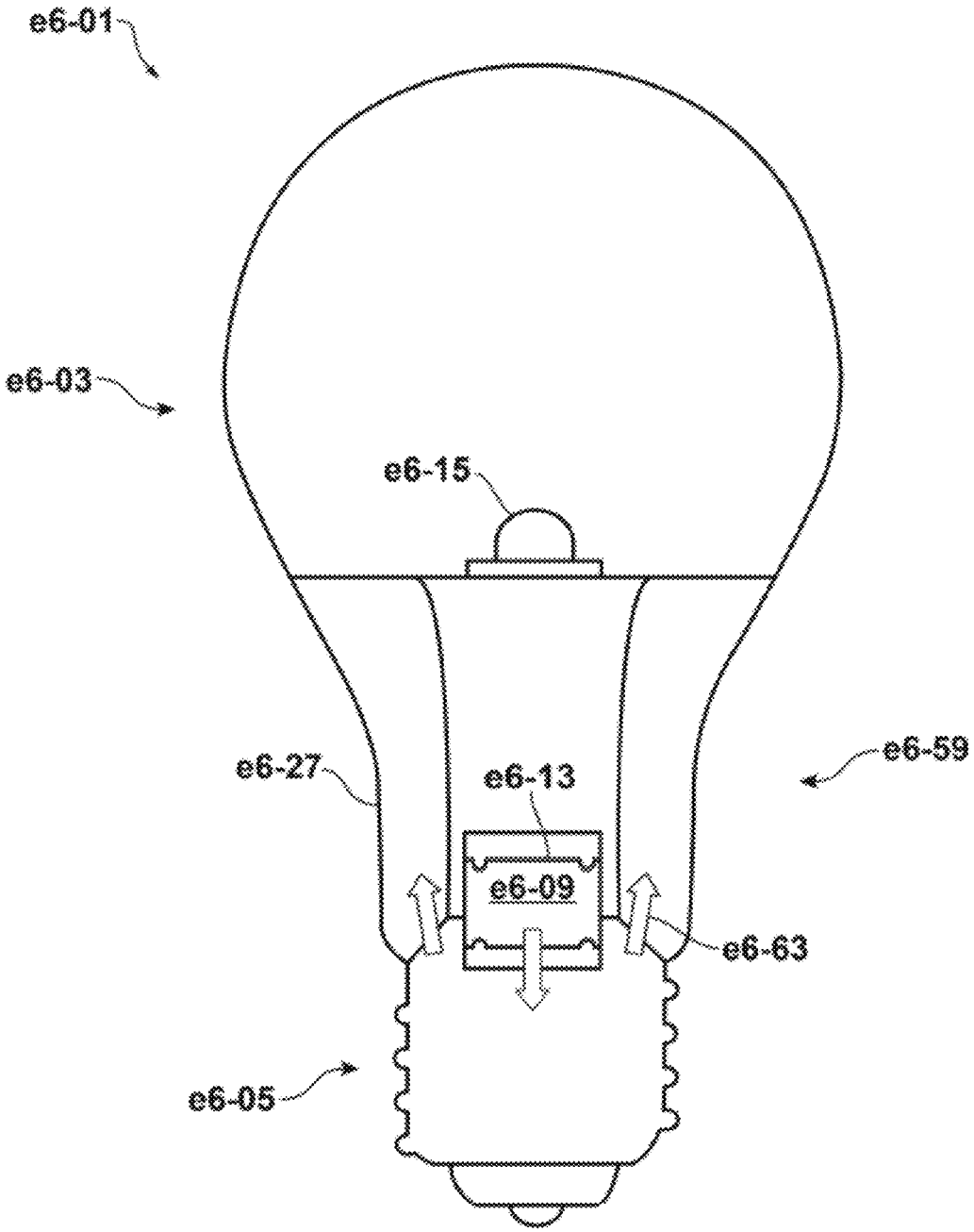
*FIG. E6-1*

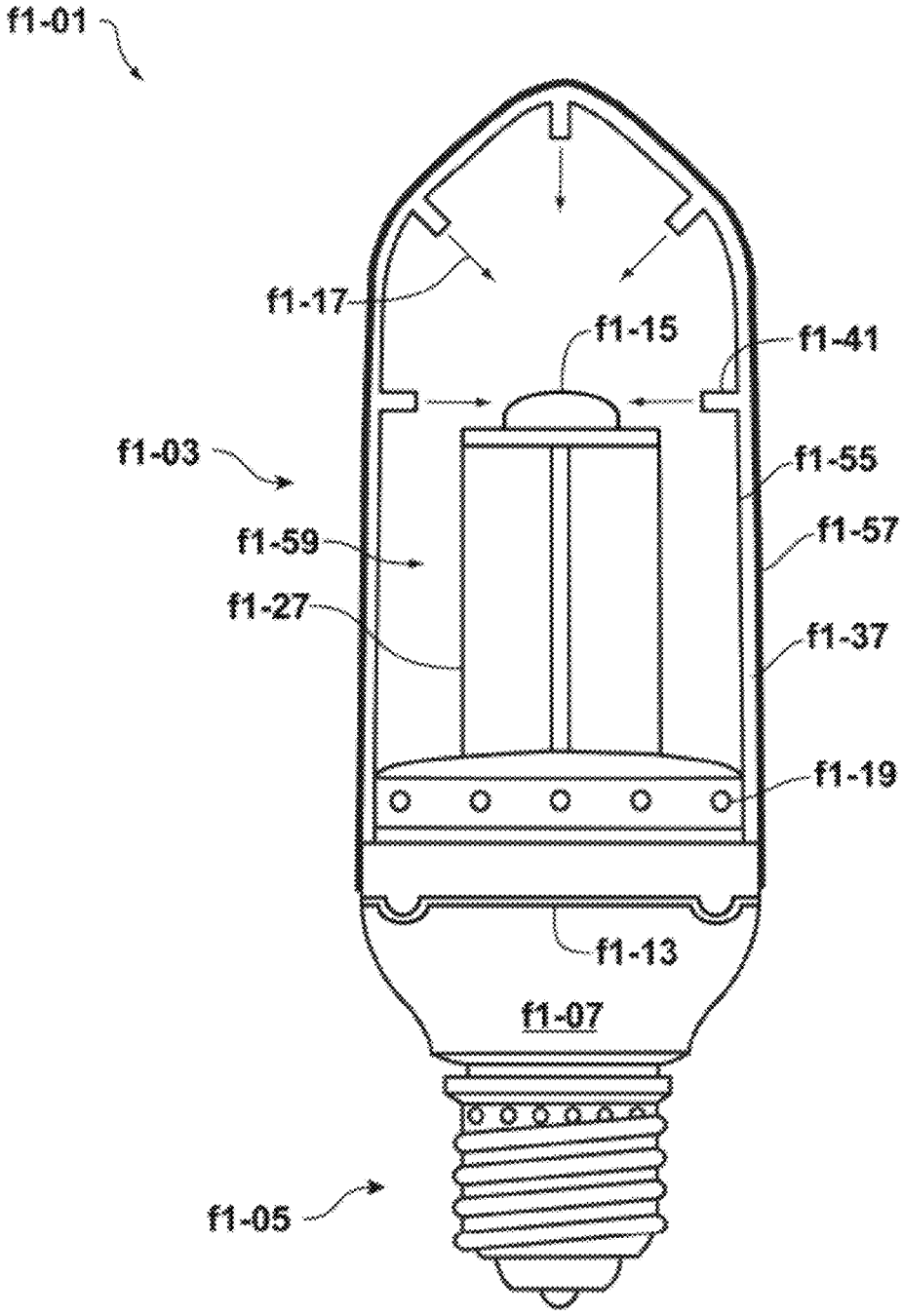
*FIG. F1-1*

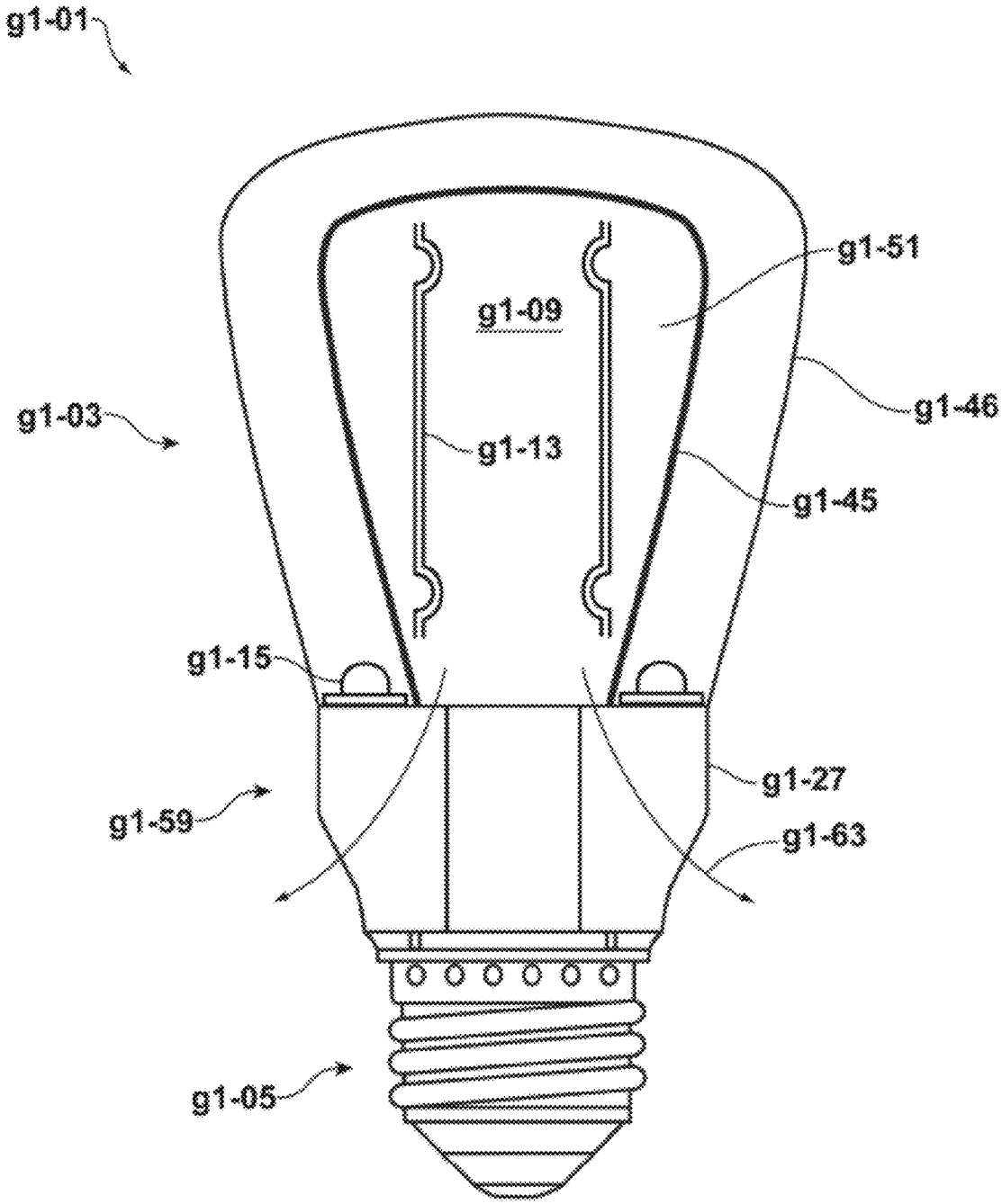
*FIG. G1-1*

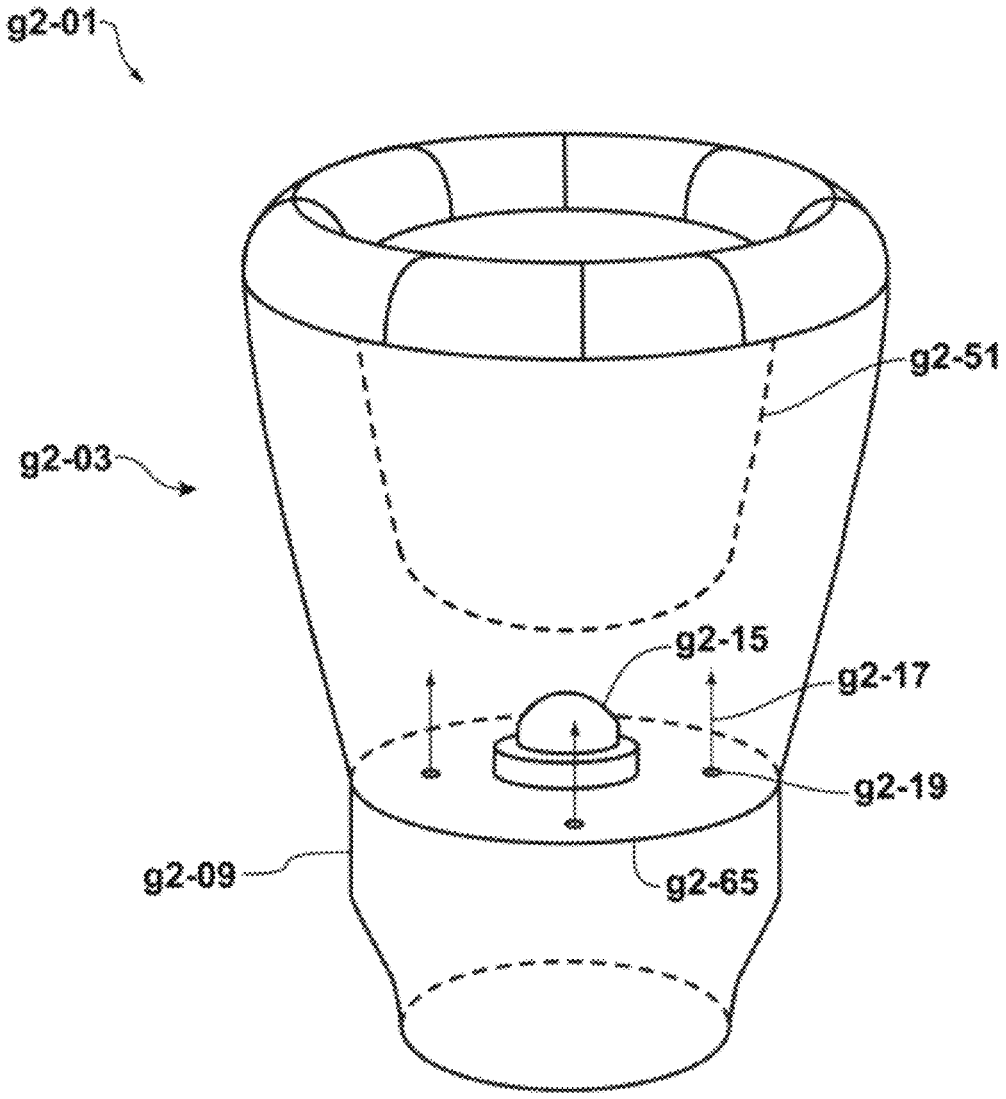
*FIG. G2-1*

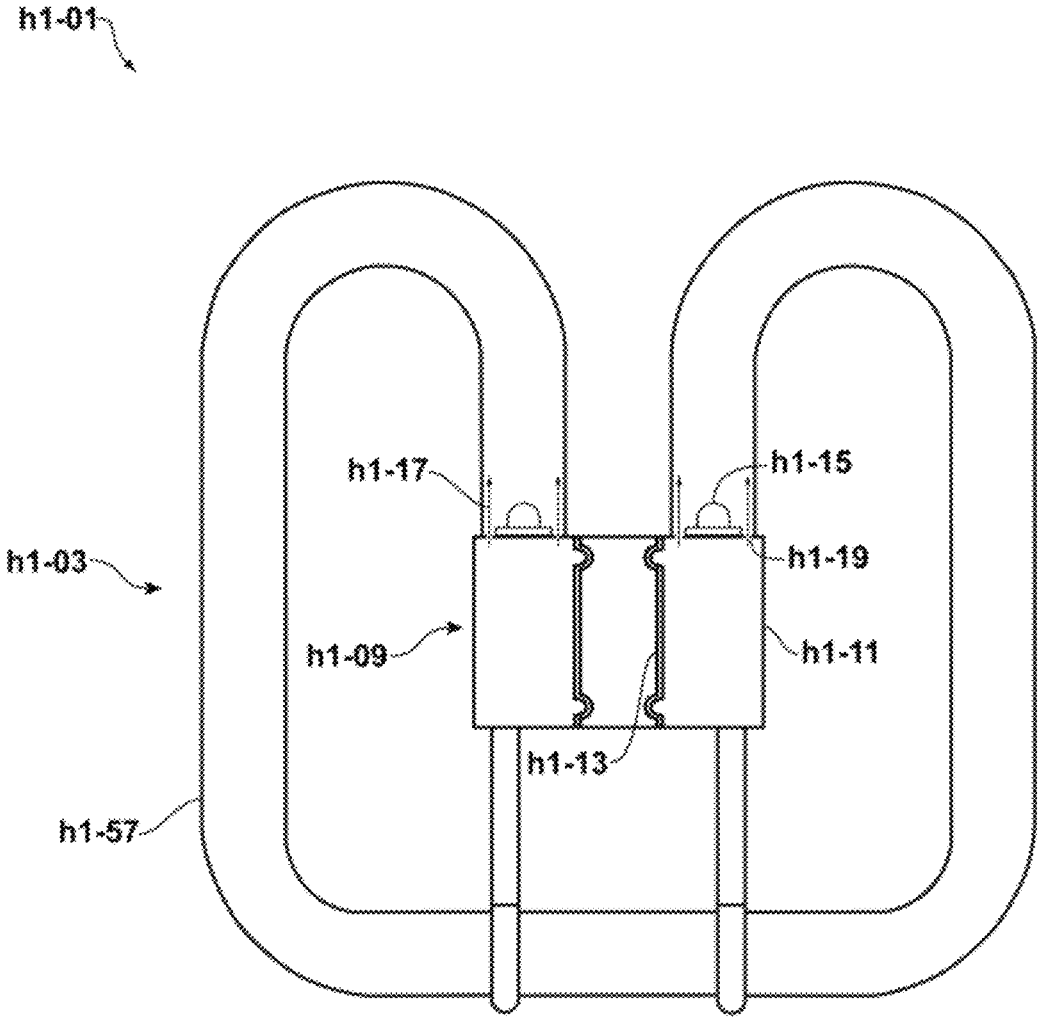
*FIG. H1-1*

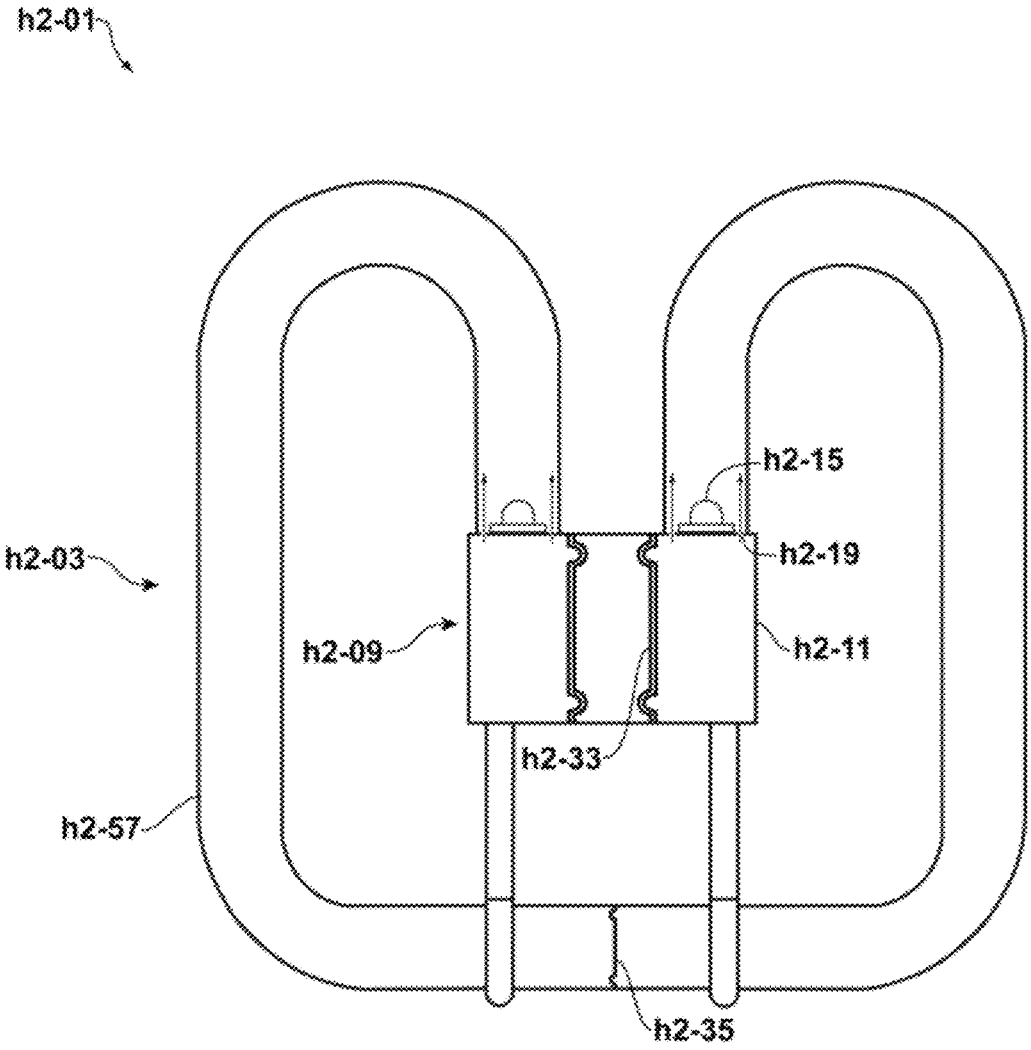
*FIG. H2-1*

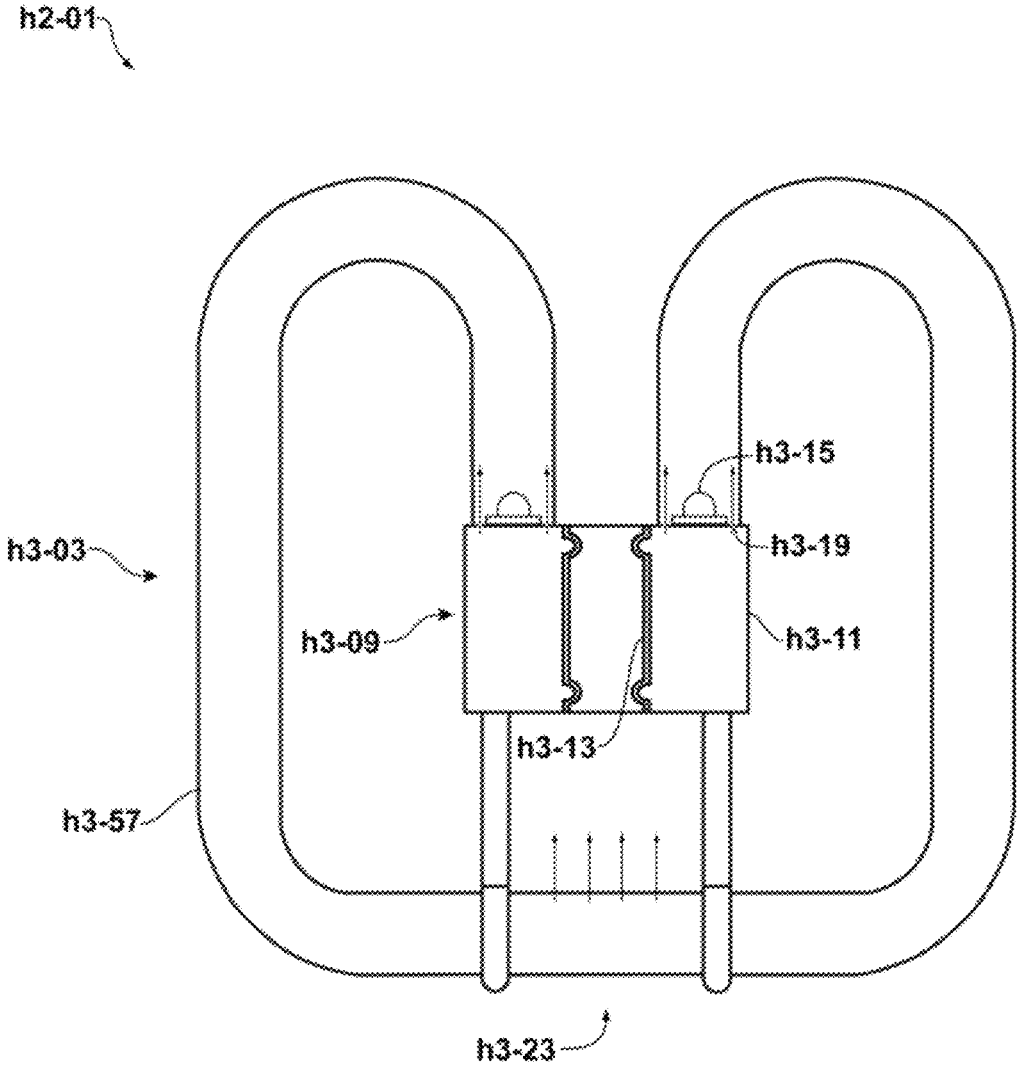
*FIG. H3-1*

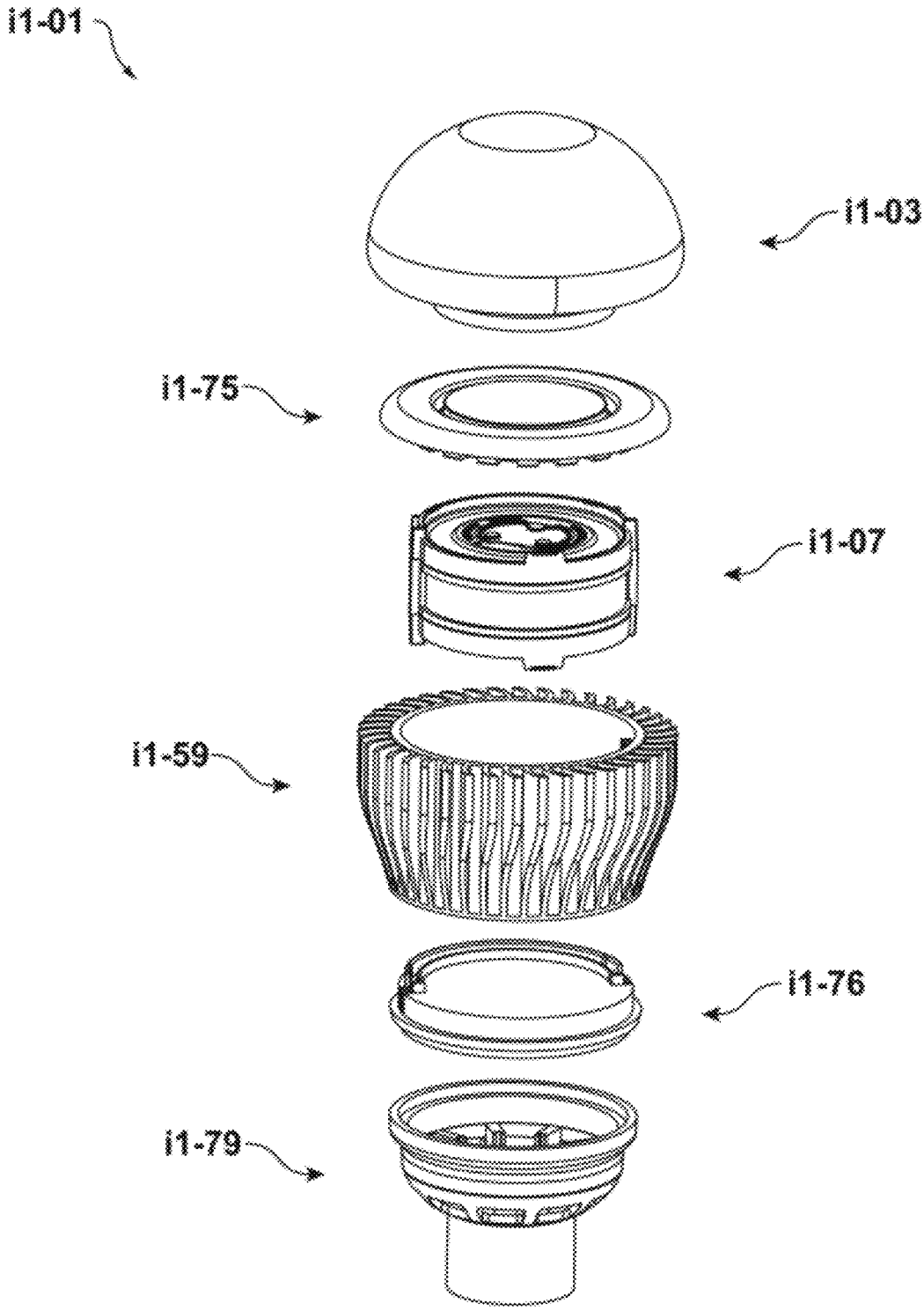
*FIG. I1-2*

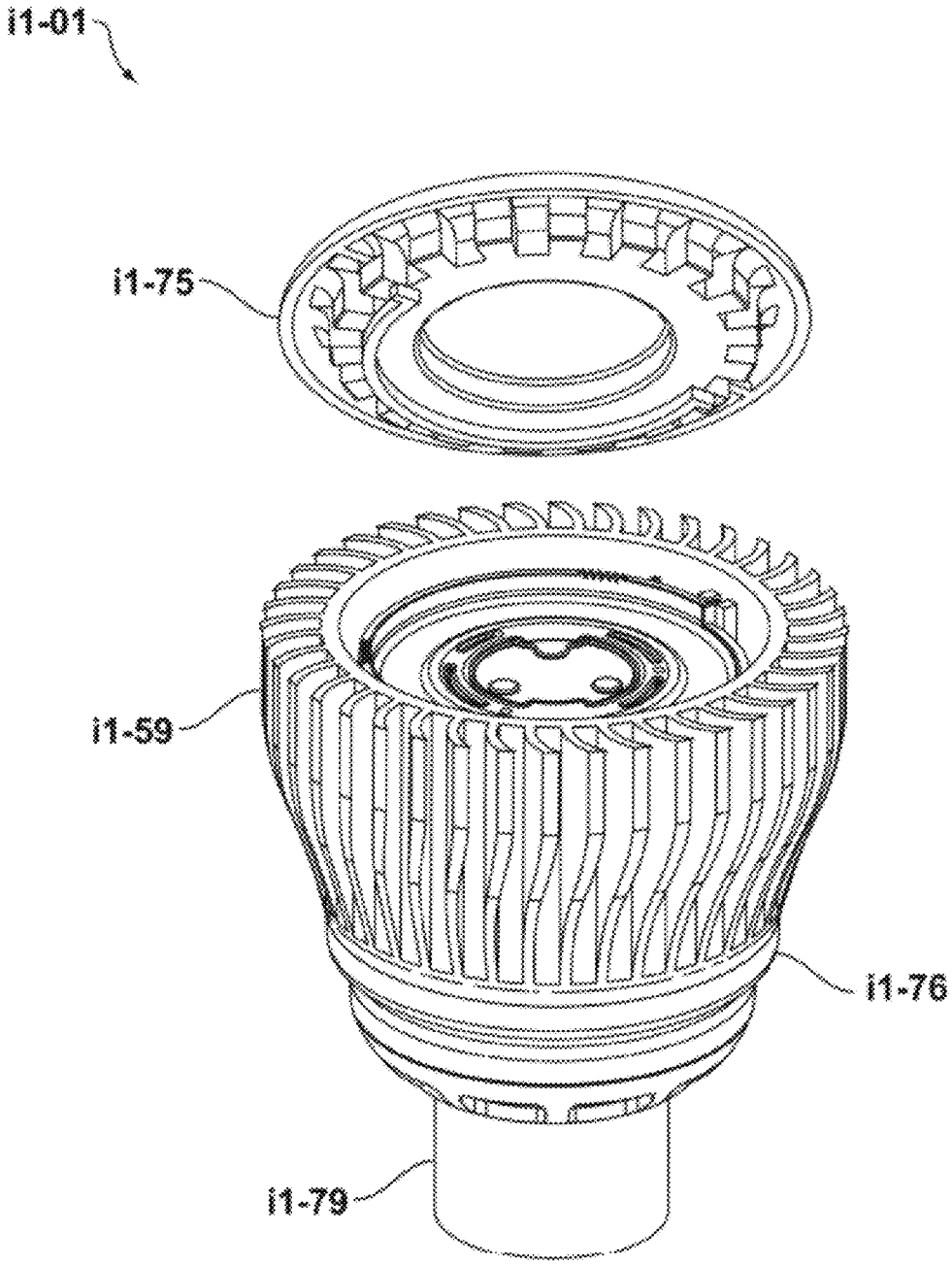
*FIG. I1-3*

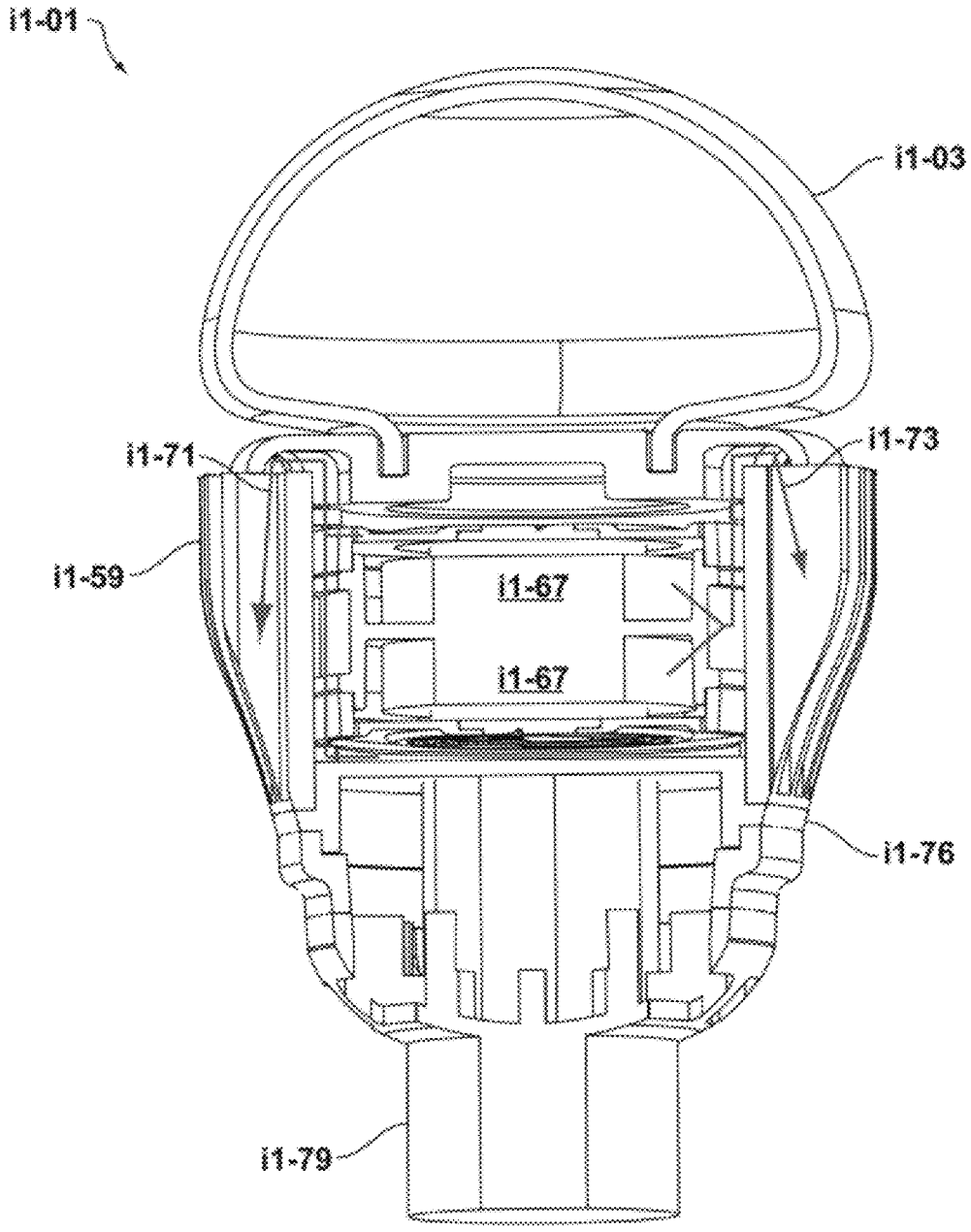
*FIG. I1-4*

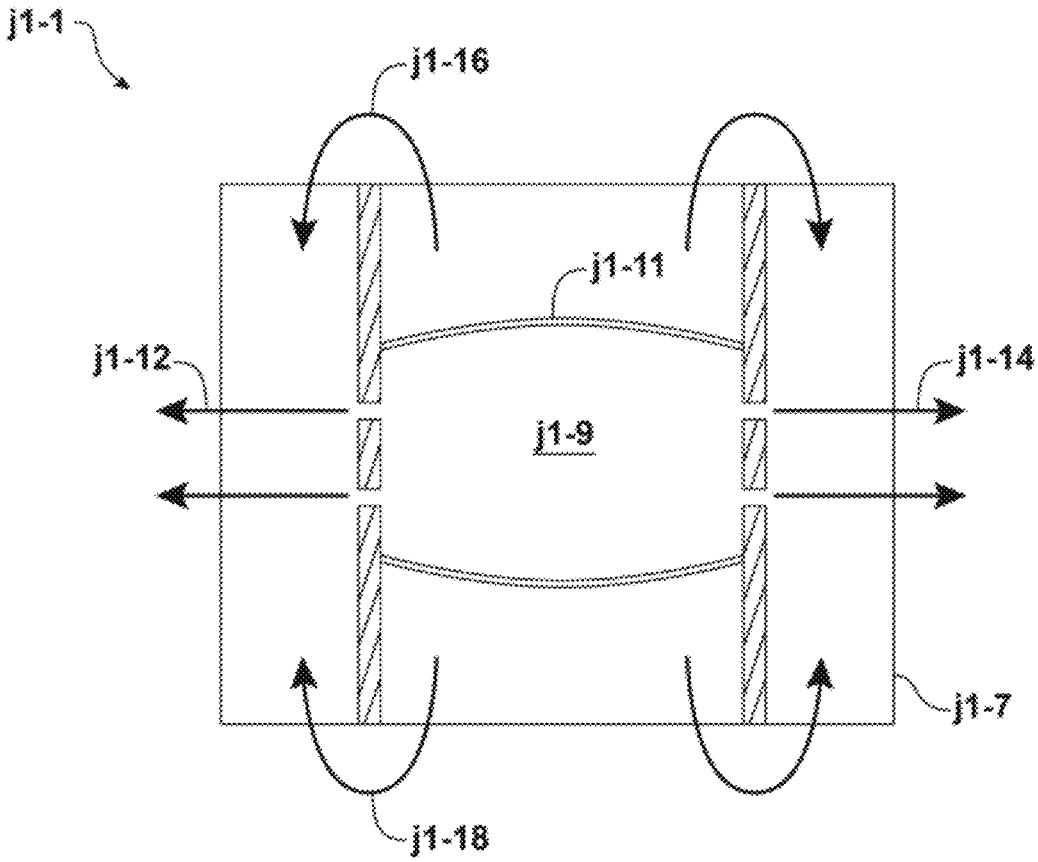
*FIG. J1-1*

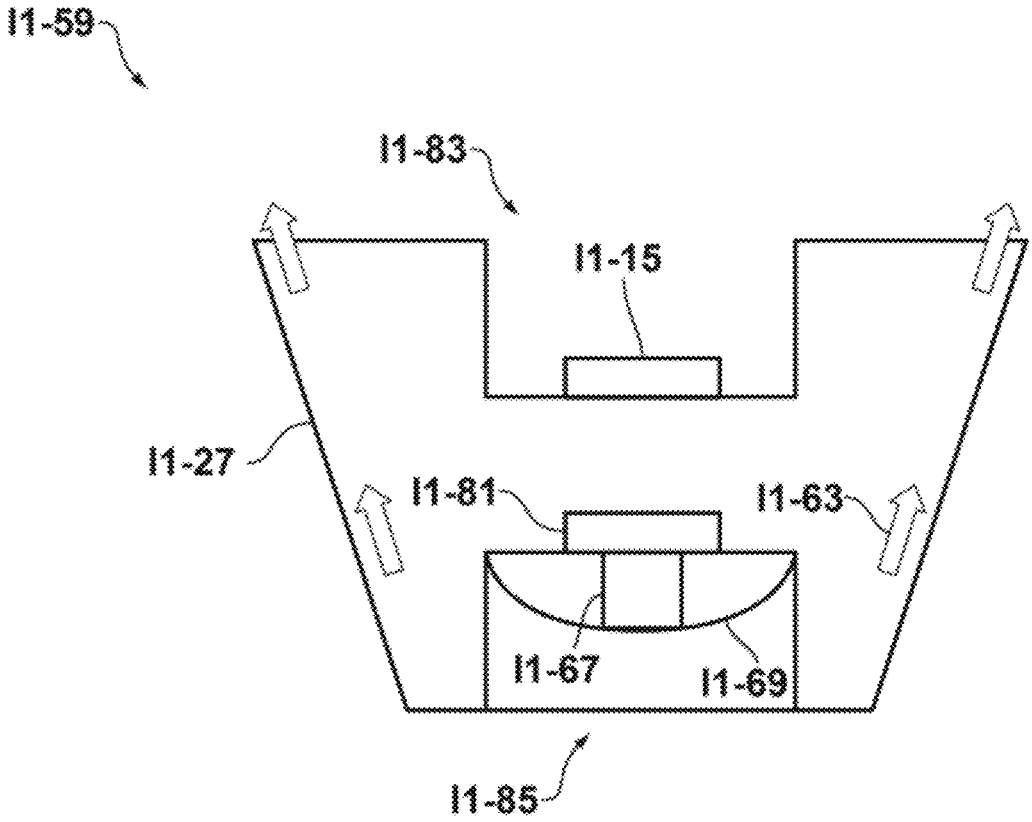
*FIG. L1-1*

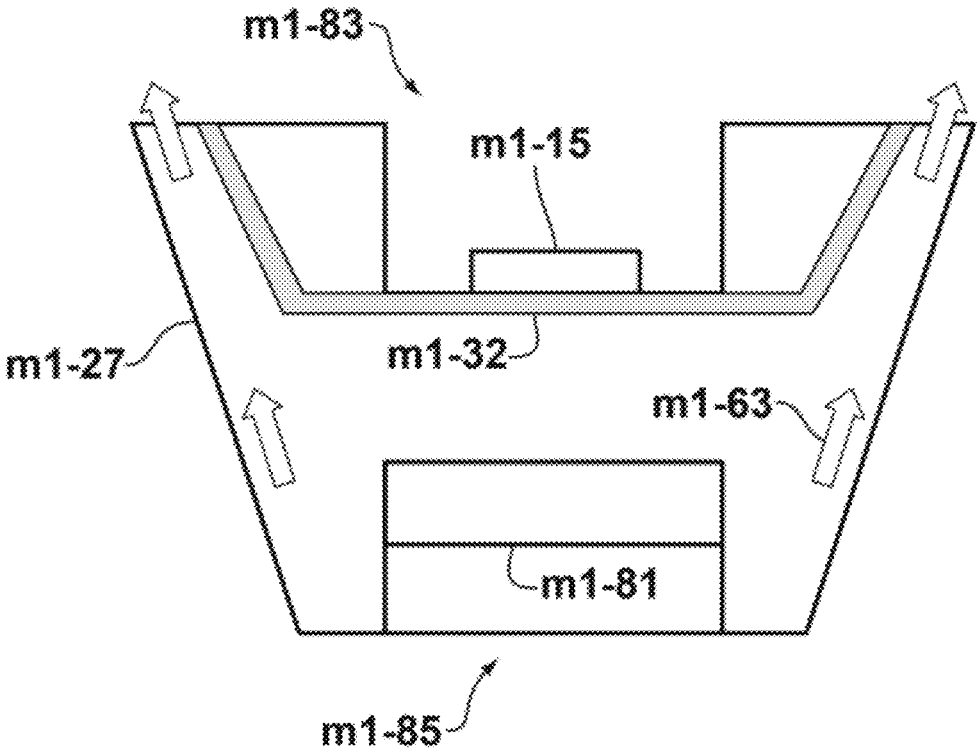
*FIG. M1-1*

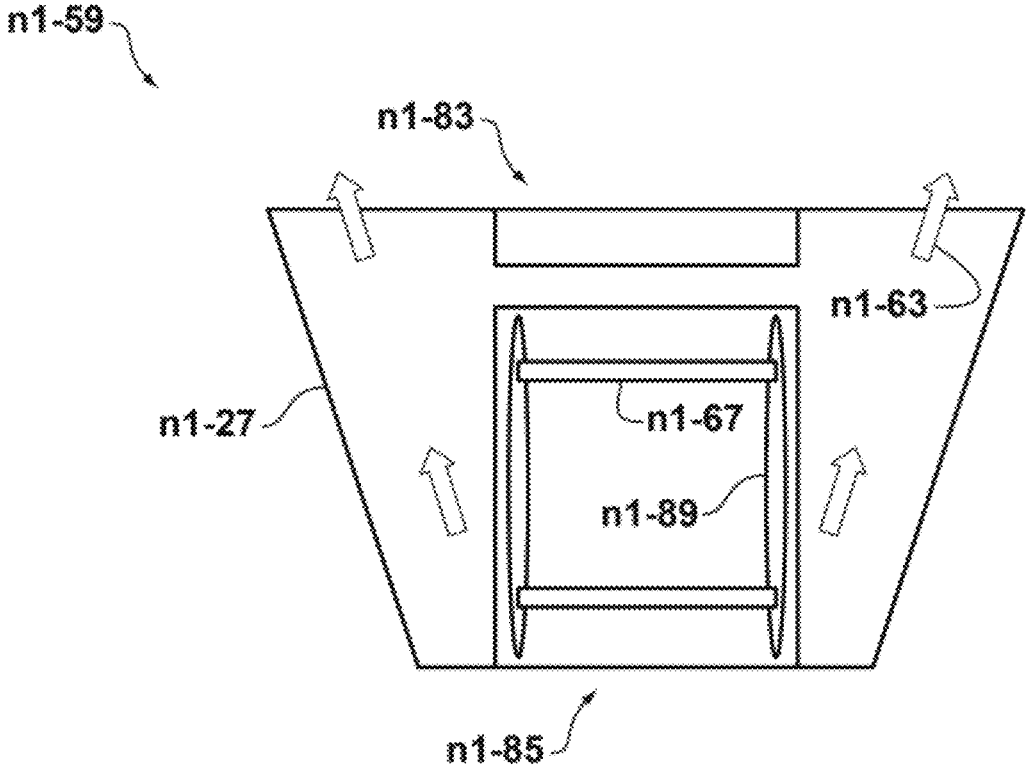
*FIG. N1-1*

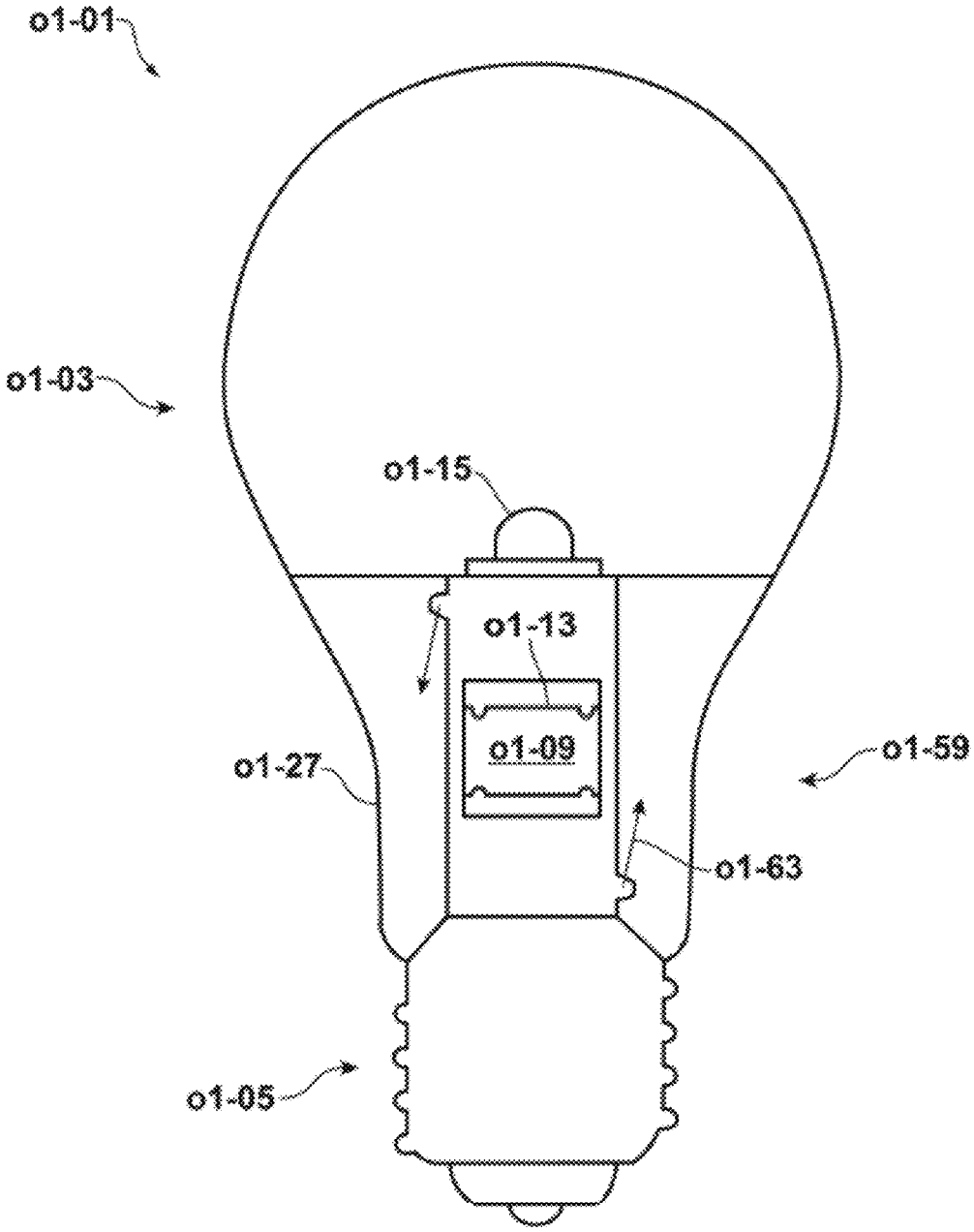
FIG. O1-1

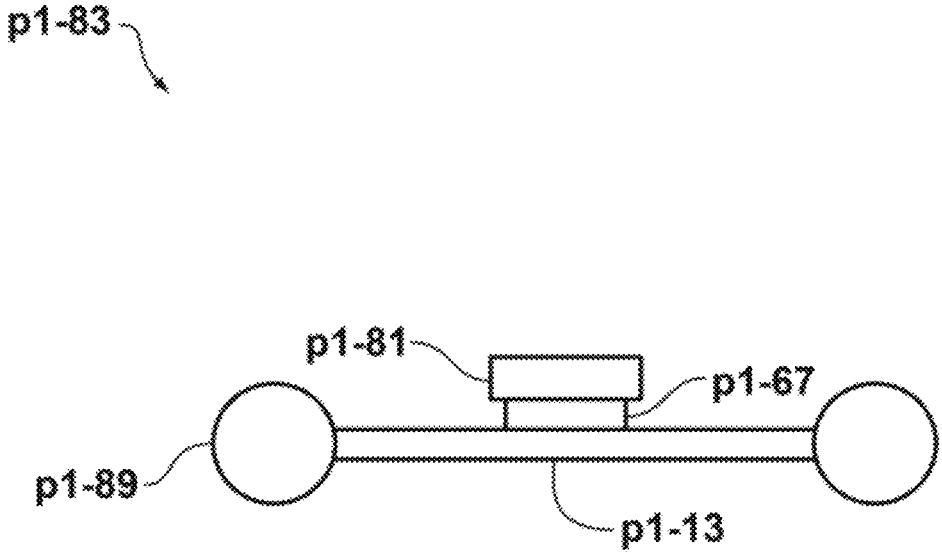
*FIG. P1-1*

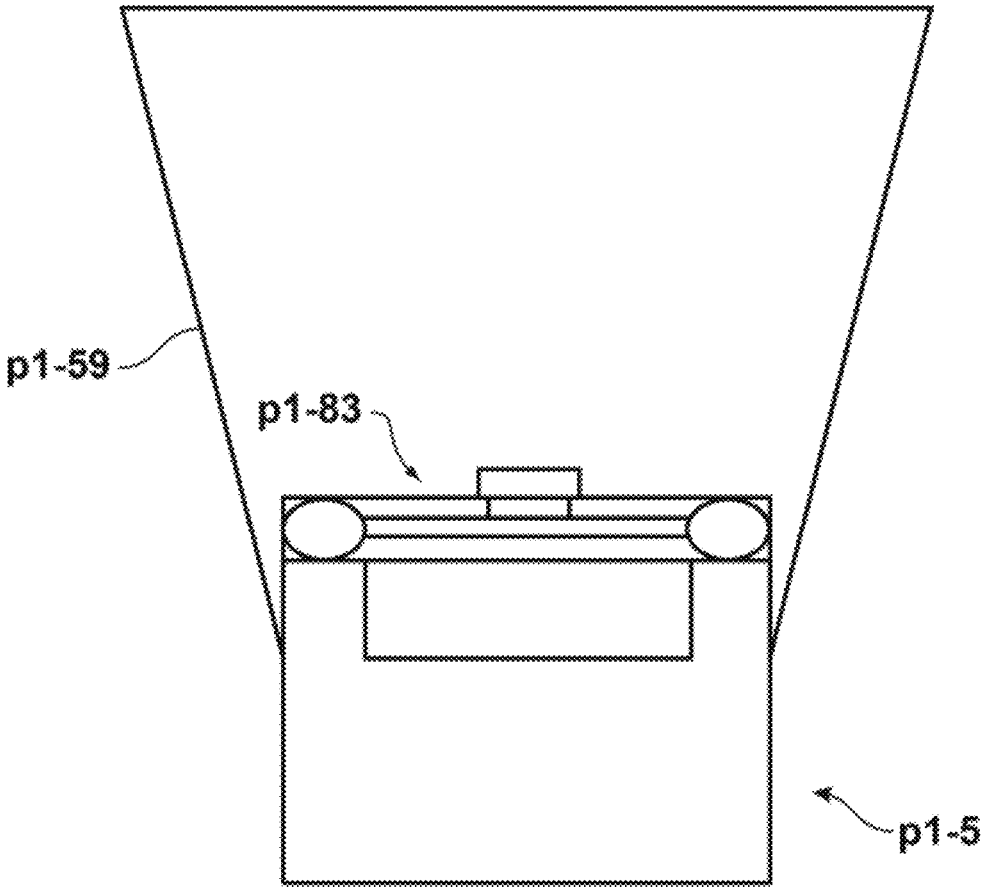
*FIG. P1-2*

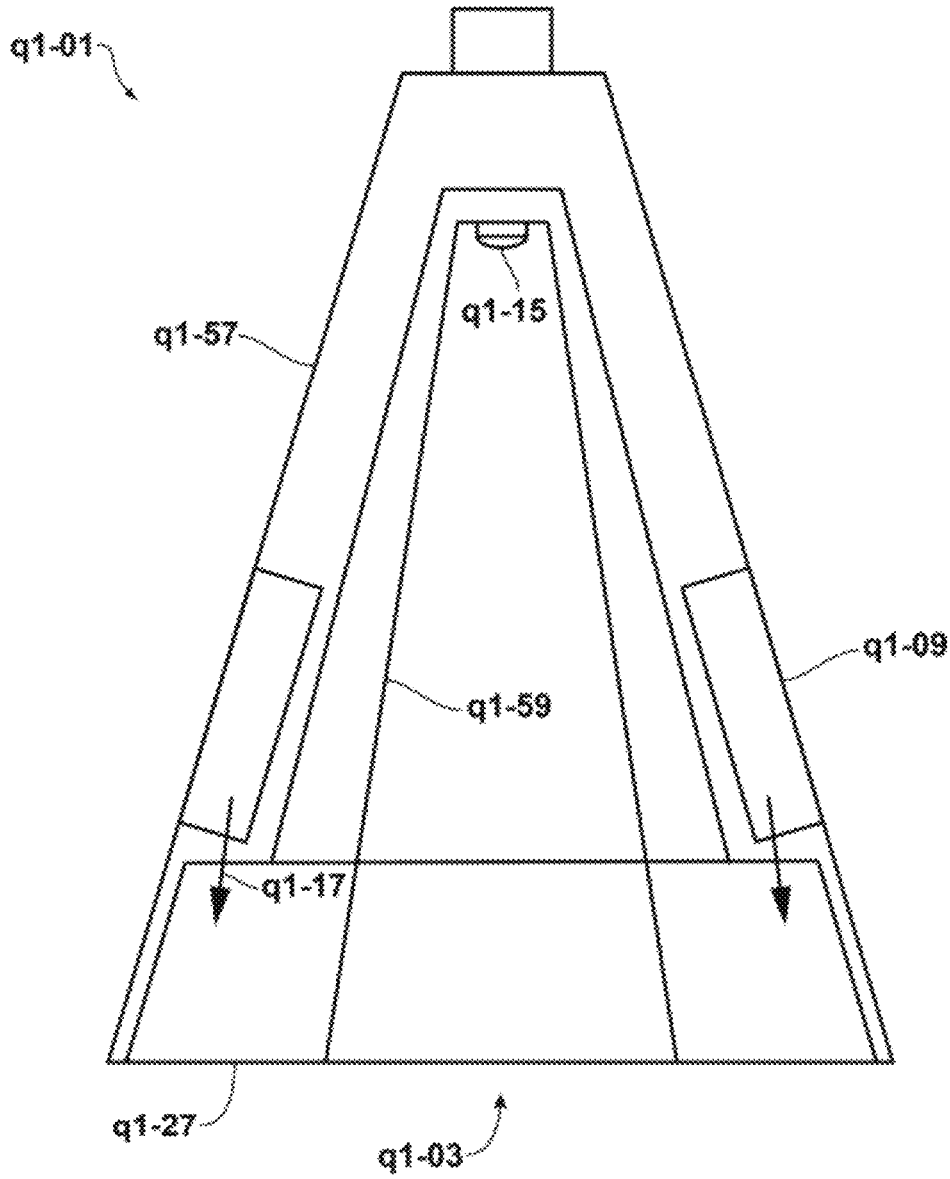
*FIG. Q1-1*

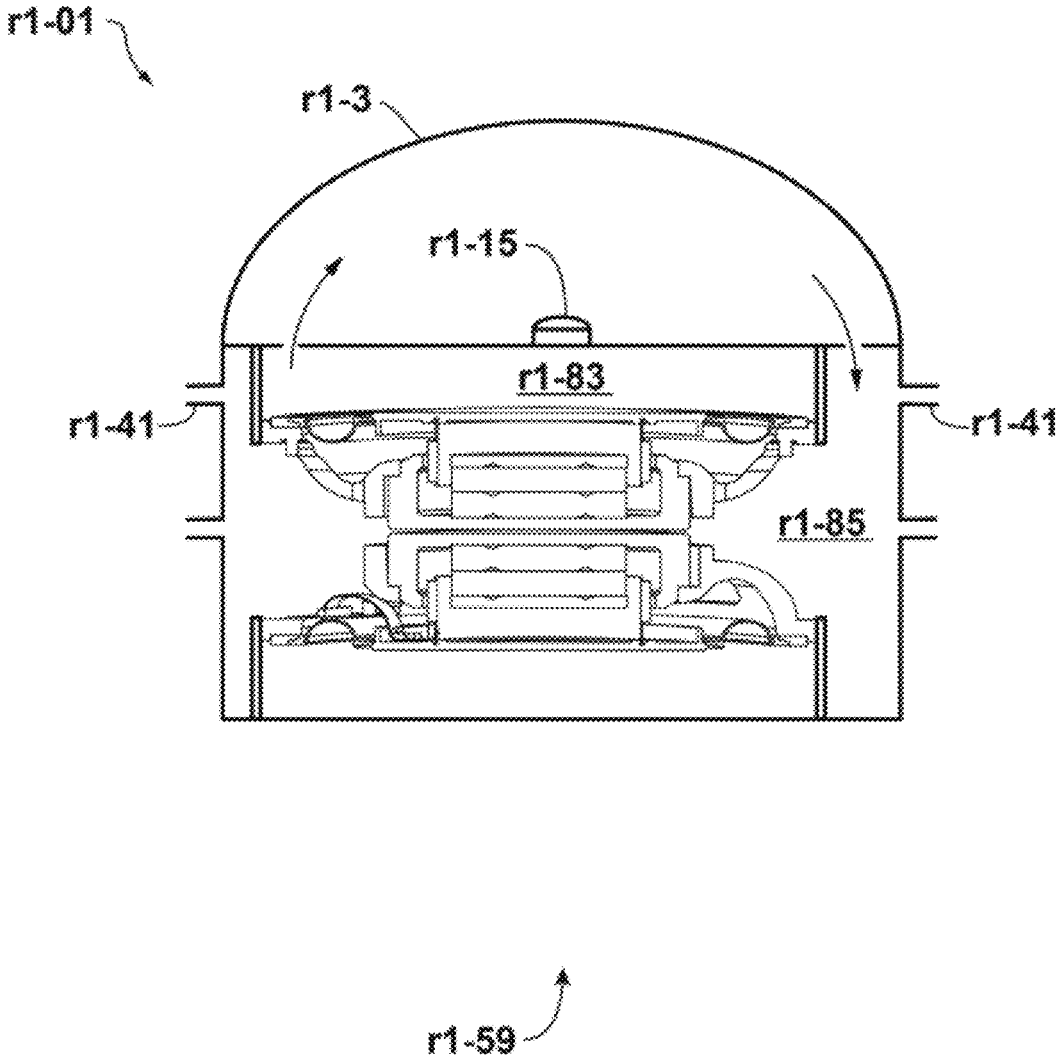
*FIG. R1-1*

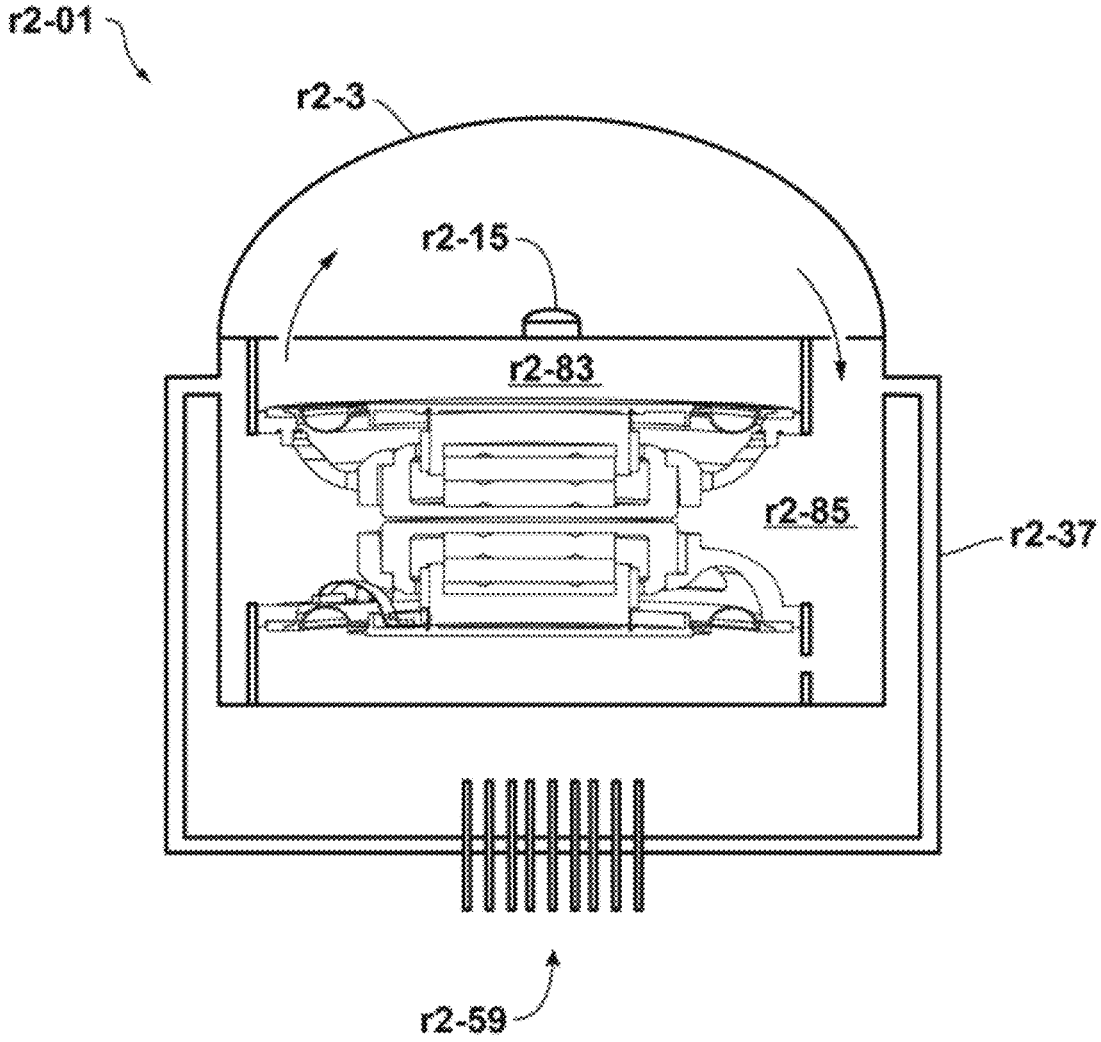
*FIG. R2-1*

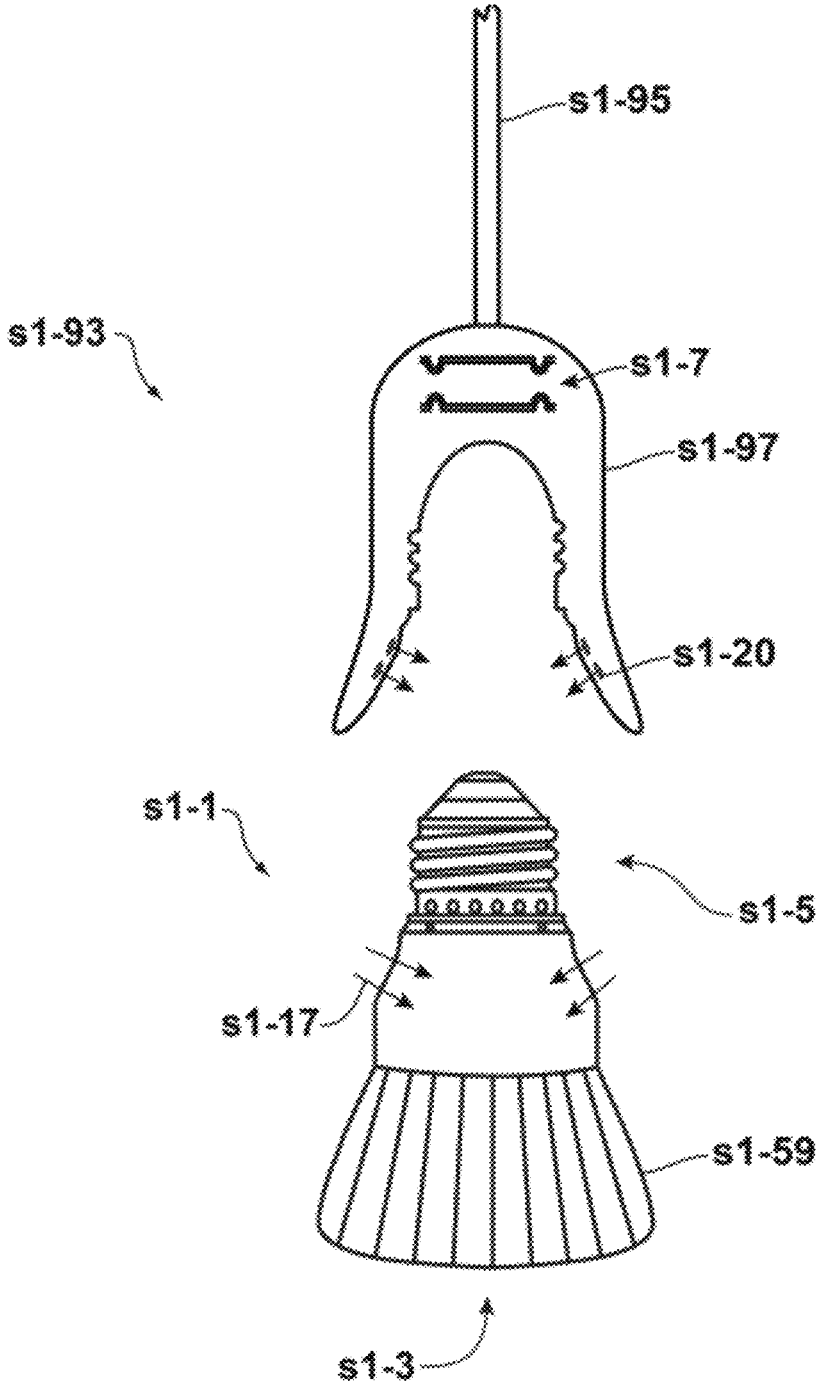
*FIG. S1-1*

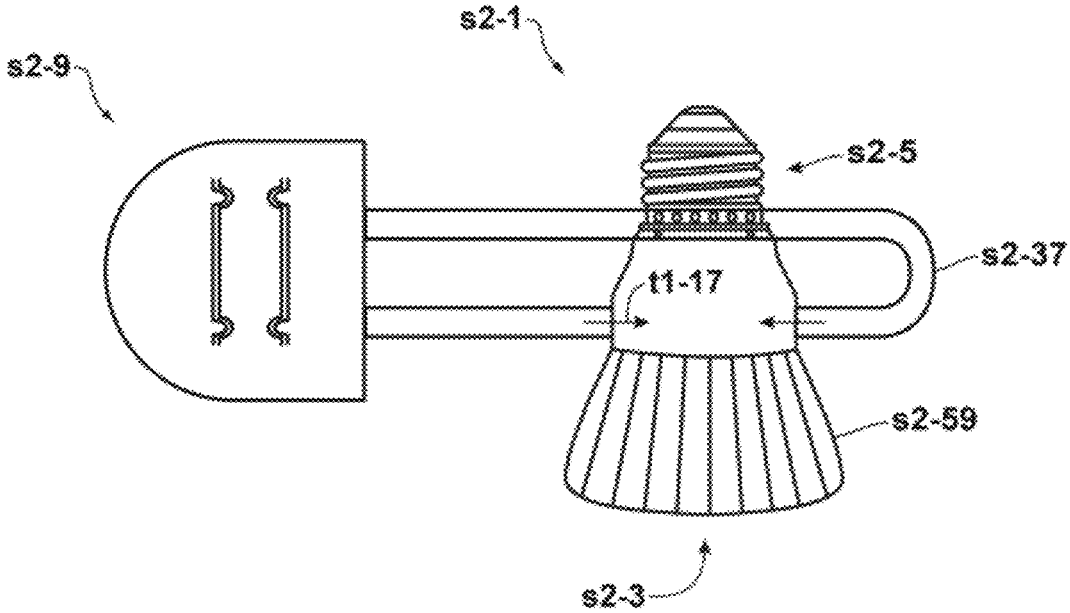
*FIG. S2-1*

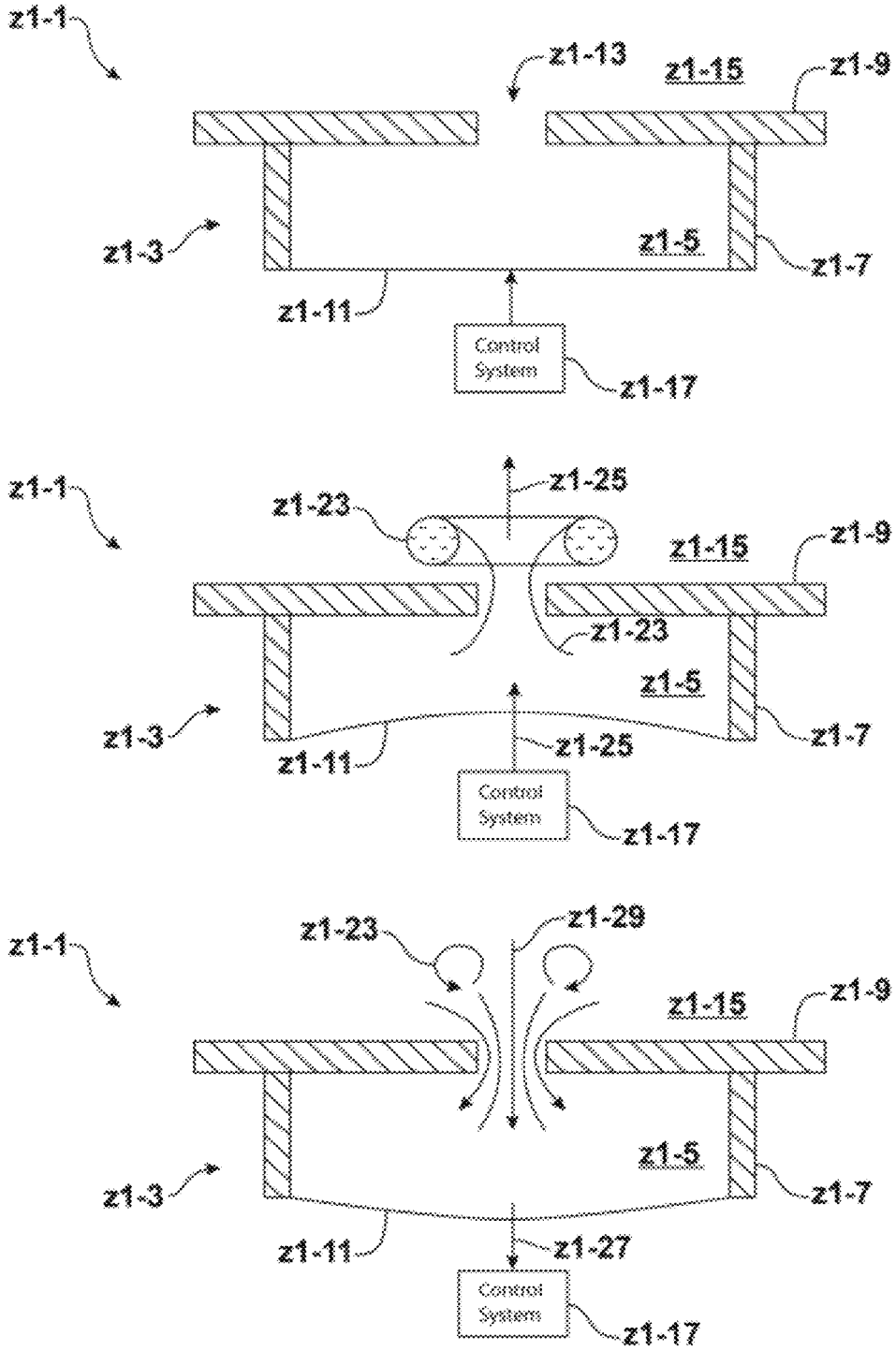
*FIG. Z1-1*

THERMAL MANAGEMENT OF LED-BASED ILLUMINATION DEVICES WITH SYNTHETIC JET EJECTORS

CROSS-REFERENCE TO RELATED APPLICATIONS

The present application is a continuation-in-part application of U.S. Ser. No. 12/902,295, entitled "THERMAL MANAGEMENT OF LED-BASED ILLUMINATION DEVICES WITH SYNTHETIC JET EJECTORS" (Mahalingam et al.), filed Oct. 12, 2010, issued Nov. 12, 2013 as U.S. Pat. No. 8,579,476, and which is incorporated herein by reference in its entirety, and which is a continuation-in-part of U.S. Ser. No. 12/503,181, entitled "THERMAL MANAGEMENT OF LED-BASED ILLUMINATION DEVICES WITH SYNTHETIC JET EJECTORS" (Heffington et al.), filed on Jul. 15, 2009, now abandoned, and which is incorporated herein by reference in its entirety, and which claims priority to U.S. Ser. No. 61/134,984, entitled "THERMAL MANAGEMENT OF LED-BASED ILLUMINATION DEVICES WITH SYNTHETIC JET EJECTORS" (Heffington et al.), filed on Jul. 15, 2008, and which is incorporated herein by reference in its entirety. This application also claims priority to U.S. Ser. No. 61/486,838, entitled "COOLING CONCEPTS" (Noska et al.), filed on May 17, 2011, and which is incorporated herein by reference in its entirety. This application is also a continuation-in-part of U.S. Ser. No. 12/503,832, entitled "Advanced Synjet Cooler Design for LED Light Modules" (Grimm), filed on Jul. 15, 2009, issued Oct. 30, 2012 as U.S. Pat. No. 8,299,691, and which is incorporated herein by reference in its entirety, and which claims priority to U.S. Ser. No. 61/134,966, entitled "ADVANCED SYNJET COOLER DESIGN FOR LED LIGHT MODULES" (Grimm), filed on Jul. 15, 2008, and which is incorporated herein by reference in its entirety.

FIELD OF THE DISCLOSURE

The present disclosure relates generally to the thermal management of illumination devices, and more particularly to the thermal management of LED-based illumination devices through the use of synthetic jet ejectors.

BACKGROUND OF THE DISCLOSURE

A variety of thermal management devices are known to the art, including conventional fan based systems, piezoelectric systems, and synthetic jet ejectors. The latter type of system has emerged as a highly efficient and versatile solution, especially in applications where thermal management is required at the local level.

Various examples of synthetic jet ejectors are known to the art. Earlier examples are described in U.S. Pat. No. 5,758,823 (Glezer et al.), entitled "Synthetic Jet Actuator and Applications Thereof"; U.S. Pat. No. 5,894,990 (Glezer et al.), entitled "Synthetic Jet Actuator and Applications Thereof"; U.S. Pat. No. 5,988,522 (Glezer et al.), entitled Synthetic Jet Actuators for Modifying the Direction of Fluid Flows"; U.S. Pat. No. 6,056,204 (Glezer et al.), entitled "Synthetic Jet Actuators for Mixing Applications"; U.S. Pat. No. 6,123,145 (Glezer et al.), entitled "Synthetic Jet Actuators for Cooling Heated Bodies and Environments"; and U.S. Pat. No. 6,588,497 (Glezer et al.), entitled "System and Method for Thermal Management by Synthetic Jet Ejector Channel Cooling Techniques.

Further advances have been made in the art of synthetic jet ejectors, both with respect to synthetic jet ejector technology in general and with respect to the applications of this technology. Some examples of these advances are described in U.S. Pat. No. 7,252,140 (Glezer et al.), entitled "Apparatus and Method for Enhanced Heat Transfer"; U.S. Pat. No. 7,606,029 (Mahalingam et al.), entitled "Thermal Management System for Distributed Heat Sources"; U.S. Pat. No. 7,607,470 (Glezer et al.), entitled "Synthetic Jet Heat Pipe Thermal Management System"; U.S. Pat. No. 7,760,499 (Darbin et al.), entitled "Thermal Management System for Card Cages"; U.S. Pat. No. 7,768,779 (Heffington et al.), entitled "Synthetic Jet Ejector with Viewing Window and Temporal Aliasing"; U.S. Pat. No. 7,784,972 (Heffington et al.), entitled "Thermal Management System for LED Array"; U.S. Pat. No. 7,819,556 (Heffington et al.), entitled "Thermal Management System for LED Array"; U.S. Pat. No. 7,932,535 (Mahalingam et al.), entitled "Synthetic Jet Cooling System for LED Module"; U.S. Pat. No. 8,030,886 (Mahalingam et al.), entitled "Thermal Management of Batteries Using Synthetic Jets"; U.S. Pat. No. 8,035,966 (Reichenbach et al.), entitled "Electronics Package for Synthetic Jet Ejectors"; U.S. Pat. No. 8,006,410 (Booth et al.), entitled "Light Fixture with Multiple LEDs and Synthetic Jet Thermal Management System"; U.S. Pat. No. 8,069,910 (Beltran et al.), entitled "Acoustic Resonator for Synthetic Jet Generation for Thermal Management"; and U.S. Pat. No. 8,136,576 (Grimm), entitled "Vibration Isolation System for Synthetic Jet Devices".

In addition to the foregoing, other advances have been made in the art of synthetic jet ejectors, both with respect to synthetic jet ejector technology in general and with respect to the applications of this technology. Some examples of these advances are described in U.S. 20100263838 (Mahalingam et al.), entitled "Synthetic Jet Ejector for Augmentation of Pumped Liquid Loop Cooling and Enhancement of Pool and Flow Boiling"; U.S. 20100039012 (Grimm), entitled "Advanced Synjet Cooler Design For LED Light Modules"; U.S. 20100033071 (Heffington et al.), entitled "Thermal Management of LED Illumination Devices"; U.S. 20090141065 (Darbin et al.), entitled "Method and Apparatus for Controlling Diaphragm Displacement in Synthetic Jet Actuators"; U.S. 20090109625 (Booth et al.), entitled Light Fixture with Multiple LEDs and Synthetic Jet Thermal Management System"; U.S. 20090084866 (Grimm et al.), entitled Vibration Balanced Synthetic Jet Ejector"; U.S. 20080219007 (Heffington et al.), entitled "Thermal Management System for LED Array"; U.S. 20080151541 (Heffington et al.), entitled "Thermal Management System for LED Array"; U.S. 20080043061 (Glezer et al.), entitled "Methods for Reducing the Non-Linear Behavior of Actuators Used for Synthetic Jets"; U.S. 20080009187 (Grimm et al.), entitled "Moldable Housing design for Synthetic Jet Ejector"; U.S. 20070096118 (Mahalingam et al.), entitled "Synthetic Jet Cooling System for LED Module"; U.S. 20070023169 (Mahalingam et al.), entitled "Synthetic Jet Ejector for Augmentation of Pumped Liquid Loop Cooling and Enhancement of Pool and Flow Boiling"; U.S. 20070119573 (Mahalingam et al.), entitled "Synthetic Jet Ejector for the Thermal Management of PCI Cards"; U.S. 20070119575 (Glezer et al.), entitled "Synthetic Jet Heat Pipe Thermal Management System"; U.S. 20070127210 (Mahalingam et al.), entitled "Thermal Management System for Distributed Heat Sources"; and U.S. 20070141453 (Mahalingam et al.), entitled "Thermal Management of Batteries using Synthetic Jets".

BRIEF DESCRIPTION OF THE DRAWINGS

FIG. A1-1 is an illustration of an illumination device in accordance with the teachings herein.

FIG. A1-2 is an illustration of an illumination device in accordance with the teachings herein.

Figures 1, 11:
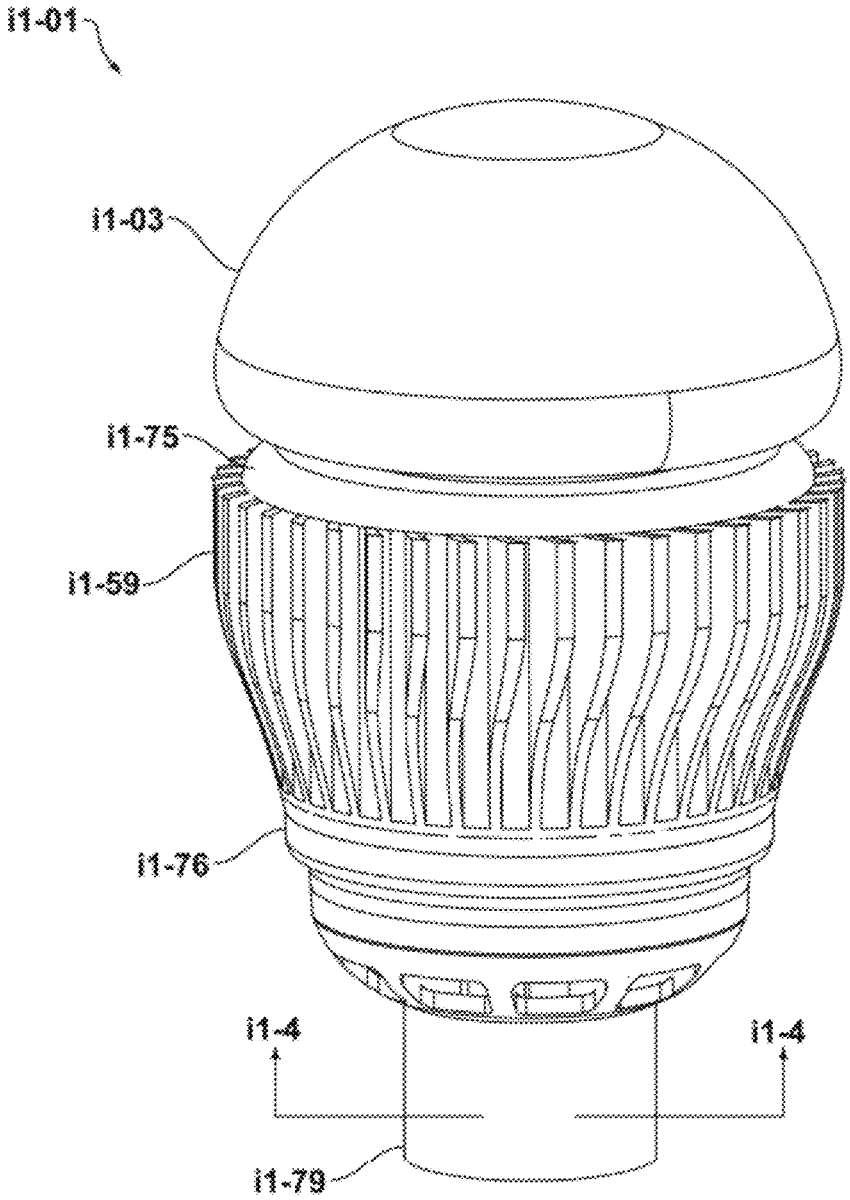

FIG. A1-3 is an illustration of an illumination device in accordance with the teachings herein.

FIG. A2-1 is an illustration of an illumination device in accordance with the teachings herein.

FIG. A3-1 is an illustration of an illumination device in accordance with the teachings herein.

FIG. A4-1 is an illustration of an illumination device in accordance with the teachings herein.

FIG. A5-1 is an illustration of an illumination device in accordance with the teachings herein.

FIG. A6-1 is an illustration of an illumination device in accordance with the teachings herein.

FIG. B1-1 is an illustration of an illumination device in accordance with the teachings herein.

FIG. C1-1 is an illustration of an illumination device in accordance with the teachings herein.

FIG. C2-1 is an illustration of an illumination device in accordance with the teachings herein.

FIG. C3-1 is an illustration of an illumination device in accordance with the teachings herein.

FIG. C4-1 is an illustration of an illumination device in accordance with the teachings herein.

FIG. C4-2 is an illustration of the synthetic jet ejector/heat sink combination utilized in the illumination device of FIG. C4-1.

FIG. D1-1 is an illustration of an illumination device in accordance with the teachings herein.

FIG. D1-2 is an illustration of an illumination device in accordance with the teachings herein.

FIG. D2-1 is an illustration of an illumination device in accordance with the teachings herein.

FIG. D2-2 is an illustration of a portion of the housing structure of the illumination device of FIG. D2-1.

FIG. D3-1 is an illustration of an illumination device in accordance with the teachings herein.

FIG. E1-1 is an illustration of an illumination device in accordance with the teachings herein.

FIG. E2-1 is an illustration of an illumination device in accordance with the teachings herein.

FIG. E3-1 is an illustration of an illumination device in accordance with the teachings herein.

FIG. E4-1 is an illustration of an illumination device in accordance with the teachings herein.

FIG. E5-1 is an illustration of an illumination device in accordance with the teachings herein.

FIG. E6-1 is an illustration of an illumination device in accordance with the teachings herein.

FIG. F1-1 is an illustration of an illumination device in accordance with the teachings herein.

FIG. G1-1 is an illustration of an illumination device in accordance with the teachings herein.

FIG. G2-1 is an illustration of an illumination device in accordance with the teachings herein.

FIG. H1-1 is an illustration of an illumination device in accordance with the teachings herein.

FIG. H2-1 is an illustration of an illumination device in accordance with the teachings herein.

FIG. H3-1 is an illustration of an illumination device in accordance with the teachings herein.

FIG. I1-1 is an illustration of an illumination device in accordance with the teachings herein.

FIG. I1-2 is an exploded view of the illumination device of FIG. I-1.

FIG. I1-3 is an illustration of the illumination device of FIG. I-1 depicting the manner in which the upper wall integrates with the heat sink to form flow paths.

FIG. I1-4 is a cross-sectional view taken along LINE I1-4-I1-4 of the illumination device of FIG. I1-1 depicting the flow paths between the synthetic jet actuators and the heat sink.

FIG. J1-1 is an illustration of a synthetic jet ejector which may be used in some of the LED-based illumination devices disclosed herein.

FIG. L1-1 is an illustration of a heat sink/support structure combination in accordance with the teachings herein.

FIG. M1-1 is an illustration of a heat sink/support structure combination in accordance with the teachings herein.

FIG. N1-1 is an illustration of a heat sink/support structure combination in accordance with the teachings herein.

FIG. O1-1 is an illustration of an illumination device in accordance with the teachings herein.

FIG. P1-1 is an illustration of a diaphragm assembly in accordance with the teachings herein.

FIG. P1-2 is an illustration of a portion of an illumination device which incorporates the diaphragm assembly of FIG. P1-1.

FIG. Q1-1 is an illustration of an illumination device in accordance with the teachings herein.

FIG. R1-1 is an illustration of an illumination device in accordance with the teachings herein.

FIG. R2-1 is an illustration of an illumination device in accordance with the teachings herein.

FIG. S1-1 is an illustration of an illumination device in accordance with the teachings herein in which elements of the thermal management solution are built into different components of the final device.

FIG. S2-1 is an illustration of an illumination device in accordance with the teachings herein in which elements of the thermal management solution are built into different components of the final device.

FIG. Z1-1 is an illustration of the operation of a synthetic jet ejector.

DETAILED DESCRIPTION

Prior to describing the devices and methodologies described herein, a brief explanation of a typical synthetic jet ejector, and the manner in which it operates to create a synthetic jet, may be useful.

The formation of a synthetic jet may be appreciated with respect to FIGS. Z1-1 to Z1-3. FIG. Z1-1 depicts a synthetic jet ejector z1-1 comprising a housing z1-3 which defines and encloses an internal chamber z1-5. The housing z1-3 and chamber z1-5 may take virtually any geometric configuration, but for purposes of discussion and understanding, the housing z1-3 is shown in cross-section in FIG. Z1-1 to have a rigid side wall z1-7, a rigid front wall z1-9, and a rear diaphragm z1-11 that is flexible to an extent to permit movement of the diaphragm z1-11 inwardly and outwardly relative to the chamber z1-5. The front wall z1-9 has an orifice z1-13 therein (see FIG. Z-1) which may be of any geometric shape. The orifice z1-13 diametrically opposes the rear diaphragm z1-11 and fluidically connects the internal chamber z1-5 to an external environment having ambient fluid z1-15.

The movement of the flexible diaphragm z1-11 may be controlled by any suitable control system z1-17. For example, the diaphragm may be moved by a voice coil actuator. The diaphragm z1-11 may also be equipped with a metal layer, and a metal electrode may be disposed adjacent to, but spaced from, the metal layer so that the diaphragm z1-11 can be moved via an electrical bias imposed between the electrode and the metal layer. Moreover, the generation of the electrical bias can be controlled by any suitable device, for example but not limited to, a computer, logic processor, or signal generator. The control system z1-17 can cause the diaphragm z1-11 to move periodically or to modulate in time-harmonic motion, thus forcing fluid in and out of the orifice z1-9.

Alternatively, a piezoelectric actuator could be attached to the diaphragm z1-11. The control system would, in that case, cause the piezoelectric actuator to vibrate and thereby move the diaphragm z1-11 in time-harmonic motion. The method of causing the diaphragm z1-11 to modulate is not particularly limited to any particular means or structure.

The operation of the synthetic jet ejector z1-1 will now be described with reference to FIGS. Z1-2 and Z1-3. FIG. Z1-2 depicts the synthetic jet ejector z1-1 as the diaphragm z1-11 is controlled to move inward into the chamber z1-5, as depicted by arrow z1-19. The chamber z1-5 has its volume decreased and fluid is ejected through the orifice z1-9. As the fluid exits the chamber z1-5 through the orifice z1-9, the flow separates at the (preferably sharp) orifice edges and creates vortex sheets z1-21. These vortex sheets z1-21 roll into vortices z1-23 and begin to move away from the edges of the orifice z1-9 in the direction indicated by arrow z1-25.

FIG. Z1-3 depicts the synthetic jet ejector z1-1 as the diaphragm z1-11 is controlled to move outward with respect to the chamber z1-5, as depicted by arrow z1-27. The chamber z1-5 has its volume increased and ambient fluid z1-15 rushes into the chamber z1-5 as depicted by the set of arrows z1-29. The diaphragm z1-11 is controlled by the control system z1-17 so that, when the diaphragm z1-11 moves away from the chamber z1-5, the vortices z1-23 are already removed from the orifice edges and thus are not affected by the ambient fluid z1-15 being drawn into the chamber z1-5. Meanwhile, a jet of ambient fluid z1-15 is synthesized by the vortices z1-23, thus creating strong entrainment of ambient fluid drawn from large distances away from the orifice z1-9.

While thermal management systems which utilize synthetic jets to enhance cooling have many desirable properties, further improvements in these devices are required to meet evolving challenges in the art. For example, many host devices which require thermal management continue to shrink in size. Hence, there is a need in the art to provide thermal management solutions based on synthetic jet ejectors which have reduced dimensions, without sacrificing functionality.

It has now been found that some of the foregoing needs may be met by a thermal management system having a synthetic jet ejector and a heat sink, and in which the synthetic jet ejector and heat sink are combined into a single unit. This may be accomplished, for example, by a thermal management system design which comprises (a) a heat sink comprising a central chamber and having a plurality of heat fins disposed about the perimeter of said central chamber; (b) a synthetic jet actuator disposed in said central chamber; (c) a first plurality of conduits adapted to direct a first plurality of synthetic jets in a first direction across the surfaces of said heat fins; and (d) a second plurality of conduits adapted to direct a second plurality of synthetic jets in a second direction across the surfaces of said heat fins; wherein said first and second directions are essentially orthogonal. Such a configuration may provide improved thermal performance, while also allowing the device to be smaller and to have more entrainment.

It has further been found that some of the foregoing needs may be met through the provision of a light source which comprises (a) an Edison socket; (b) a heat sink disposed adjacent to said socket; and (c) a synthetic jet actuator disposed at least partially within said heat sink or at least partially within said socket, wherein said socket has at least one nozzle defined therein which is adapted to direct at least one synthetic jet across a surface of said heat sink. Currently, the Edison socket serves two functions, namely to make electrical contact to the main power and to house some electronics. In the design disclosed herein, however, some internal volume of the Edison socket is utilized to form synthetic jet nozzles for cooling the heat sink. Hence, the resulting Edison socket has built in nozzles for directing airflow over the heat sink.

It has also been found that some of the foregoing needs may be met through the provision of a heat sink as the synthetic jet actuator support structure. In order to reduce size and cost, if possible, it is advantageous to combine the function of multiple components of a synthetic jet actuator into one integrated component. Many existing synthetic jet actuators have various plastic support structures to support the diaphragm. It has now been found that these components may be designed as part of the heat sink, wherein the heat sink can be metal or can be injection molded with a thermally conductive polymeric composition. Alternatively, a similar end may be met by providing a metal substrate having a plurality of heat fins defined therein, and overmolding the metal substrate with a thermally conductive polymeric resin to form a heat sink containing a plurality of heat fins and having a first cavity defined therein which is in fluidic communication with the surfaces of said fins by way of a first set of channels.

It has further been found that some of the foregoing needs may be met with a thermal management system equipped with one or more diaphragms having a long surround with a small bend radius. Such a construction allows for a larger usable piston area and a smaller diameter assembly.

It has further been found that some of the foregoing needs may be met with an illumination device equipped with a translucent dome, an electrical connector and a heat sink disposed between the dome and the electrical connector. The heat sink is equipped with a synthetic jet ejector which ejects a first plurality of synthetic jets in a first direction along the surface of the illumination device, and a second plurality of synthetic jets in a second direction along the surface of the illumination device. The different directional movement of the jets allows for a circular airflow pattern around the illumination device. In some applications in which the illumination device is installed into a fixture, having jets formed to move air into the fixture may create thermal heating of the air and hence remove heat more efficiently from the illumination device.

It has also been found that some of the foregoing needs may be met with a heat sink design which allows for the compression fit assembly of a diaphragm to housing components. Such an assembly allows for a snap fit or threaded fit type of installation which eliminates the need for adhesives, overmolding or ultrasonic welding.

The devices and methodologies disclosed herein may be further understood with reference to the particular, non-limiting embodiments of the illumination devices depicted in FIGS. A1-1 through I1-4 herein. In these figures, like elements have been given like numerical identifiers. A listing of the numerical identifiers is attached hereto as APPENDIX A.

FIGS. A1-1 to A1-3 depict a first particular, non-limiting embodiment of an LED-based illumination device in accordance with the teachings herein. As seen therein, the illumination device a1-01 comprises a light-emitting portion a1-03 which emits light, and a connector module a1-05 which connects the illumination device a1-01 to the electrical outlet of a light fixture. In the particular embodiment depicted, the connector module a1-05 is a threaded connector module that rotatingly engages a complimentary shaped socket in an electrical outlet (not shown), though it will be appreciated that the illumination devices disclosed herein are not necessarily limited to use in conjunction with such an outlet.

The light emitting portion a1-01 in this embodiment houses a pedestal a1-25 (see FIG. A1-2) upon which is disposed a synthetic jet ejector a1-09. The synthetic jet ejector a1-09 comprises a housing a1-11 which contains a set of diaphragms a1-13, and upon an exterior surface of which are disposed a plurality of LEDs a1-15. The set of diaphragms a1-13 operate to generate a plurality of synthetic jets a1-17, which are emitted from a plurality of apertures a1-20 (see FIG. A1-3) provided in the synthetic jet actuator housing a1-11, and which transfer heat from the LEDs to the interior of the light emitting portion a1-03. The apertures a1-20 may be disposed in a variety of suitable patterns around one or more of the LEDs a1-15, one particular example of which is depicted in FIG. A1-3. The heat in the interior of the light emitting portion a1-03 may then be transferred to the external environment through thermal transfer across the surface of the light emitting portion a1-03 or by other suitable means.

FIG. A2-1 depicts another particular, non-limiting embodiment of an LED-based illumination device in accordance with the teachings herein is disclosed. As seen therein, the illumination device a2-01 comprises a light-emitting portion a2-03 which emits light, and a connector module a2-05 which connects the illumination device a2-01 to the electrical outlet of a light fixture. In the particular embodiment depicted, the connector module a2-05 is a threaded connector module that rotatingly engages a complimentary shaped socket in an electrical outlet (not shown), though it will be appreciated that the illumination devices disclosed herein are not necessarily limited to use in conjunction with such an outlet.

The light emitting portion a2-01 in this embodiment contains a synthetic jet actuator housing a2-11 which contains a set of diaphragms a2-13, and upon an exterior surface of which are disposed a plurality of LEDs a2-15. The set of diaphragms a2-13 operate to generate a plurality of synthetic jets a2-17, which are emitted from a plurality of apertures (not shown) provided in the synthetic jet actuator housing a2-11, and which transfer heat from the LEDs a2-15 to the interior of the light emitting portion a2-03. The apertures may be disposed in a variety of suitable patterns around one or more of the LEDs a2-15, one particular example of which is depicted in FIG. A2-1. The heat in the interior of the light emitting portion a2-03 may then be transferred to the external environment through thermal conduction, through the provision of apertures or vents in the light emitting portion a2-03, or by other suitable means.

The embodiment of FIG. A2-1 differs from the embodiment of FIGS. A1-1 to A1-3 in that the pedestal a1-25 of the embodiment of FIGS. A1-1 to A1-3 has essentially been replaced with the synthetic jet actuator housing a2-11. Such a construction allows for the use of larger diaphragms a2-13 which, in some applications and embodiments, may allow the synthetic jet actuator a2-07 to dissipate a larger amount of heat than a comparable device with smaller diaphragms a2-13.

FIG. A3-1 depicts another particular, non-limiting embodiment of an LED-based illumination device in accordance with the teachings herein. As seen therein, the illumination device a3-01 comprises a light-emitting portion a3-03 which emits light, and a connector module a3-05 which connects the illumination device a3-01 to the electrical outlet of a light fixture. In the particular embodiment depicted, the connector module a3-05 is a threaded connector module that rotatingly engages a complimentary shaped socket in an electrical outlet (not shown), though it will be appreciated that the illumination devices disclosed herein are not necessarily limited to use in conjunction with such an outlet.

The connector module a3-05 in this embodiment contains a synthetic jet actuator a3-07 which is equipped with a set of diaphragms a3-13. The synthetic jet actuator a3-07 is in fluidic communication with a pedestal a3-25 which is equipped on one end with a plenum a3-12. The plenum a3-12 is equipped with a plurality of apertures a3-20, and has a plurality of LEDs a3-15 disposed on an exterior surface thereof. The set of diaphragms a3-13 operate to generate a plurality of synthetic jets a3-17, which are emitted from a plurality of apertures a3-20 provided in the plenum a3-12, and which transfer heat from the LEDs a3-15 to the interior of the light emitting portion a3-03. The apertures a3-20 may be disposed in a variety of suitable patterns around one or more of the LEDs a3-15. The heat in the interior of the light emitting portion a3-03 may then be transferred to the external environment through thermal conduction, through the provision of apertures or vents in the light emitting portion a3-03, or by other suitable means.

The embodiment of FIG. A3-1 differs from the embodiment of FIGS. A1-1 to A1-3 in that the synthetic jet actuator a3-07 has been moved from the light emitting portion a3-03 of the device to the connector module a3-05. This arrangement is advantageous in some applications in that more of the interior space of the light emitting portion a3-03 is available for other purposes. It will be appreciated that this embodiment may offer greater flexibility in some applications with respect to the size and dimensions of the plenum a3-12, and the manner in which the LEDs a3-15 are disposed thereon.

FIG. A4-1 depicts another particular, non-limiting embodiment of an LED-based illumination device in accordance with the teachings herein. The illumination device a4-01 depicted therein comprises a light-emitting portion a4-03 which emits light, and a connector module a4-05 which connects the illumination device a4-01 to the electrical outlet of a light fixture.

This embodiment is similar to the embodiment of FIG. A1-3, except that the pedestal a1-25 of that embodiment has been replaced with a heat pipe a4-49. The heat pipe a4-49 is preferably in thermal communication with the connector module a4-05. A plurality of LEDs a4-15 are disposed on one end of the heat pipe a4-49. In some variations of this embodiment, the LEDs a4-15 may be mounted on a portion of the heat pipe a4-49 or on a thermally conductive substrate which is in thermal contact with the heat pipe a4-49. In some instances, this thermally conductive substrate may be the housing of a synthetic jet ejector or plenum thereof as in FIG. A1-2 or A3-1, though variations of this embodiment are also contemplated which are devoid of a synthetic jet ejector.

FIG. A5-1 depicts another particular, non-limiting embodiment of an LED-based illumination device in accordance with the teachings herein. The illumination device a5-01 depicted therein comprises a light-emitting portion a5-03 which emits light, and a connector module a5-05 which connects the illumination device a5-01 to the electrical outlet of a light fixture.

The illumination device a5-01 in this embodiment is a hybrid of the embodiments depicted in FIGS. A1-2 and A2-1. In particular, this embodiment utilizes a vertical arrangement of the diaphragms a5-13 in the synthetic jet ejector a5-09, but also utilizes a pedestal a5-25. In some variations, the pedestal a5-25 may be replaced with, or may include, a heat pipe.

The illumination device a5-01 in this embodiment is also equipped with a vent a5-23 which allows the atmosphere inside of the light emitting portion a5-03 to be in fluidic communication with the external atmosphere. In some variations of this embodiment, the synthetic jet ejector a5-09 may be adapted to emit synthetic jets from apertures in the vent a5-23, either solely or in addition to emitting synthetic jets a5-17 from the actuator housing a5-11.

FIG. A6-1 depicts another particular, non-limiting embodiment of an LED-based illumination device in accordance with the teachings herein. The illumination device a6-01 depicted therein comprises a light-emitting portion a6-03 which emits light, and a connector module a6-05 which connects the illumination device a6-01 to the electrical outlet of a light fixture.

The illumination device a6-01 in this embodiment is similar in many respects to the illumination device a5-01 of FIG. A5-1, but is equipped on an external surface thereof with a series of heat fins a6-27. The synthetic jet ejector a6-09 in this embodiment is adapted to direct a synthetic jet a6-17 into each channel a6-37 defined by an opposing pair of heat fins a6-27. The illumination device a6-01 in this embodiment is also equipped with a vent a6-23 which brings the atmosphere inside of the light emitting portion a6-03 into fluidic communication with the external atmosphere. In some variations of this embodiment, the synthetic jet ejector a6-09 may be adapted to emit synthetic jets from apertures in the vent a6-23 in addition to the synthetic jets a6-17 which are emitted from the synthetic jet ejector a6-09.

FIG. B1-1 depicts another particular, non-limiting embodiment of an LED-based illumination device in accordance with the teachings herein. The illumination device b1-01 depicted therein comprises a light-emitting portion b1-03 which emits light, and a connector module b1-05 which connects the illumination device b1-01 to the electrical outlet of a light fixture.

The light emitting portion b1-03 in this embodiment contains an active diaphragm b1-33 and a passive diaphragm b1-35 which are in fluidic communication with each other. A heat sink b1-59 comprising at least one heat fin b1-27 is disposed between the active diaphragm b1-33 and the passive diaphragm b1-35 and has a plurality of LEDs b1-15 disposed thereon. Each heat fin b1-27 has at least one channel b1-37 defined therein which is in fluidic communication with the environment external to the light emitting portion.

In operation, the active diaphragm b1-33 vibrates to produce a plurality of synthetic jets b1-17 in the air passing through the channels b1-37 and into the external environment. Hence, as the heat fins b1-27 absorb heat from the LEDs b1-15 mounted on the heat sink b1-59, this operation ensures that the heat is efficiently transferred to the external environment through the turbulent flow created by the synthetic jets b1-17. During operation, the larger passive diaphragm b1-35 basically serves as a counterweight to the active diaphragm b1-33, which allows the synthetic jet actuator b1-09 to provide sufficient heat flux while operating outside of the audible range and producing fewer vibrations.

The passive diaphragm b1-35 preferably has the same mass as the active diaphragm b1-33, although the dimensions of the two diaphragms may be the same or different. The passive diaphragm b1-35 may also be of the same or different construction as the active diaphragm b1-33. In some implementations of the embodiment, the passive diaphragm b1-35 may comprise a transparent or translucent material.

FIG. C1-1 depicts another particular, non-limiting embodiment of an LED-based illumination device in accordance with the teachings herein. The illumination device c1-01 depicted therein comprises a light-emitting portion c1-03 which emits light, and a connector module c1-05 which connects the illumination device c1-01 to the electrical outlet of a light fixture.

The illumination device c1-01 in this embodiment is equipped with a combination synthetic jet ejector/heat sink c1-29 which contains both a synthetic jet ejector c1-09 and a heat sink c1-27. These two components may be combined in a variety of ways, and each of these components, or the combination thereof, may have a variety of shapes or sizes. The two components may also comprise a variety of materials, though the heat sink c1-27 preferably comprises a thermally conductive material such as a metal (such as, for example, copper, aluminum, tin, steel, or various combinations or alloys thereof) or a thermally conductive loaded polymer. In the particular embodiment depicted, however, the heat sink c1-27 extends from one side of the synthetic jet ejector c1-09 and is adapted to direct synthetic jets c1-17 through channels c1-37 defined in the heat sink c1-27. Since the LED c1-15 is mounted on top of the heat sink c1-27 and is in thermal communication therewith, this arrangement transfers heat from the LED c1-15 to the atmosphere external to the illumination device c1-01.

In the embodiment depicted in FIG. C1-1, the light emitting portion c1-03 is preferably mounted on top of the heat sink c1-27 and may be open to the external atmosphere or may be vacuum sealed. Appropriate channels or conduits may be provided in the heat sink to accommodate any wires or circuitry associated with the LED c1-15. In some variations of this embodiment, however, the combination synthetic jet ejector/heat sink c1-29, the heat sink c1-27, or the synthetic jet ejector c1-09 may be disposed on an external surface of the illumination device c1-01. In such embodiments, if the heat sink c1-27 is disposed on an exterior surface of the illumination device c1-01, the LED c1-15 may be in thermal contact with the heat sink c1-27 through one or more heat pipes or other thermally conductive elements.

FIG. C2-1 depicts another particular, non-limiting embodiment of an LED-based illumination device in accordance with the teachings herein. The illumination device c2-01 depicted therein comprises a light-emitting portion c2-03 which emits light, and a connector module c2-05 which connects the illumination device c2-01 to the electrical outlet of a light fixture.

The illumination device c2-01 of this embodiment is similar in most respects to the illumination device c1-01 of FIG. C1-1 and hence is equipped with a combination synthetic jet ejector/heat sink c1-29 which contains both a synthetic jet ejector c1-09 and a heat sink c1-27. However, the illumination device c2-01 in this embodiment differs from the illumination device c1-01 of FIG. C1-1 in that the synthetic jet ejector c2-09 is centrally located. In some implementations, this type of embodiment may facilitate integration of the circuitry of the synthetic jet ejector c2-09 with the circuitry used to power the LED c2-15.

FIG. C3-1 depicts a further particular, non-limiting embodiment of an LED-based illumination device in accordance with the teachings herein. The illumination device c3-01 depicted therein comprises a light-emitting portion c3-03 which emits light, and a connector module c3-05 which connects the illumination device c3-01 to the electrical outlet of a light fixture.

In this embodiment, a heat sink c3-59 is disposed about the exterior of the light emitting portion c3-03 and the synthetic jet ejector c3-09 is disposed within the light emitting portion c3-03. However, the synthetic jet ejector c3-09 is in fluidic communication with the heat sink c3-59 by way of one or more channels c3-37. In the particular embodiment depicted, these channels c3-37 extend from the interior of the light emitting portion to the exterior of the light emitting portion c3-03, and are adapted to direct one or more synthetic jets across the surfaces of the heat sink c3-59 or the heat fins c3-27 thereof.

FIG. C4-1 depicts another particular, non-limiting embodiment of an LED-based illumination device in accordance with the teachings herein. The illumination device c4-01 depicted therein comprises a light-emitting portion c4-03 which emits light, and a connector module c4-05 which connects the illumination device c4-01 to the electrical outlet of a light fixture.

The illumination device c4-01 of this embodiment is similar in most respects to the illumination device c2-01 of FIG. C2-1 and hence is equipped with a combination synthetic jet ejector/heat sink c4-29 (shown in greater detail in FIG. C4-02) which contains both a synthetic jet actuator c4-07 and a heat sink c4-59. However, the illumination device c4-01 in this embodiment differs from the illumination device c1-01 of FIG. C2-1 in that the heat sink c4-27 is covered with a smooth exterior surface having a plurality of apertures c4-23 defined therein (see FIG. C4-1). These apertures c4-23 are in fluidic communication with the synthetic jet actuator c4-07 by way of channels c4-37 defined in the heat sink c4-27 (see FIG. C4-2). This type of embodiment may be advantageous in applications where the presence of exposed heat fins on the exterior of the illumination device c4-01 would be objectionable or undesirable.

FIG. C5-1 depicts another particular, non-limiting embodiment of an LED-based illumination device disclosed herein. The illumination device c5-01 depicted therein comprises a light-emitting portion c5-03 which emits light, and a connector module c5-05 which connects the illumination device c5-01 to the electrical outlet of a light fixture.

The illumination device c5-01 of this embodiment is similar in some respects to the illumination device c2-01 of FIG. C2-1 and to the illumination device c4-01 of FIG. C4-1 in that a heat sink c5-59 is disposed between the light-emitting portion c5-03 and the connector module c5-05. The illumination device c5-01 is also equipped with a synthetic jet actuator c5-09 that is provided with one or more diaphragms c5-13, and that may be disposed within the heat sink c5-59, within the connector module c5-05, or partially within both.

However, the illumination device c4-01 in this embodiment features a connector module c5-05 that is equipped with one or more nozzles c5-41 or apertures that are in fluidic communication with at least a portion of the interior of the connector module c5-05. The synthetic jet actuator c5-07 is in fluidic communication with the one or more nozzles c5-41 or apertures, and operates to generate one or more synthetic jets c5-41 at the nozzles c5-41 or apertures. These synthetic jets c5-17 are directed into the channel formed by opposing heat fins c5-27 in the heat sink c5-59, thus providing thermal management for an LED c5-15 which is disposed within the light emitting portion c5-41 and which is in thermal communication with the heat sink c5-59. Hence, at least a portion of the interior of the electrical connector module c5-5 (which, in many embodiments, will be an Edison socket) is used to form the nozzles c5-41 or apertures of a synthetic jet ejector used for thermal management of the host device.

FIGS. D1-1 to D1-2 depict a further particular, non-limiting embodiment of an LED-based illumination device in accordance with the teachings herein. The illumination device d1-01 depicted therein comprises a light-emitting portion d1-03 which emits light, and a connector module d1-05 which connects the illumination device d1-01 to the electrical outlet of a light fixture. A synthetic jet actuator d1-07 is disposed between the light emitting portion and the connector module d1-05.

This embodiment illustrates the application of the principles described herein to a popular type of compact fluorescent light bulb. The synthetic jet actuator d1-07 in this embodiment is equipped with a set of nozzles d1-41 which are adapted to direct a plurality of synthetic jets d1-17 across the surfaces, or into the interior of, the helical coil of the light emitting portion d1-03. The nozzles d1-41 are in fluidic communication with the interior of the synthetic jet actuator d1-07 where the diaphragms d1-13 are disposed, and the LEDs d1-15 which illuminate the light emitting portion d1-03 are disposed in, or adjacent to, this fluidic path.

In operation, the synthetic jet actuator d1-07 operates to create a fluidic flow adjacent to, or across the surfaces of, the LEDs d1-15, thereby removing heat from the LEDs and rejecting it to the external environment. The hot fluid is ejected as a synthetic jet d1-17, and hence is removed a significant distance from the nozzles d1-41. The synthetic jets also entrain cool air from the local environment and create a turbulent flow around the surfaces of the helix of the light emitting portion, thus helping to cool this portion of the illumination device d1-01 as well. The synthetic jets also draw in cool fluid around the nozzles d1-41, which is then drawn into the synthetic jet ejector during the in-flow phase of the diaphragms d1-13.

FIGS. D2-1 to D2-2 depict another particular, non-limiting embodiment of an LED-based illumination device in accordance with the teachings herein. The illumination device d2-01 depicted therein comprises a light-emitting portion d2-03 which emits light, and a connector module d2-05 which connects the illumination device d2-01 to the electrical outlet of a light fixture. A synthetic jet actuator d2-07 is disposed between the light emitting portion and the connector module d2-05.

The illumination device of FIGS. D2-1 to D2-2 is similar in many respects to the illumination device d1-01 of FIGS. D1-1 to D1-2. However, in the embodiment of FIGS. D2-1 to D2-2, the LEDs d2-15 are disposed at entrances to the helical light emitting portion d2-03, and the synthetic jet actuator d2-07 operates to direct synthetic jets d2-17 past the LEDs and into the light emitting portion d2-03. As best seen in FIG. D2-2, region d2-53 of the light emitting portion d2-03 is equipped with a series of apertures d2-23 which vent the fluidic flow to the external atmosphere. The vented flow may be in the form of one or more synthetic jets, but need not be so.

Various modifications may be made to the embodiment depicted in FIGS. D2-1 to D2-2. For example, in some variations, a single LED d2-15 may be utilized to generate light, and hence only one opening of the helix may be occupied by an LED d2-15. In some embodiments, two or more LEDs d2-15 may be provided which emit different wavelengths of light, and which provide color mixing for desired optical effects. In some embodiments, the apertures d2-23 may be disposed in any desired location on the light emitting portion d2-03.

FIG. D3-1 depicts another particular, non-limiting embodiment of an LED-based illumination device in accordance with the teachings herein. The illumination device d3-01 depicted therein comprises a light-emitting portion d3-03 which emits light, and a connector module d3-05 which connects the illumination device d3-01 to the electrical outlet of a light fixture. A synthetic jet actuator d3-07 is disposed between the light emitting portion and the connector module d3-05.

The illumination device d3-01 of FIG. D3-1 is similar in most respects to the illumination device of FIG. D1-1, but differs in the placement of the LEDs d3-39. In particular, in the embodiment depicted in FIG. D3-1, the LEDs d3-39 are disposed on the external surface of the helix of the light emitting portion d3-3. The synthetic jet actuator d3-07 operates to generate a fluidic flow which extends through the coils of the light emitting portion d3-03, and exits through nozzles d3-41 in the form of synthetic jets d3-17. Hence, this embodiment operates to cool the substrate the LED d3-39 is disposed on, as well as the light emitting surface of the LED d3-39.

In some variations of this embodiment, the helical coils of the light emitting portion d3-03 may comprise a suitably thermally conductive material. Such a material may provide for more efficient transfer of heat from the LEDs d3-39 to the underlying substrate, where it may be rejected to the external atmosphere by the fluidic flow created by the synthetic jet actuator d3-07. In other variations, the LEDs d3-39 may be directed inward so that their backsides are exposed to the internal environment, and their light emitting surfaces are directed towards the interior of the helical coil. In these different embodiments, a metallic interconnect may be disposed on the interior or exterior surface of the coils, or may be embedded in the walls of the coils.

FIG. E1-1 depicts another particular, non-limiting embodiment of an LED-based illumination device in accordance with the teachings herein. The illumination device e1-01 depicted therein comprises a light-emitting portion e1-03 which emits light, and a connector module e1-05 which connects the illumination device e1-01 to the electrical outlet of a light fixture. A synthetic jet actuator e1-07 is disposed between the light emitting portion and the connector module e1-05.

In this embodiment, the synthetic jet actuator e1-07 is centrally disposed within the light emitting portion e1-03, and a plurality of LEDs e1-15 are disposed around it. A heat sink e1-59 is built into the base of the illumination device e1-01, and is equipped with channels e1-37 which are in fluidic communication with the synthetic jet actuator e1-07. During operation, the synthetic jet actuator e1-07 creates a fluidic flow which preferably includes synthetic jets e1-17, and which rejects heat from the heat sink e1-59 to the external environment.

As indicated in FIG. E1-1, the surfaces of the illumination device e1-01 in the vicinity of the LEDs e1-15 may be covered with a suitable reflective material e1-45. The amount of the surface area so coated may be determined, for example, by the desired illumination profile of the illumination device e1-01. Notably, the design of this illumination device e1-01 also allows for the use of relatively large diaphragms e1-13 in the synthetic jet actuator e1-07, which may be useful in achieving high heat flux from the heat sink e1-59 to the external environment.

FIG. E2-1 depicts another particular, non-limiting embodiment of an LED-based illumination device in accordance with the teachings herein. The illumination device e2-01 depicted therein comprises a light-emitting portion e2-03 which emits light, and a connector module e2-05 which connects the illumination device e2-01 to the electrical outlet of a light fixture. A synthetic jet ejector e2-09 is disposed between the light emitting portion and the connector module e2-05.

One wall of the synthetic jet ejector e2-09 is equipped with a heat sink e2-59 comprising a plurality of heat fins e2-27. The heat fins e2-27 are disposed adjacent to an LED e2-15 and define a plurality of channels e2-37 which are in fluidic communication with the interior of the synthetic jet ejector e2-09.

During operation, the heat sink e2-59 absorbs heat from the LEDs e2-15, and the synthetic jet ejector e2-09 generates a plurality of synthetic jets e2-17 in the channels e2-37 which transfers the heat to the interior environment of the light emitting portion e2-03. From there, the heat is rejected to the external environment through thermal transfer. In some implementations, thermal transfer to the external environment may be facilitated by the provision of suitable venting in the light emitting portion e2-03 or by other suitable means. As with the previous embodiment, the design of this illumination device e2-01 allows for the use of relatively large diaphragms e2-13 in the synthetic jet ejector e2-09, which may be useful in achieving high heat flux from the heat sink e2-59 to the external environment.

FIG. E3-1 depicts another particular, non-limiting embodiment of an LED-based illumination device in accordance with the teachings herein. The illumination device e3-01 depicted therein comprises a light-emitting portion e3-03 which emits light, and a connector module e3-05 which connects the illumination device e3-01 to the electrical outlet of a light fixture. A synthetic jet ejector e3-09 is disposed between the light emitting portion and the connector module e3-05.

In this embodiment, the synthetic jet ejector e3-09 is centrally disposed within a heat sink e3-59 having a plurality of external heat fins e3-27. The external heat fins e3-27 have a plurality of channels e3-37 defined therein which are in fluidic communication with the interior of the synthetic jet ejector e3-09 and the external environment. An LED e3-15 is disposed on top of the heat sink.

In operation, the heat sink e3-59 absorbs heat given off by the LED e3-15, and this heat is transferred to the heat fins e3-27. The synthetic jet ejector e3-09 creates a plurality of synthetic jets e3-17 in the channels e3-37 which rejects the heat to the external environment. As with the previous embodiment, the design of this illumination device e3-01 allows for the use of relatively large diaphragms e3-13 in the synthetic jet ejector e3-09, which may be useful in achieving high heat flux from the heat sink e3-59 to the external environment.

FIG. E4-1 depicts another particular, non-limiting embodiment of an LED-based illumination device in accordance with the teachings herein. The illumination device e4-01 depicted therein comprises a light-emitting portion e4-03 which emits light, and a connector module e4-05 which connects the illumination device e4-01 to the electrical outlet of a light fixture. A synthetic jet ejector e4-09 is disposed between the light emitting portion and the connector module e4-05.

In this embodiment, the synthetic jet ejector e4-09 is centrally disposed within a heat sink e4-59 having a plurality of external heat fins e4-27. The portion of the heat sink e4-59 which separates the light emitting portion e4-03 from the heat fins e4-27 is porous, and hence provides for fluidic flow between the interior of the light emitting portion e4-03 and the external environment as indicated by arrows e4-63. This may be achieved, for example, by forming this portion of the heat sink e4-59 out of a foamed, thermally conductive material, such as a foamed metal, or by providing a plurality of apertures or vents in this portion of the heat sink e4-59. An LED e4-15 is disposed on top of the heat sink e4-59.

Similarly, the interior of the light emitting portion e4-03 is in fluidic communication with the interior of the synthetic jet ejector e4-09. This may be accomplished, for example, by seating the LED e4-15 on a metal plate or heat spreader which is in thermal contact with the heat fins e4-27, and which has a plurality of apertures e4-37 therein adjacent to the LED e4-15 which are in fluidic communication with the interior of the synthetic jet ejector e4-09.

In operation, the heat sink e4-59 absorbs heat given off by the LED e4-15, and this heat is transferred to the heat fins e4-47. The synthetic jet ejector e4-09 emits a plurality of synthetic jets e4-17 from the channels e4-37, which in turn creates a flow of fluid across the heat fins e4-27. The synthetic jets e4-17 also facilitate the transfer of heat from the LED e4-15 to the interior atmosphere of the light emitting portion e4-03, where the warmed fluid can then exit the light emitting portion e4-03 to the external environment as indicated by the arrows e4-63. This fluidic flow also facilitates the transfer of heat from the heat fins e4-27 to the external environment. As with the previous embodiment, the design of this illumination device e4-01 allows for the use of relatively large diaphragms e4-13 in the synthetic jet ejector e4-09, which may be useful in achieving high heat flux from the heat sink e4-59 to the external environment.

FIG. E5-1 depicts another particular, non-limiting embodiment of an LED-based illumination device in accordance with the teachings herein. The illumination device e5-01 depicted therein comprises a light-emitting portion e5-03 which emits light, and a connector module e5-05 which connects the illumination device e5-01 to the electrical outlet of a light fixture. A synthetic jet ejector e5-09 is disposed between the light emitting portion and the connector module e5-05.

In this embodiment, the synthetic jet ejector e5-09 is centrally disposed within a heat sink e5-59 having a plurality of external heat fins e5-27. The heat sink e5-59 has a plurality of channels defined therein by the space between adjacent heat fins e5-27. These channels are in fluidic communication with the external environment, and are also in fluidic communication with the interior of the synthetic jet ejector e5-09 by way of a plurality of nozzles e5-41 disposed at the top and bottom of the channels. An LED e3-15 is disposed on top of the heat sink.

In operation, the heat sink e5-59 absorbs heat given off by the LED e5-15, and this heat is transferred to the heat fins e5-27. The synthetic jet ejector e5-09 creates a plurality of synthetic jets e5-17 in the channels of the heat sink e5-59 which rejects the heat to the external environment.

Various flow patterns are possible with this embodiment. Preferably, for any pair of heat fins which are coplanar (as shown in the figure) or on opposing sides of the heat sink, one heat fin has a synthetic jet directed in a first direction parallel to its major surface, and the second heat fin has a synthetic jet directed in a second direction parallel to its major surface, where the first and second directions are preferably opposing directions. It is also preferred that the heat fins on a first half of the device have synthetic jets directed across their major surfaces in the first direction, and that the heat fins on a second half of the device have synthetic jets directed across their major surfaces in the second direction, since this helps to create a circular flow pattern around the device. However, embodiments are also possibly where the directions of the jets alternate between each channel formed by adjacent pairs of fins.

FIG. E6-1 depicts another particular, non-limiting embodiment of an LED-based illumination device in accordance with the teachings herein. The illumination device e6-01 depicted therein comprises a light-emitting portion e6-03 which emits light and a connector module e6-05 which connects the illumination device e6-01 to the electrical outlet of a light fixture. A heat sink e6-59 having a plurality of external heat fins e5-27 is disposed between the connector module e6-05 and the light-emitting portion e6-03.

A synthetic jet ejector e6-09 is centrally disposed between the heat sink e6-59 and the connector module e6-05. The heat sink e6-59 has a plurality of channels defined therein by the space between adjacent heat fins e6-27. These channels are in fluidic communication with the external environment, and are also in fluidic communication with the interior of the synthetic jet ejector e6-09 by way of the interior of the connector module k1-05 as indicated by arrows e6-63. An LED e6-15 is disposed on top of the heat sink e6-59.

In operation, the heat sink e6-59 absorbs heat given off by the LED e6-15, and this heat is transferred to the heat fins e6-27. The synthetic jet ejector e6-09 creates a plurality of synthetic jets e6-17 in the channels of the heat sink e6-59 which rejects the heat to the external environment.

FIG. F1-1 depicts a further particular, non-limiting embodiment of an LED-based illumination device in accordance with the teachings herein. The illumination device f1-01 depicted therein comprises a light-emitting portion f1-03 which emits light, and a connector module f1-05 which connects the illumination device f1-01 to the electrical outlet of a light fixture. A synthetic jet actuator f1-07 is disposed between the light emitting portion f1-03 and the connector module f1-05.

The illumination device f1-01 in this embodiment is equipped with a heat sink f1-59 comprising a plurality of heat fins f1-27, and upon which is disposed an LED f1-15. The illumination device f1-01 comprises an interior housing element f1-55 and an exterior housing element f1-57 which, between them, define a channel f1-37 for fluidic flow. The channel f1-37 is in fluidic communication with the synthetic jet actuator f1-07 by way of a series of internal apertures f1-09, and is further in fluidic communication with a plurality of nozzles f1-41 disposed about the interior of the light emitting portion f1-03.

In operation, the synthetic jet actuator f1-07, which is driven by one or more diaphragms f1-13, creates a plurality of synthetic jets f1-17 at the nozzles f1-41. The synthetic jets f1-17 are directed at, or across, the surfaces of the LED f1-15, and especially the light emitting surface thereon. The synthetic jets f1-17 facilitate the transfer of heat from the LED f1-15 to the interior atmosphere of the light emitting portion f1-03, where it can be dissipated through thermal transfer to the internal f1-55 and external f1-57 housing elements and to the external environment, or through absorption by the heat sink f1-59. The heat sink f1-59 serves to absorb heat directly from the backside of the LED f1-15. In some implementations of this embodiment, the heat sink f1-59 may be equipped with one or more heat pipes.

FIG. G1-1 depicts a further particular, non-limiting embodiment of an LED-based illumination device in accordance with the teachings herein. The illumination device g1-01 depicted therein comprises a light-emitting portion g1-03 which emits light, a connector module g1-05 which connects the illumination device g1-01 to the electrical outlet of a light fixture, and a heat sink g1-59 disposed between the two. A synthetic jet ejector g1-09 equipped with a set of diaphragms g1-13 is disposed in a central, internal chamber g1-51 in the light emitting portion g1-03 of the illumination device g1-01. The internal chamber g1-51 has a reflective surface g1-45. A plurality of LEDs g1-15 are disposed on the heat sink g1-59 in the volume between the internal chamber g1-45 and the exterior wall of the light emitting portion g1-03.

In operation, the light emitted from the LEDs g1-15 is reflected off of the reflective surface g1-45 and is emitted through the exterior wall of the light emitting portion g1-03. The degree of specular or diffuse reflectivity of these two surfaces may be selected to achieve a desired illumination footprint. Heat is withdrawn from the LEDs g1-15 by the heat sink g1-59. The synthetic jet ejector g1-09 creates a fluidic flow across the surfaces of the heat fins g1-27 as indicated by the arrows g1-63, thus rejecting the heat to the external environment. Preferably, this flow g1-63 is in the form of one or more synthetic jets.

FIG. G1-2 depicts another particular, non-limiting embodiment of an LED-based illumination device in accordance with the teachings herein. The illumination device g2-01 depicted therein comprises a light-emitting portion g2-03 which emits light, and a synthetic jet ejector g2-09. The remaining elements of the illumination device have been omitted for clarity of illustration, but would typically include an electrical connector module and the operating components of the synthetic jet ejector g2-09. The illumination device g2-01 includes a heat spreader g2-65 with a plurality of apertures g2-19 defined therein. The globe g2-57 of the light emitting portion g2-03 is provided with a centrally disposed depression g2-51 therein.

In use, the synthetic jet ejector g2-09 creates a plurality of synthetic jets g2-17 in the vicinity of the LED g2-15. The synthetic jets impinge on the surface of the depression g2-51, and thus aid in the transfer of heat from the interior of the light emitting portion g2-03 to the external environment.

FIG. H1-1 depicts another particular, non-limiting embodiment of an LED-based illumination device in accordance with the teachings herein, which in this case is a tubular illumination device similar to the type used in fluorescent lamps. The illumination device h1-01 depicted therein comprises a light-emitting portion h1-03 which emits light, and a synthetic jet actuator h1-09 equipped with a set of diaphragms h1-13. An LED g1-15 is disposed at each end of the tubing h1-57 forming the light emitting portion h1-03, and has a set of apertures h1-19 disposed adjacent thereto which permit a fluidic flow about the LED h1-13 and into the tubing h1-57 of the light emitting portion h1-03.

In operation, the synthetic jet ejector h1-09 creates a fluidic flow about the LEDs h1-15 in the form of one or more synthetic jets h1-17. This flow transfers heat from the LEDs h1-13 to the surfaces of the tubing h1-57 of the light emitting portion h1-03, where it is rejected to the external atmosphere.

FIG. H2-1 depicts another particular, non-limiting embodiment of an LED-based illumination device in accordance with the teachings herein. The illumination device h2-01 depicted therein is similar in most respects to the embodiment depicted in FIG. H1-1, and hence comprises a light-emitting portion h2-03 which emits light, and a synthetic jet actuator h2-09 equipped with a set of diaphragms h2-13. An LED h2-15 is disposed at each end of the tubing h2-57 forming the light emitting portion h2-03, and has a set of apertures h2-19 disposed adjacent thereto which permit a fluidic flow about the LED h2-15 and into the tubing h2-57 of the light emitting portion h2-03. In addition, however, the illumination device h2-01 of this embodiment is equipped with a passive diaphragm h2-35 which operates in a manner similar the passive diaphragm b1-35 in the embodiment of FIG. B1-1.

In operation, the synthetic jet ejector h2-09 creates a fluidic flow about the LEDs h2-15 in the form of one or more synthetic jets h2-17. This flow transfers heat from the LEDs h2-15 to the surfaces of the tubing h2-57 of the light emitting portion h2-03, where it is rejected to the external atmosphere.

FIG. H3-1 depicts another particular, non-limiting embodiment of an LED-based illumination device in accordance with the teachings herein. The illumination device h3-01 depicted therein is similar in most respects to the embodiment depicted in FIG. H1-1, and hence comprises a light-emitting portion h3-03 which emits light, and a synthetic jet actuator h3-09 equipped with a set of diaphragms h3-13. An LED h3-15 is disposed at each end of the tubing h3-57 forming the light emitting portion h3-03, and has a set of apertures h3-19 disposed adjacent thereto which permit a fluidic flow about the LED h3-15 and into the tubing h3-57 of the light emitting portion h3-03. In addition, however, this embodiment is equipped with an external vent h3-23 disposed in a central location on the tubing h3-57 which forms the light emitting portion h3-03.

In operation, the synthetic jet ejector h3-09 creates a fluidic flow about the LEDs h3-15 in the form of one or more synthetic jets h3-17. This flow transfers heat from the LEDs h3-15 to the surfaces of the tubing h3-57 of the light emitting portion h3-03, where it is rejected to the external atmosphere. The external vent h3-23 provides an additional means by which heat may be rejected to the external environment.

In some variations of this embodiment, the illumination device h2-01 may be adapted to emit synthetic jets from the external vent h3-23. In other variations, the synthetic jet ejector provides a fluidic flow around the LEDs h3-15, but only emits synthetic jets at the external vent h3-23.

Reflective Materials

The various embodiments of light fixtures disclosed herein may be equipped with various reflective materials or surfaces. These include, without limitation, specularly or diffusely reflective or scattering materials. Such materials may be applied to the intended substrate as coatings or films. In some implementations, these coatings or films may be formed and then applied to the substrate, while in other implementations, they may be formed on the substrate in situ.

Examples of such scattering films include those based on continuous/disperse phase materials. Such films may be formed, for example, from a disperse phase of polymeric particles disposed within a continuous polymeric matrix. In some embodiments, one or both of the continuous and disperse phases may be birefringent. Such a film may be oriented, typically by stretching, in one or more directions. The size and shape of the disperse phase particles, the volume fraction of the disperse phase, the film thickness, and the amount of orientation may be chosen to attain a desired degree of diffuse reflection and total transmission of electromagnetic radiation of a desired wavelength in the resulting film. Films of this type, and methods for making them, are described, for example, in U.S. Pat. No. 6,031,665 (Carlson et al.), which is incorporated herein by reference in its entirety. Analogous films in which the disperse phase comprises inorganic or non-polymeric materials (such as, for example, silica, alumina, or metal particles) may also be utilized in the devices and methodologies described herein.

Reflective surfaces may also be imparted to the devices described herein through suitable metallization. These include, for example, films of silver or other metals which may be formed through vapor or electrochemical deposition.

Electrical Outlets

The various embodiments of light fixtures disclosed herein may be equipped with various electrical connectors. These include, without limitation, threaded connectors that rotatingly engage complimentary shaped sockets in an electrical outlet; prong connectors, which may be male or female, and which mate with complimentary shaped prongs or receptacles in an electrical outlet; cord connectors; and the like. The choice of connector may vary from one application to another and may depend, for example, on the wattage output of the light fixture and other such considerations as are known to the art. It will be understood, however, that while embodiments of light fixtures may have been disclosed or illustrated herein as having a particular connector type, any other suitable connector, including those described above, may be substituted where suitable for a particular application.

Bulb Coatings/Pigments

The various embodiments of light fixtures disclosed herein may be equipped with various bulbs. These bulbs, or any portion thereof, may be clear, opaque, specularly or diffusively transmissive, specularly or diffusively reflective, polarizing, mirrored, colored, or any combination of the foregoing. In some embodiments, the bulb may also be equipped with a film or pigment which provides the light fixture with a desired optical footprint. These bulbs may also be equipped with any of the various types of phosphors as are known to the art, or with various combinations of such phosphors.

Synthetic Jet Actuators/Ejectors

Various synthetic jet actuators and synthetic jet ejectors may be utilized in the devices and methodologies described herein. Preferably, however, the synthetic jet actuators and synthetic jet ejectors are of the type described in U.S. Ser. No. 61/304,427, entitled "SYNTHETIC JET EJECTOR AND DESIGN THEREOF TO FACILITATE MASS PRODUCTION" (Grimm et al.), which is incorporated herein by reference in its entirety. These synthetic jet actuators and synthetic jet ejectors may have various sizes, dimensions and geometries, and hence may be adapted to spaces available in the host device. Hence, for example, the synthetic jet ejector may be cylindrical, parallelepiped, or irregular in shape. Also, while the use of synthetic jet actuators which utilize voice coils is preferred, one skilled in the art will appreciate that synthetic jet actuators based on various piezoelectric materials may also be utilized.

FIG. I-1 depicts a particular, non-limiting embodiment of such a synthetic jet ejector i1-09 and its application in an illumination device i1-01. The illumination device i1-01 comprises a light-emitting portion i1-03, a heat sink i1-59 (which, in this embodiment, is integral with the housing) having a synthetic jet actuator i1-07 (see FIG. I1-2) disposed therein, an upper wall i1-75, a lower wall i1-76, and a base i1-79.

As best seen in FIG. I1-4, the synthetic jet ejector i1-09 comprises first and second voice coils i1-67 which drive first and second diaphragms i1-69. The synthetic jet ejector i1-09 has first i1-71 and second i1-73 channels defined therein which are in fluidic communication with a heat sink i1-59.

Notably, in the particular illumination device i1-01 depicted, elements of the host illumination device i1-01 define the housing of the synthetic jet ejector i1-09. Consequently, the overall space occupied by the synthetic jet ejector i1-09 is significantly reduced compared to the situation that would exist if the synthetic jet ejector was made as a standalone unit (with its own housing) and subsequently incorporated into the host device. Moreover, in this embodiment, the upper wall i1-75 (see FIG. I1-1) is thermally conductive and is in thermal communication with the heat sink fins i1-27, and hence forms part of the heat sink i1-59. This allows the synthetic jet ejector i1-09 to absorb a greater amount of heat, distribute it over a larger area, and disperse it to the external atmosphere with the fluidic flow used to create synthetic jets i1-17. As a further advantage, the synthetic jets i1-17 further help to dissipate heat to the external environment by disrupting the boundary layer at the surfaces of the fins i1-27 of the synthetic jet ejector i1-09.

FIG. J1-1 depicts a particular, non-limiting embodiment of a synthetic jet ejector which may be used in some of the LED-based illumination devices disclosed herein, and which may also be used in various other applications where synthetic jet ejectors commonly find use. As seen therein, the synthetic jet ejector j1-01 comprises a heat sink j1-03 having a perimeter wall j1-05. The exterior surface of the perimeter wall j1-05 is equipped with a plurality of heat fins j1-07, and the interior surface of the perimeter wall j1-05 defines an interior space j1-09 within which one or more synthetic jet actuators are disposed. For simplicity of illustration, the details of the one or more synthetic jet actuators are not illustrated; rather, the synthetic jet actuators is indicated by opposing diaphragms j1-11. Of course, one skilled in the art will appreciate that, in a particular implementation, a single diaphragm j1-11, or more than two diaphragms j1-11, may be utilized. Moreover, the one or more synthetic jet actuators may be driven by voice coils, piezoelectric devices, or other suitable actuator means as are known to the art, although the use of voice coils is preferred.

As seen in FIG. J1-1, the one or more synthetic jet actuators operate to create a fluidic flow—which preferably includes one or more synthetic jets—in at least two, and preferably at least four, different directions within a given cross-sectional plane taken in a direction parallel to the major surface of a heat fin (here, it is to be understood that the use of non-planar heat fins is also possible in variations of this embodiment; hence, reference to planar heat fins is for simplicity of illustration). Preferably, this fluidic flow is primarily disposed along first and second mutually orthogonal axes, it being understood that synthetic jets are typically highly directional and characterized by a predominant flow along a single axis for a particular synthetic jet.

Fluidic flow along a first axis parallel to the major surfaces of the heat fins j1-07 may be achieved through the provision of a series of flow control devices (preferably in the form of apertures in the perimeter wall j1-05) which may be configured to induce the formation of synthetic jets in the ambient media along a first axis (indicated by arrows j1-12, j1-14) parallel to the major surfaces of the heat fins j1-07. Since the perimeter wall j1-05 may assume virtually any shape (including, for example, circular, elliptical, irregular or polygonal (including, but not limited to, square, rectangular, pentagonal and hexagonal)), these synthetic jets may be directed in a plurality of directions. Preferably, though not necessarily, the heat fins j1-07 will follow the contour of the perimeter wall j1-05.

Fluidic flow along a second axis parallel to the major surfaces of the heat fins j1-07 may be achieved through the provision of a series of flow control devices which may be configured to induce the formation of synthetic jets in the ambient media along a second axis (indicated by arrows j1-16, j1-18) parallel to the major surfaces of the heat fins j1-07. An example of such a flow control device is disclosed in U.S. Ser. No. 12/503,832, entitled "Advanced Synjet Cooler Design for LED Light Modules" (Grimm), filed on Jul. 15, 2009. Such a flow control device may be utilized, for example, to direct fluidic flow—which may include synthetic jets—from a series of apertures disposed along the top and bottom of the device. Notably, the direction of flow indicated by arrows j1-16, j1-18 is preferably orthogonal to the fluidic flow along the first axis.

The synthetic jet ejector j1-01 of FIG. J1-1 has some notable features that make its use advantageous in some applications. In particular, the design of the synthetic jet ejector j1-01 makes it smaller, which is advantageous in applications where there is limited space in the host device.

Moreover, the flow design has the potential to create more entrainment, and better thermal performance, in some applications.

Heat Sinks

The various illumination devices described herein may be equipped with heat sources of various sizes, shapes and geometries. These heat sinks may be readily adapted to the space available within the illumination device or external to it. In some embodiments, these heat sinks may comprise a plurality of heat fins or other suitable heat dissipating structures.

In some applications, it may be desirable to mount the heat sink on the exterior of an illumination device. Examples of such embodiments may be found in FIGS. C1-1, C2-1 and C3-1. As illustrated in the embodiment of FIGS. C4-1 and C4-2, however, the surface created by the heat fins may be covered by a smooth surface equipped with a plurality of apertures. Such a surface permits a fluidic flow between adjacent fins in the heat sink, but presents a smooth, possibly aesthetically pleasing outer surface. In such embodiments, the edges of the channels formed by adjacent fins may be left open to the ambient environment to facilitate heat transfer thereto.

In some embodiments, the heat sink may be utilized as a support structure for the actuator, engine, diaphragm or other components of the synthetic jet ejector. Since many current synthetic jet ejectors have various support structures for these components, this approach helps to reduce the size and cost of synthetic jet ejectors. If desired, some of these components may also be formed out of thermally conductive materials (such as, for example, injection molded plastics with conductive fillers).

FIG. L1-1 shows a particular, non-limiting embodiment of the foregoing type of heat sink. As seen therein, the heat sink l1-59 depicted therein is constructed to include or provide support for some of the components of the synthetic jet ejector. The heat sink l1-59 in this embodiment may comprise any suitable thermally conductive material, including various metals and filled polymers. Preferably, however, the heat sink l1-59 comprises a thermally conductive, injection molded plastic.

The heat sink l1-59 in this embodiment comprises a first compartment l1-83 which houses one or more LEDs l1-15, and a second compartment l1-85 which houses the voice coils l1-67 and diaphragms l1-69 of one or more synthetic jet actuators. A magnet l1-81 associated with the one or more synthetic jet actuators is embedded in the material of the heat sink l1-59. Also, as indicated by arrows l1-63, flow paths are designed in the heat sink l1-59. Such flow paths may be in the form of channels molded into the heat sink l1-59, which may be closed along portions of their length, or which may be open along all, or a portion of, their lengths. Preferably, these channels are formed by pairs of adjacent heat fins l1-27 along portions of their length.

FIG. M1-1 shows another particular, non-limiting embodiment of a heat sink which is similar in many respects to the embodiment shown in FIG. L1-1. Hence, as seen therein, the heat sink m1-59 depicted is constructed to include or provide support for some of the components of the synthetic jet ejector. The heat sink m1-59 in this embodiment may comprise any suitable thermally conductive material, including various metals and filled polymers, and preferably comprises a thermally conductive, injection molded plastic. However, unlike the embodiment shown in FIG. L1-1, the heat sink further includes an integrated heat sink support structure m1-32. This heat sink support structure m1-32 preferably comprises a material that is more thermally conductive than the thermally conductive, injection molded plastic to provide better thermal conduction in the base and into the fins. The heat sink support structure m1-32 preferably comprises a metal with high thermal conductivity, such as aluminum or copper, which may be stamped and formed into the heat sink shape and overmolded with the thermally conductive, injection molded plastic.

The heat sink m1-59 in this embodiment comprises a first compartment m1-83 which houses one or more LEDs m1-15, and a second compartment m1-85 which houses the voice coils m1-67 and diaphragms m1-69 of one or more synthetic jet actuators. A magnet m1-81 associated with the one or more synthetic jet actuators is embedded in the material of the heat sink m1-59. Also, as indicated by arrows m1-63, flow paths are designed in the heat sink m1-59. Such flow paths may be in the form of channels molded into the heat sink m1-59, which may be closed along portions of their length, or which may be open along all, or a portion of, their lengths. Preferably, these channels are formed by pairs of adjacent heat fins m1-27 along portions of their length.

FIG. N1-1 shows another particular, non-limiting embodiment of a heat sink which is similar in some respects to the heat sinks utilized in the embodiments shown in FIGS. E1-1 to E1-4. Hence, as seen therein, the heat sink n1-59 depicted therein is constructed to include or provide support for some of the components of the synthetic jet ejector. The heat sink n1-59 in this embodiment may comprise any suitable thermally conductive material, including various metals and filled polymers. Preferably, however, the heat sink n1-59 comprises a thermally conductive, injection molded plastic.

The heat sink n1-59 in this embodiment comprises a first compartment n1-83 which may be utilized to house one or more LEDs (not shown), and a second compartment n1-85 which houses the voice coils n1-67 and diaphragms n1-69 of one or more synthetic jet actuators. As indicated by arrows n1-63, flow paths are designed in the heat sink n1-59. Such flow paths may be in the form of channels molded into the heat sink n1-59, which may be closed along portions of their length, or which may be open along all, or a portion of, their lengths. Preferably, these channels are formed by pairs of adjacent heat fins n1-27 along portions of their length.

This embodiment is advantageous in that the surround is long and has a small bend radius. Such a construction allows for a larger usable piston area. Moreover, the small radius allows for a smaller diameter assembly with more usable piston area.

FIGS. P1-1 to P1-2 illustrate a particular, non-limiting embodiment of a diaphragm assembly and its use in accordance with the teachings herein. As with the previous embodiments, this embodiment allows elements of the host device to be used as part of the construction of the synthetic jet ejector.

With reference to FIG. P1-1, the diaphragm assembly p1-83 comprises a diaphragm p1-13, a preferably toroidal and resilient surround p1-89, a voice coil p1-67 and a magnet p1-89. This assembly is preferably prefabricated as a single standalone unit.

As seen in FIG. P1-2, the diaphragm assembly p1-83 may then be assembled into an illumination device. For simplicity of illustration, only the heat sink p1-59 and the electrical connector module p1-5 of an illumination device are shown, and these components are preferably designed to fit together with a snap fit or threaded fit. As seen therein, the diaphragm assembly p1-83 is disposed between the heat sink p1-59 and the electrical connector module p1-5 in such a way that the resilient surround p1-89 is compressed between the two when they are attached together, thus forming a seal. This construction eliminates the need for adhesives, overmolding or ultrasonic welding in assembling these devices.

FIGS. S1-1 and S2-1 illustrate further particular, non-limiting embodiments of illumination devices in which elements of the thermal management solution are built into different components of the final device. In particular, these embodiments illustrate examples in which the synthetic jet actuator is built into a light fixture, and in which the heat sink and parts of the fluidic flow path for the synthetic jet ejectors are built into the bulb which fits into the fixture. These approaches provide additional flexibility for applications where such flexibility is required by the form factor of the bulb or the matching electronics, LEDs, wiring, thermal management constraints, or cost considerations.

With respect to FIG. S1-1, the embodiment depicted therein features a light fixture s1-93 that comprises an illumination device s1-1 and a host light socket s1-97. The host light socket s1-97 is powered by a power cord s1-95, and has a synthetic jet ejector s1-7 housed therein which is in fluidic communication with a plurality of apertures s1-20 defined in the surface of the light socket s1-97 adjacent to the illumination device s1-1. The illumination device s1-1 is equipped with an electrical connector module s1-5 which rotatingly engages a complimentary shaped threaded receptacle in the light fixture s1-93. The illumination device s1-1 is further equipped with a heat sink s1-59 and a light emitting portion s1-3. In addition, the illumination device s1-1 is equipped with a series of apertures that align with the apertures s1-20 in the light fixture s1-93.

When the illumination device s1-1 is installed in the light socket s1-97, the synthetic jet actuator resident in the light socket s1-97 creates a fluidic flow into the light emitting device s1-1 as indicated by synthetic jets s1-17. This fluidic flow dissipates heat from the heat sink s1-59 and to the ambient environment.

The embodiment depicted in FIG. S1-2 is similar in many respects to the embodiment of FIG. S1-1. However, in this embodiment, the synthetic jet actuator s2-9 is separate from the light fixture (not shown) and is fluidically connected to the illumination device s2-1 by way of tubing s2-37.

In the embodiments of FIGS. S1-1 and S2-1, various interfaces may be utilized to establish a connection between the flow path provided by the synthetic jet actuators and the flow path within the illumination device. For example, in some embodiments, ports or other such features may be provided in the light fixture that form a (preferably air-tight) fluidic connection to ports or other such features in the illumination device.

The foregoing principles of incorporating synthetic jet ejectors and their components into the structure of host devices allows illumination devices to be produced which may feature a variety of arrangements for synthetic jet modules. This is illustrated by FIG. Q1-1, which depicts another particular, non-limiting embodiment of an LED-based illumination device in accordance with the teachings herein. The illumination device q1-01 depicted therein is of the general PAR/R 38 form factor and features an LED q1-15 disposed on, and within, a heat sink q1-59. The heat sink q1-59 is disposed within a housing q1-57 that is generally conical in shape and that terminates in a light emitting portion q1-03 on the end opposite of the LED q1-15.

The synthetic jet ejectors q1-09 in this embodiment are placed on the sides of the housing q1-57 and preferably parallel to the sides thereof. This arrangement not only allows the synthetic jet ejectors to be positioned so as to dissipate heat from the heat sink, but also allows the length of the optical element to be significantly longer than would be the case if the synthetic jet ejectors q1-09 were centrally disposed within the housing q1-57, thus improving light output distribution. It also leaves space available for electronics and attachment structures in the upper area of the housing q1-57.

In operation, heat flows from the base of the heat sink q1-59 (where the LED q1-15 is mounted) to the heat fins q1-27, where the turbulent air flow created by the synthetic jets q1-17 emitted by the synthetic jet ejectors q1-09 reject the heat to the environment.

Synthetic jet ejectors may be utilized in the embodiments described herein to induce air flow within an otherwise externally sealed chamber. This principle is demonstrated in FIG. R1-1, which depicts another particular, non-limiting embodiment of an LED-based illumination device in accordance with the teachings herein. The illumination device r1-01 depicted therein uses a synthetic jet actuator to create a first fluidic flow in the optical dome that forms the light emitting portion r1-03 of an A-lamp LED light bulb. The light emitting portion r1-03 is fed by one or more apertures or nozzles that are in fluidic communication with the diaphragm r1-83 and motor r1-85 chambers ("diaphragm" and "motor") inside the illumination device. The first fluidic flow causes fluid to be moved back and forth between the diaphragm r1-83 and motor r1-85 chambers via the light emitting portion, thus dissipating heat in the light emitting portion r1-03.

In some embodiments, a second fluidic flow may occur at apertures or nozzles r1-41. In these embodiments, the second fluidic flow may be utilized, for example, to disperse the heated fluid generated by the first fluidic flow to the ambient environment, or to cool or thermally manage another heat source or device.

FIG. R2-1 depicts another particular, non-limiting embodiment of an LED-based illumination device in accordance with the teachings herein. This device is similar in many respects to the device of FIG. R1-1, but is further equipped with a tubing r2-37 or other suitable conduit which is equipped with a heat sink r2-59.

APPENDIX A

Parts List

01: Illumination device
03: Light Emitting Portion
05: Electrical Connector Module
07: Synthetic Jet Actuator
09: Synthetic Jet Ejector
11: Actuator Housing
13: Diaphragm
15: LED
17: Synthetic Jet
19: Internal Aperture
20: Aperture in Actuator Housing
21: External Aperture
23: External Vent
25: Pedestal
27: Heat Fin
29: Synthetic Jet Ejector/Heat Sink Combination
31: LED Support Structure
32: Heat Sink Support Structure
33: Active Diaphragm
35: Passive Diaphragm
37: Channel
39: Externally Mounted LED
41: Nozzle
43: Synthetic Jet Actuator Support Structure
45: Reflective Material

47: Porous Medium
49: Heat Pipe
51: Internal Chamber
53: Region
55: Internal Housing Element
57: External Housing Element
59: Heat Sink
63: Arrow
65: Heat Spreader
67: Voice Coils
69: Diaphragm
71: $1^{st}$ Channel
73: $2^{nd}$ Channel
75: Upper Wall
76: Lower Wall
77: Heat Sink Cover
79: Base
81: Magnet
83: $1^{st}$ Compartment
85: $2^{nd}$ Compartment
87: Piston
89: Surround
91: Gasket
93: Light Fixture
95: Power Cable
97: Light Socket The above description of the present invention is illustrative, and is not intended to be limiting. It will thus be appreciated that various additions, substitutions and modifications may be made to the above described embodiments without departing from the scope of the present invention. Accordingly, the scope of the present invention should be construed in reference to the appended claims.

What is claimed is:

1. A light source, comprising:

a light-emitting portion;

a connector module which releasably connects the light source to an electrical outlet;

a heat sink disposed between said connector module and said light-emitting portion; and a synthetic jet actuator, disposed at least partially within said heat sink or at least partially within said connector module, which drives a plurality of synthetic jets across a surface of said heat sink.

2. The light source of claim 1, wherein said connector module has at least one nozzle defined therein which is adapted to direct at least one synthetic jet across a surface of said heat sink.

3. The light source of claim 1, wherein said connector module has a threaded external surface.

4. The light source of claim 1, wherein said synthetic jet actuator is disposed at least partially within said heat sink.

5. The light source of claim 1, wherein said synthetic jet actuator is disposed within said heat sink.

6. The light source of claim 1, wherein said synthetic jet actuator is disposed at least partially within said connector module.

7. The light source of claim 1, wherein said synthetic jet actuator is disposed within said connector module.

8. The light source of claim 1, wherein said connector module has a plurality of nozzles defined therein which are adapted to direct a plurality of synthetic jets across at least one surface of said heat sink.

9. The light source of claim 1, wherein said heat sink has a central compartment with a plurality of heat fins extending therefrom, and wherein said synthetic jet actuator is disposed within said central compartment.

10. The light source of claim 9, wherein each of said heat fins has a major surface, wherein said central compartment is equipped with a plurality of apertures which are in fluidic communication with said synthetic jet actuator, and wherein said synthetic jet actuator operates to direct a plurality of synthetic jets from said plurality of apertures across the major surfaces of said heat fins.

11. The light source of claim 9, wherein said plurality of apertures include first and second sets of apertures which direct synthetic jets in first and second opposing directions.

12. The light source of claim 9, wherein said synthetic jet actuator is equipped with first and second diaphragms, and wherein each of said first and second diaphragms has a major surface which is parallel to the longitudinal axis of said light source.

13. The light source of claim 9, wherein said synthetic jet actuator is equipped with first and second diaphragms, and wherein each of said first and second diaphragms has a major surface which is perpendicular to the longitudinal axis of said light source.

14. The light source of claim 1, wherein said heat sink has a first end which abuts said connector module, and a second end which abuts said light emitting portion.

15. The light source of claim 14, further comprising an LED disposed on said first end of said heat sink.

16. The light source of claim 9, wherein said heat sink is equipped with a plurality of channels that are in fluidic communication with said central compartment, and wherein each of said plurality of channels extends through one of said heat fins.

17. The light source of claim 9, wherein said central compartment is equipped with a plurality of apertures which are in fluidic communication with said light emitting portion.

18. The light source of claim 17, wherein said synthetic jet actuator operates to direct a plurality of synthetic jets from said plurality of apertures.

19. The light source of claim 17, further comprising a thermally conductive element having a first portion which extends over said central compartment and a second portion which extends over said heat fins, and wherein said apertures are disposed in said first portion.

20. The light source of claim 19, further comprising a plurality of LEDs disposed on said second portion of said thermally conductive element.

* * * * *